US011267118B2

(12) United States Patent
Kamiya

(10) Patent No.: US 11,267,118 B2
(45) Date of Patent: Mar. 8, 2022

(54) ELECTRIC POWER TOOL

(71) Applicant: MAKITA CORPORATION, Anjo (JP)

(72) Inventor: Takeshi Kamiya, Anjo (JP)

(73) Assignee: MAKITA CORPORATION, Anjo (JP)

( * ) Notice: Subject to any disclaimer, the term of this patent is extended or adjusted under 35 U.S.C. 154(b) by 286 days.

(21) Appl. No.: 16/416,406

(22) Filed: May 20, 2019

(65) Prior Publication Data

US 2020/0147776 A1 May 14, 2020

(30) Foreign Application Priority Data

Nov. 8, 2018 (JP) ..... JP2018-210809
Nov. 8, 2018 (JP) ..... JP2018-210810
Nov. 8, 2018 (JP) ..... JP2018-210811

(51) Int. Cl.
*B25D 16/00* (2006.01)

(52) U.S. Cl.
CPC .... *B25D 16/006* (2013.01); *B25D 2216/0084* (2013.01); *B25D 2250/095* (2013.01); *B25D 2250/121* (2013.01); *B25D 2250/265* (2013.01)

(58) Field of Classification Search
CPC ..... B25D 16/006; B25D 2216/0084; B25D 2250/095; B25D 2250/121; B25D 2250/265
See application file for complete search history.

(56) References Cited

U.S. PATENT DOCUMENTS

2016/0211730 A1* 7/2016 Niwa ..... B25F 5/008
2017/0157753 A1* 6/2017 Nagasaka ..... B25B 21/023

FOREIGN PATENT DOCUMENTS

JP 2003-220570 A 8/2003
JP 2012-218088 A 11/2012
JP 2016-150431 A 8/2016
JP 2016-214042 A 12/2016
JP 2017-100259 A 6/2017

OTHER PUBLICATIONS

Jan. 5, 2022 Office Action issued in Japanese Patent Application No. 2018-108877.

* cited by examiner

*Primary Examiner* — Anna K Kinsaul
*Assistant Examiner* — Daniel Jeremy Leeds
(74) *Attorney, Agent, or Firm* — Oliff PLC

(57) ABSTRACT

An electric power tool includes a motor, a spindle, a first vibration cam, a housing, a second vibration cam, a vibration switching member, and a plurality of biasing members. The spindle is rotatable by the motor. The first vibration cam is fixed to the spindle. The first vibration cam is located inward of the housing. The second vibration cam is located inward of the housing. The second vibration cam is configured to be in friction with the first vibration cam. The vibration switching member switches between a rotatable condition and an unrotatable condition of the second vibration cam with respect to the housing. The plurality of biasing members bias the vibration switching member.

12 Claims, 42 Drawing Sheets

ELECTRIC POWER TOOL

BACKGROUND

This application claims the benefit of Japanese Patent Application Number 2018-210809 filed on Nov. 8, 2018, Japanese Patent Application Number 2018-210810 filed on Nov. 8, 2018, and Japanese Patent Application Number 2018-210811 filed on Nov. 8, 2018, the entirety of which is incorporated by reference.

TECHNICAL FIELD

The disclosure relates to an electric power tool such as an electric vibration driver drill or an electric vibration drill.

RELATED ART

As described in Japanese Patent Application Publication No. 2017-100259, there has been known a vibration driver drill in which vibration switching levers 66 as vibration switching members that switch presence/absence of vibrations are entered into a pair of respective slits 64, which are formed from a front end of a small diameter portion 39 of a second gear case 37 along an axial direction.

Each of the vibration switching levers 66 is movable back and forth in the slit 64 and is biased forward by one coil spring 65. On the front side of the respective vibration switching levers 66, a cam ring 84 of a mode change ring 82 is located. Rotation of the mode change ring 82 at a position corresponding to a vibration mode causes the respective vibration switching levers 66 to enter cam depressed portions in the cam ring 84 and move forward, and thus the respective vibration switching levers 66 engage with claws 60 in a second cam 56 of a vibration mechanism 54 located between the respective vibration switching levers 66. The engagement of the respective vibration switching levers 66 makes the second cam 56 unrotatable around an axis, and a contact with a first cam 55, which rotates integrally with a spindle 5, generates vibrations by the first cam 55 and the second cam 56 (vibration mechanism 54).

Additionally, as described in Japanese Patent Application Publication No. 2012-218088, there has been known a vibration driver drill that includes a mode switching ring 79 switching a mode between a clutch mode, a drill mode, and a vibration mode. Switching the clutch mode to the drill mode or the vibration mode causes restriction pins 107, which enter into cutouts 110 in an insertion portion 81 of the mode switching ring 79 from rearward, to exit from the cutouts 110 and run onto a rear end edge of the insertion portion 81 to retreat. Then, the restriction pins 107 engage with external teeth 32 on an internal gear 23C in a planetary gear reduction mechanism 20 to lock a rotation of the internal gear 23C.

The restriction pin 107 has a large-diameter head portion 108 on its front end and is biased forward by a coil spring 109 externally mounted on the rear side of the head portion 108.

A main object of the disclosure is to provide an electric power tool that includes compact vibration switching means including a vibration switching member and further is entirely compact.

Further, another main object of the disclosure is to provide an electric power tool which is compact in a radial direction.

Further, yet another main object of the disclosure is to provide an electric power tool that reduces an amount of lubricant leaked from a gear case.

Additionally, yet another main object of the disclosure is to provide an electric power tool that improves strength of the gear case.

SUMMARY

In order to achieve the above-described object, there is provided an electric power tool according to a first aspect of the disclosure. The electric power tool includes a motor, a spindle, a first vibration cam, a housing, a second vibration cam, a vibration switching member, and a plurality of biasing members. The spindle is rotatable by the motor. The first vibration cam is fixed to the spindle. The first vibration cam is located inward of the housing. The second vibration cam is located inward of the housing. The second vibration cam is configured to be in friction with the first vibration cam. The vibration switching member switches between a rotatable condition and an unrotatable condition of the second vibration cam with respect to the housing. The plurality of biasing members bias the vibration switching member.

In the disclosure according to a second aspect of the above-described disclosure, three or more of the biasing members may be disposed and circumferentially arranged.

In the disclosure according to a third aspect of the above-described disclosure, a plurality of the vibration switching members may be disposed and circumferentially arranged.

In the disclosure according to a fourth aspect of the above-described disclosure, the second vibration cam may include a claw. The vibration switching member may include a vibration switching claw. The vibration switching claw may be hooked to the claw to block the rotation of the second vibration cam.

In order to achieve the above-described object, there is provided an electric power tool according to a fifth aspect of the disclosure. The electric power tool includes a motor, a planetary gear, an internal gear, an internal gear lock pin, and a plurality of elastic bodies. The planetary gear is driven by the motor. The internal gear meshes with the planetary gear. The internal gear lock pin blocks a rotation of the internal gear. The plurality of elastic bodies bias the internal gear lock pin. The plurality of elastic bodies have center axes different from a center axis of the internal gear lock pin. The plurality of elastic bodies are circumferentially arranged.

In the disclosure according to a sixth aspect of the above-described disclosure, a plurality of the internal gear lock pins may be disposed.

In the disclosure according to a seventh aspect of the above-described disclosure, the plurality of elastic bodies may be located radially inward of the internal gear lock pin.

In the disclosure according to an eighth aspect of the above-described disclosure, the internal gear lock pin may be held to the pin holder. The plurality of elastic bodies may bias the internal gear lock pin via the pin holder.

The disclosure according a ninth aspect of the above-described disclosure may further include a clutch pin in contact with the internal gear and a clutch washer in contact with the clutch pin. An elastic holder may be located radially inward of the clutch washer. The elastic holder may hold the elastic bodies in the pin holder.

The disclosure according to a tenth aspect of the above-described disclosure may further include a clutch pin in contact with the internal gear and a clutch washer in contact with the clutch pin. The clutch washer may include a bottom through which the internal gear lock pin passes.

In order to achieve the above-described object, there is provided an electric power tool according to an eleventh aspect of disclosure. The electric power tool includes a motor, a spindle, a first vibration cam, a housing, a second vibration cam, and a vibration switching member. The spindle is rotatable by the motor. The first vibration cam is fixed to the spindle. The first vibration cam is located inward of the housing. The second vibration cam is located inward of the housing. The second vibration cam is configured to be in friction with the first vibration cam. The vibration switching member switches between a rotatable condition and an unrotatable condition of the second vibration cam with respect to the housing. A plurality of the vibration switching members are circumferentially arranged and disposed to be movable back and forth.

In the disclosure according to a twelfth aspect of the above-described disclosure, the vibration switching members may form a ring shape in combination.

In the disclosure according to a thirteenth aspect of the above-described disclosure, the housing may include a main body housing and a gear housing located inward of the main body housing. The vibration switching members may be located inward of the main body housing and outward of the gear housing.

In the disclosure according to a fourteenth aspect of the above-described disclosure, the vibration switching member may include a vibration switching cam portion for the vibration switching member to axially move.

A main effect of the disclosure is to provide an electric power tool that includes compact vibration switching means including a vibration switching member and further is entirely compact.

Further, another main effect of the disclosure is to provide an electric power tool which is compact in a radial direction.

Further, yet another main effect of the disclosure is to provide an electric power tool that reduces an amount of lubricant leaked from a gear housing.

Additionally, yet another effect of the disclosure is to provide an electric power tool that improves strength of the gear housing.

DETAILED DESCRIPTION

The following describes embodiments and modification examples of the embodiments of the disclosure with reference to the drawings as necessary. The front, rear, up, down, right, and left are defined in these embodiments and modification examples for convenience of explanation and therefore may change depending on at least one of a work condition, a state of a moving member, and a similar state. The disclosure is not limited to the following embodiments and modification examples.

Figure 1:
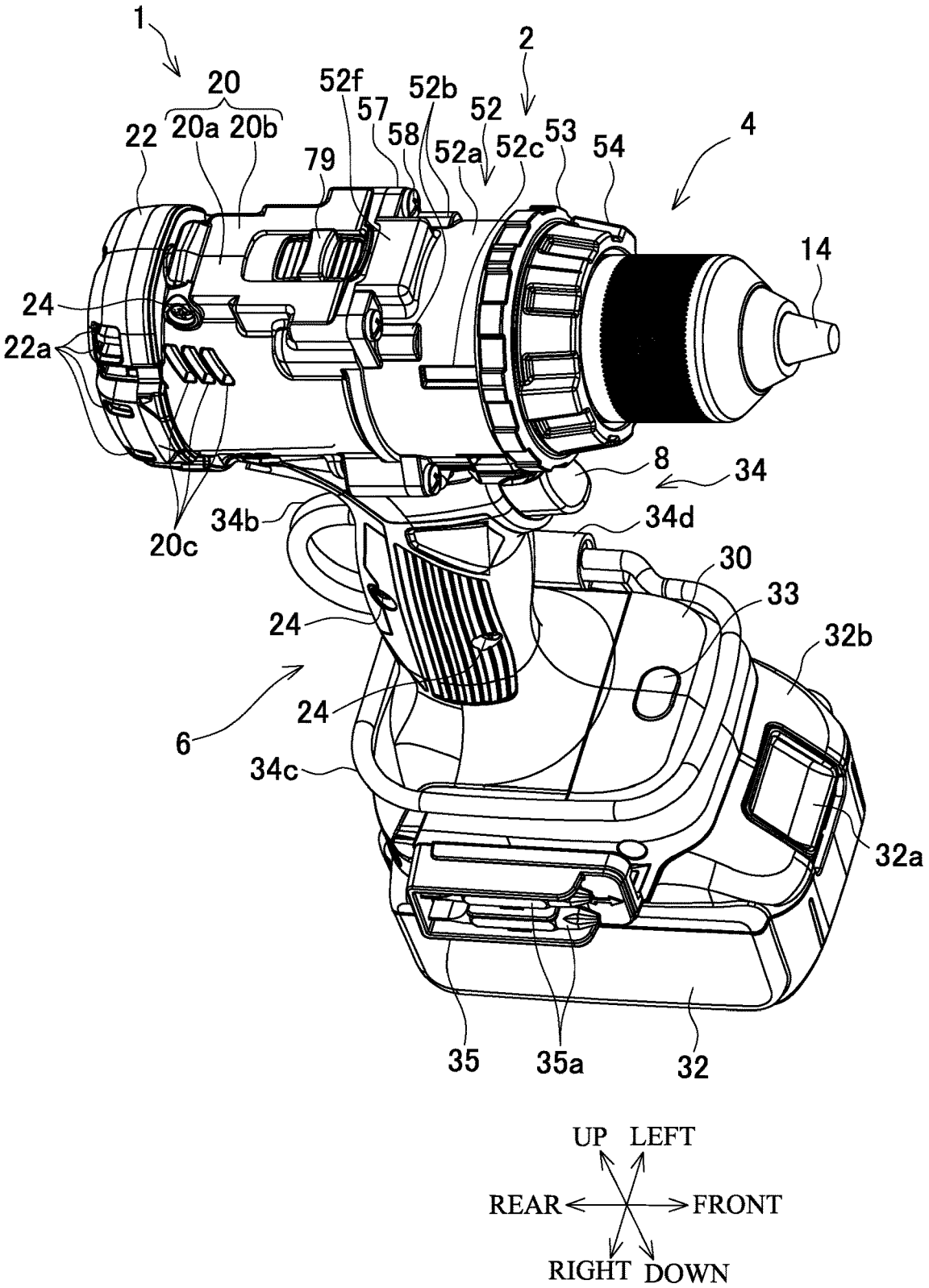
FIG. 1 is a perspective view of a driver drill according to the disclosure.
Figure 2:
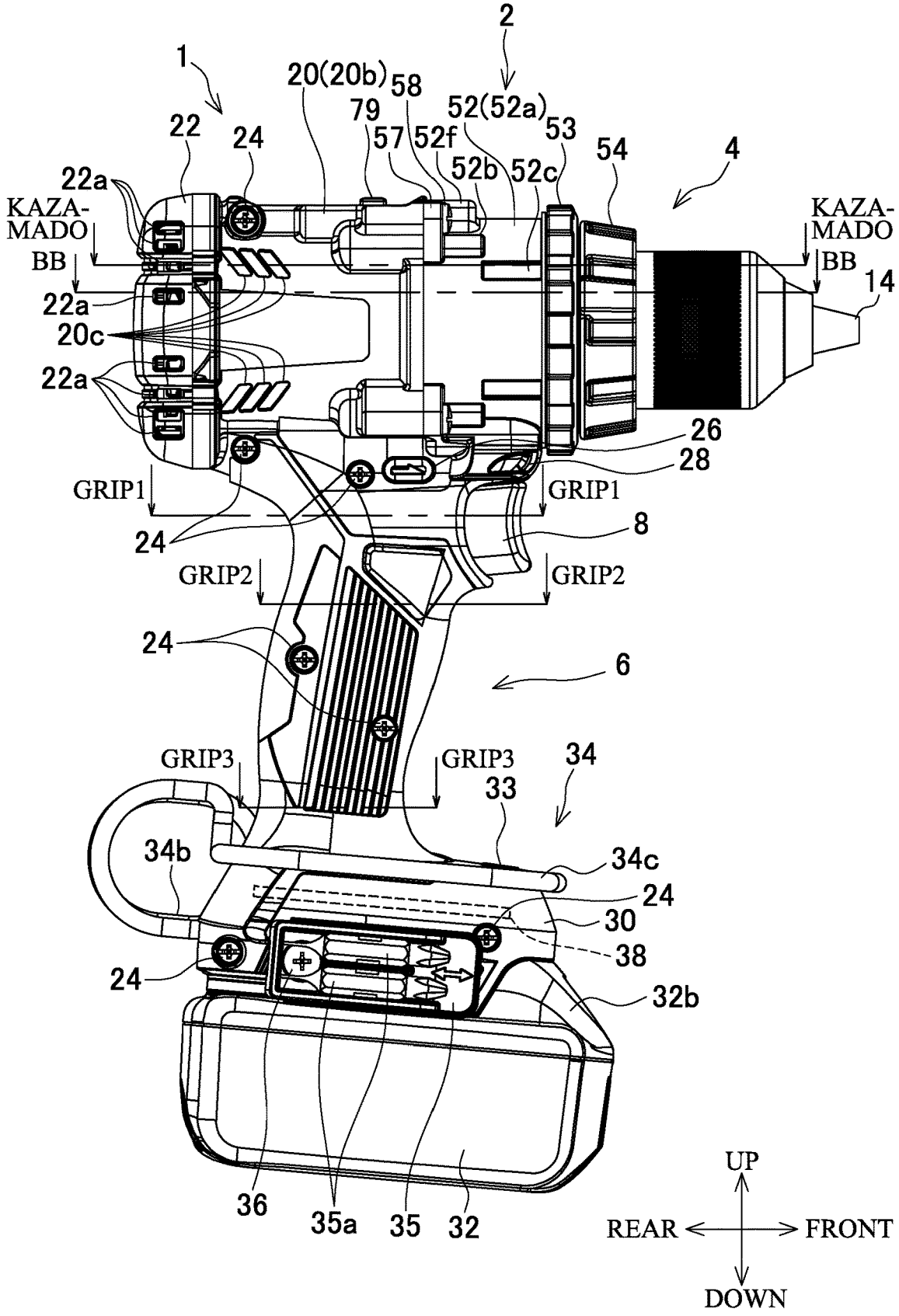
FIG. 2 is a right view of FIG. 1.
Figure 3:
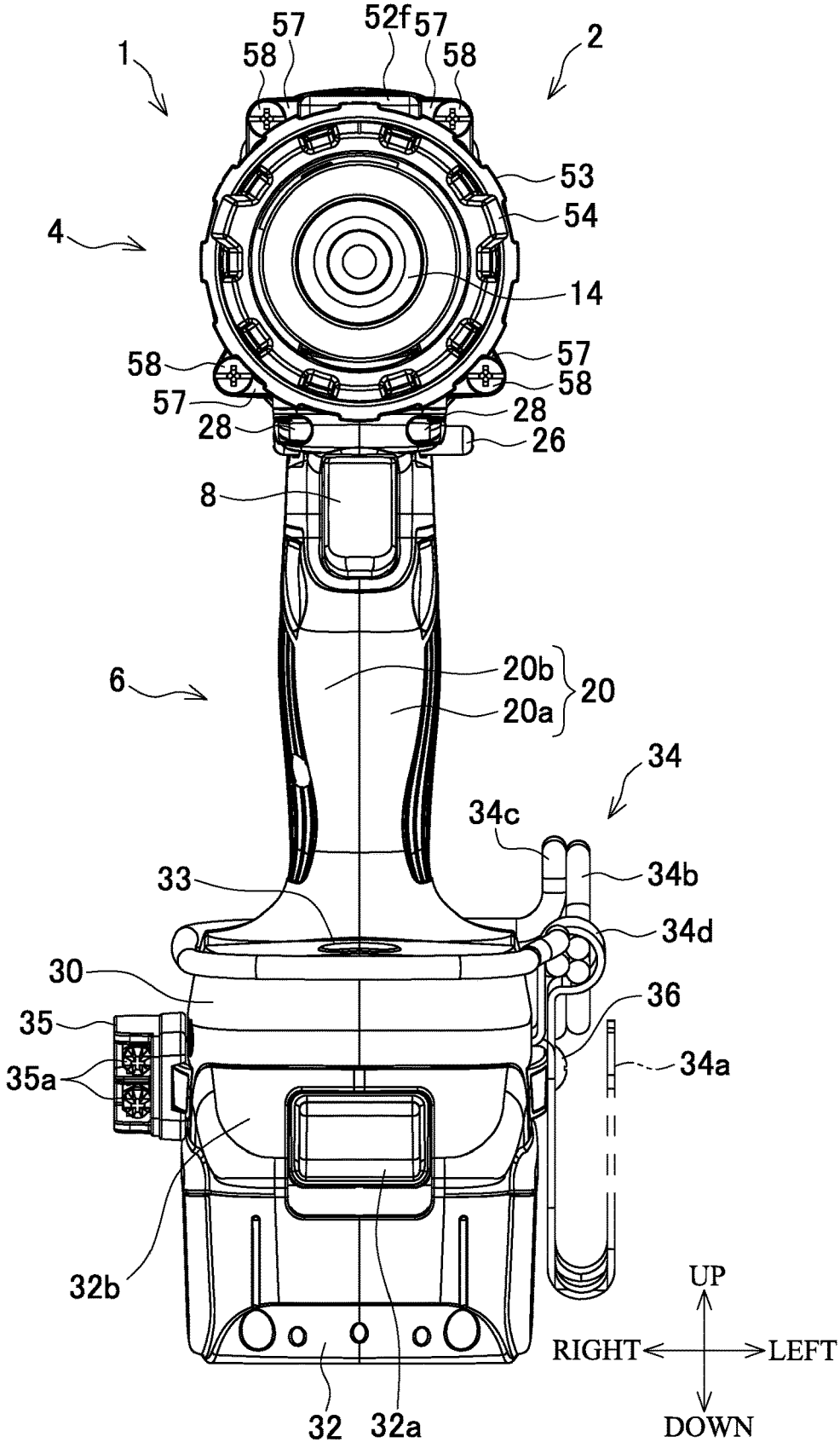
FIG. 3 is a front view of FIG. 1.
Figure 4:
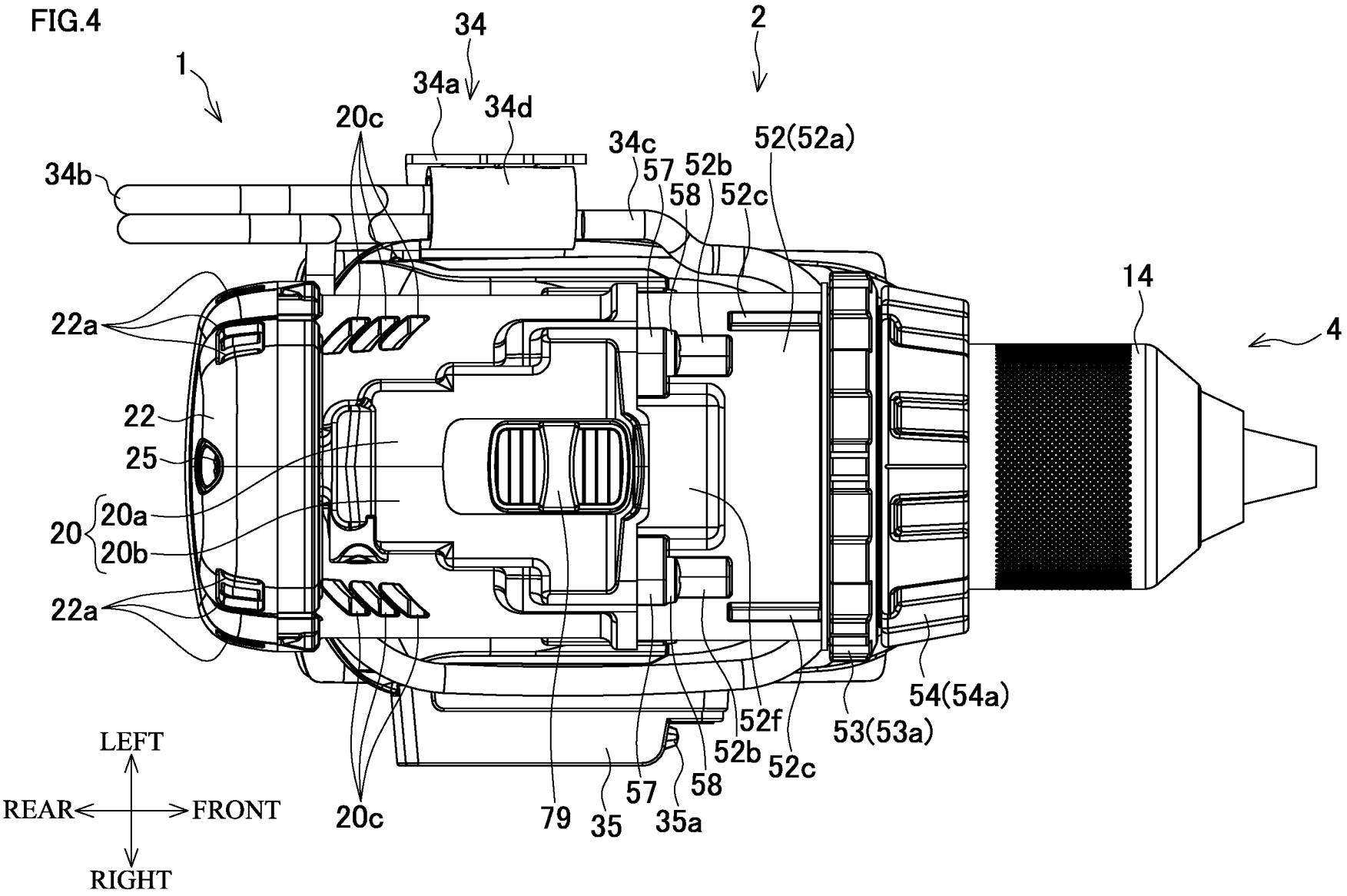
FIG. 4 is a top view of FIG. 1.
Figure 5:
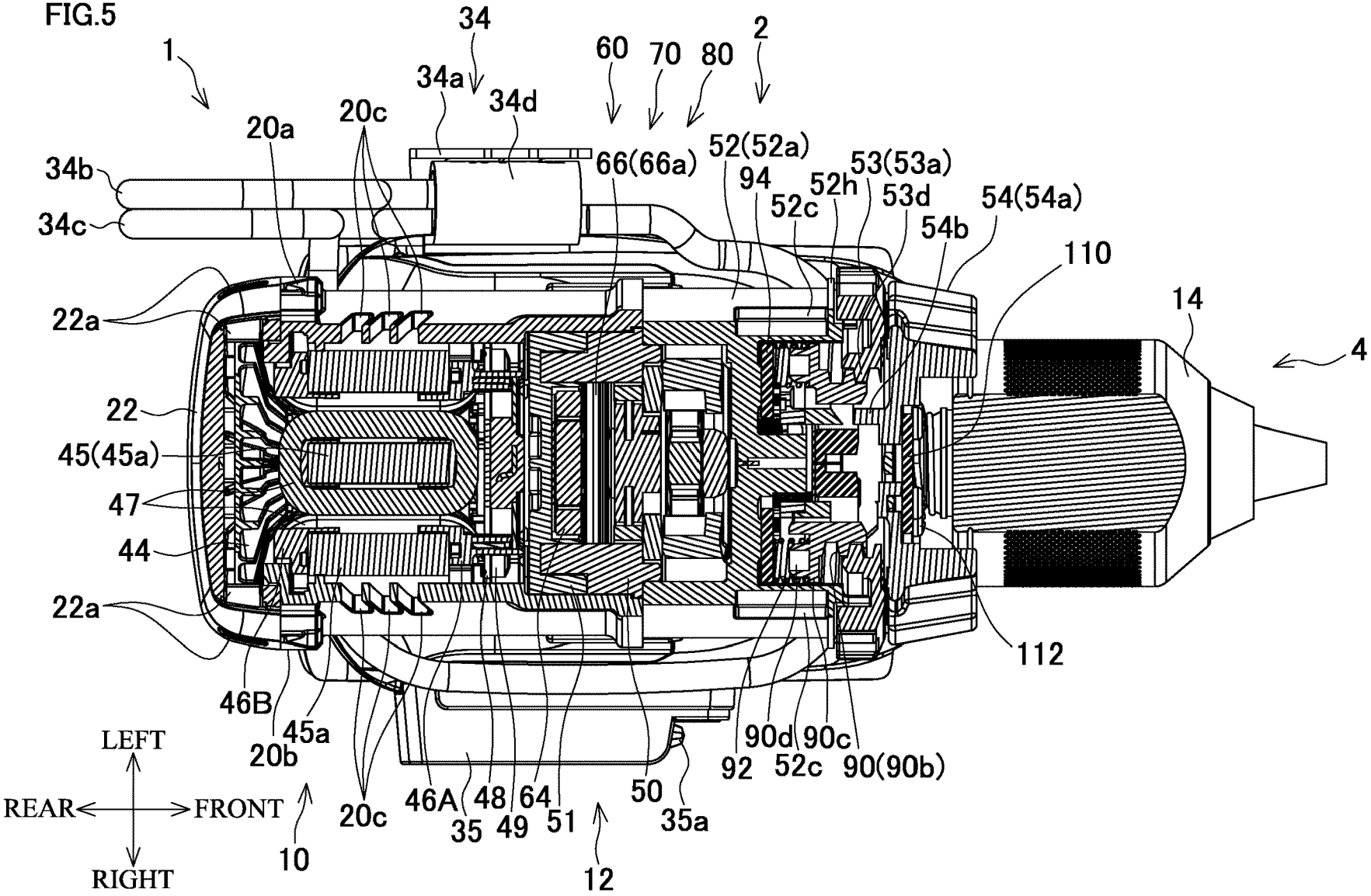
FIG. 5 is a cross-sectional view taken along KAZAMADO-KAZAMADO of FIG. 2.
Figure 6:
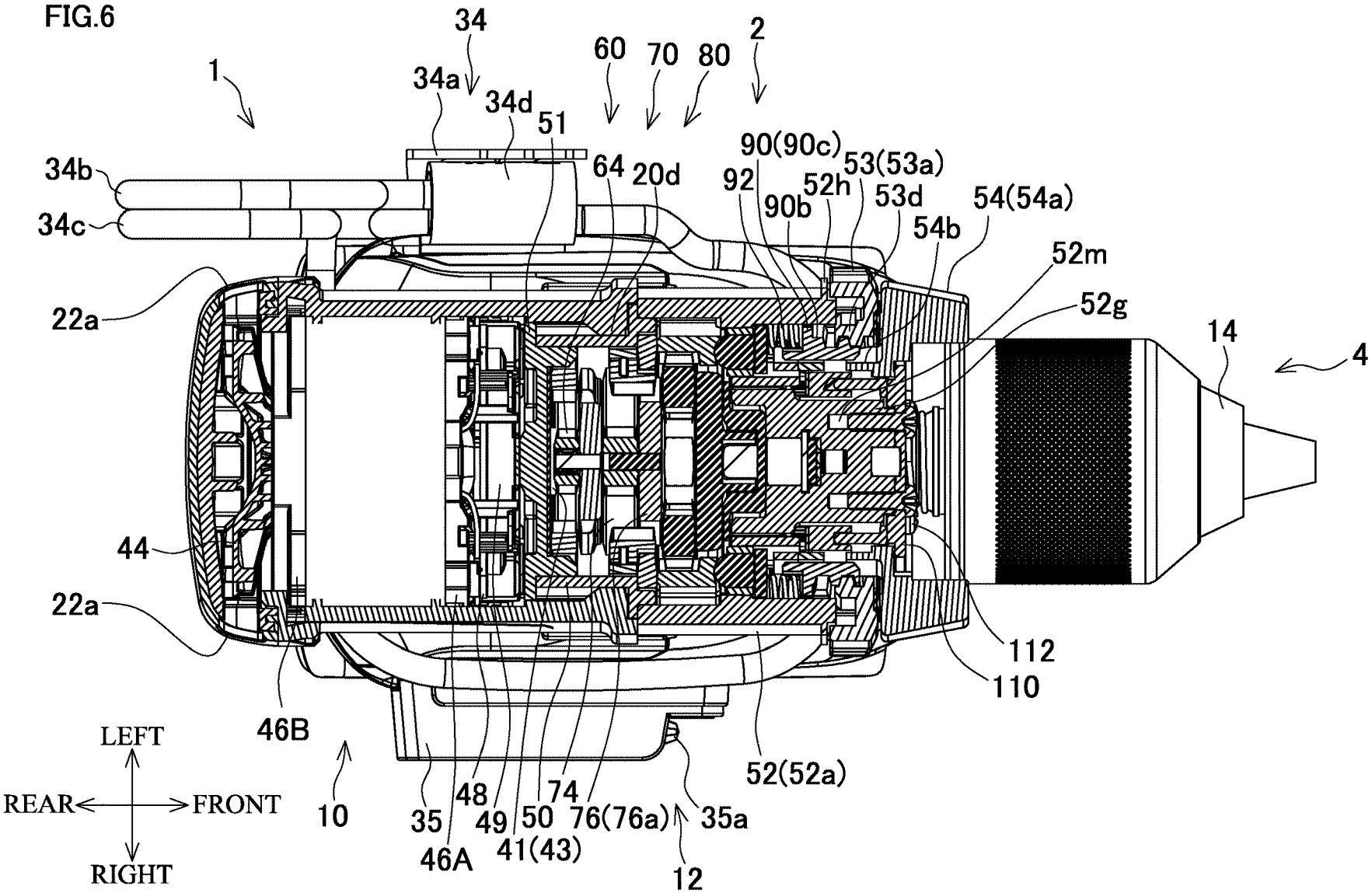
FIG. 6 is a cross-sectional view taken along BB-BB of FIG. 2.
Figure 7:
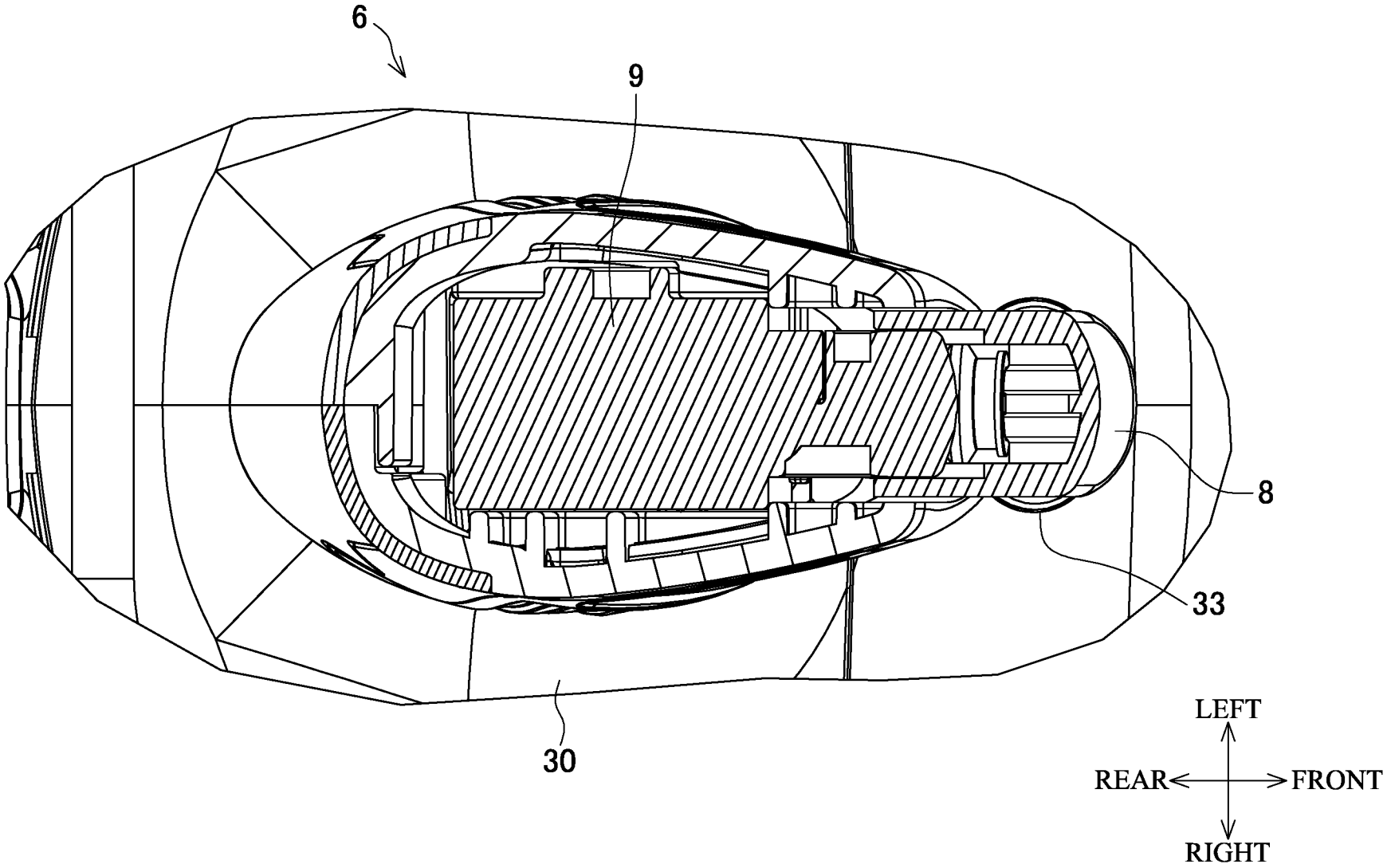
FIG. 7 is a cross-sectional view taken along GRIP1-GRIP1 of FIG. 2.
Figure 8:
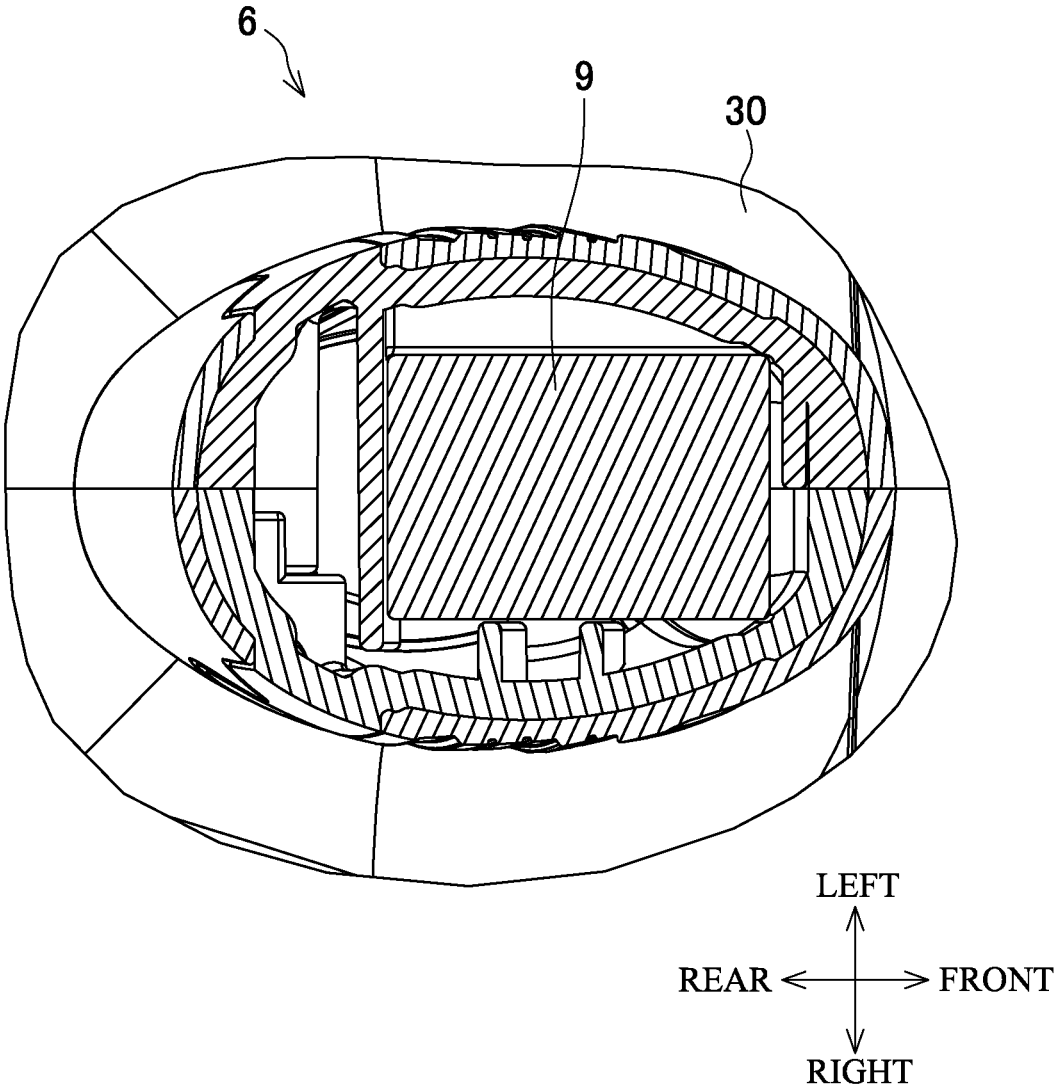
FIG. 8 is a cross-sectional view taken along GRIP2-GRIP2 of FIG. 2.
Figure 9:
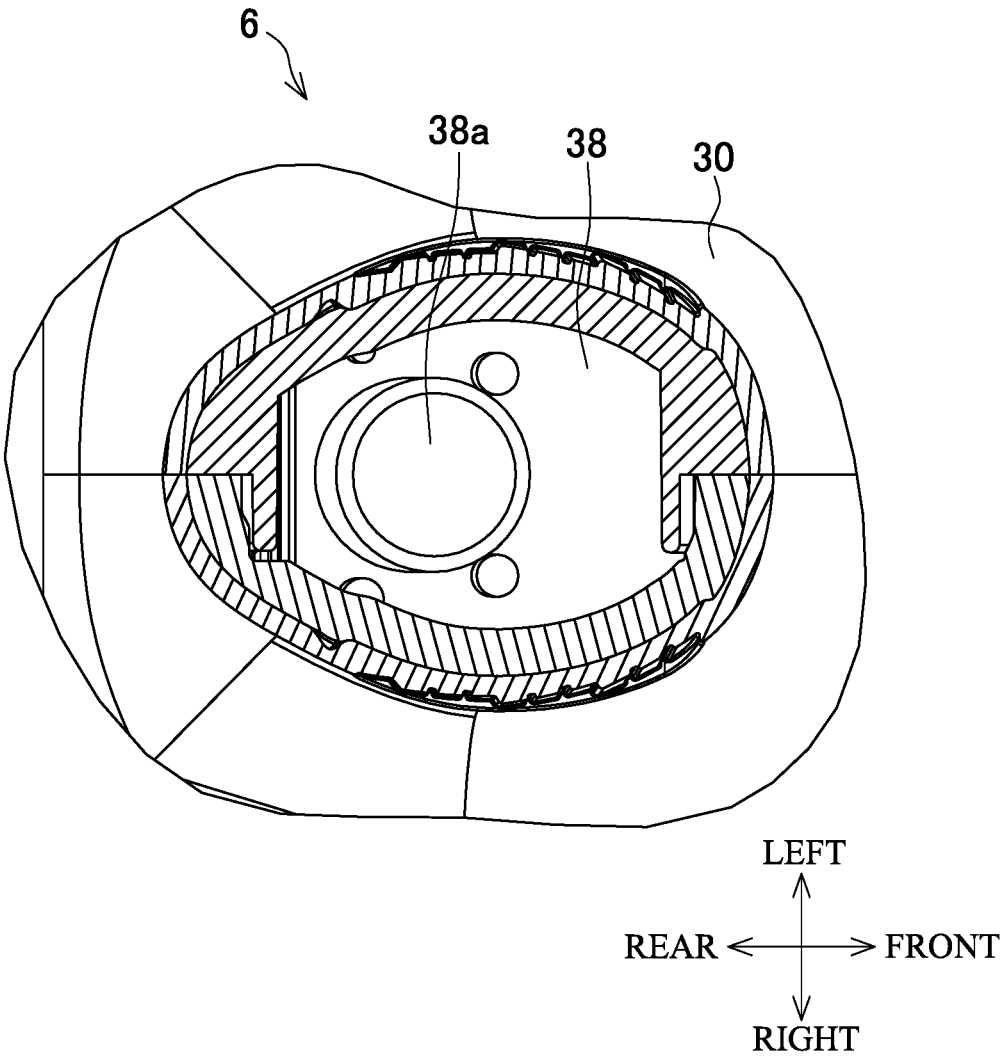
FIG. 9 is a cross-sectional view taken along GRIP3-GRIP3 of FIG. 2.
Figure 10:
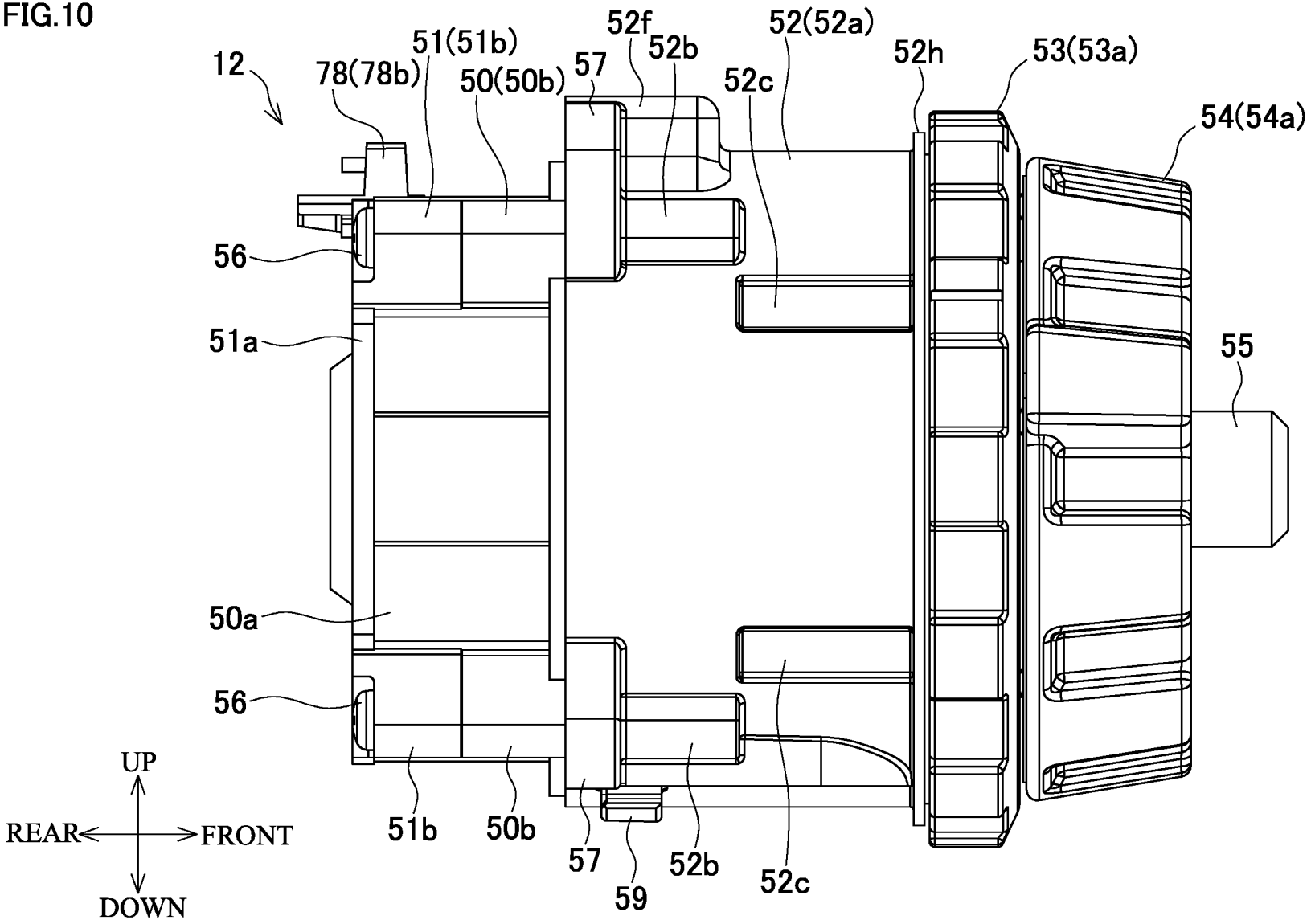
FIG. 10 is a right view of a gear assembly in an electric vibration driver drill of FIG. 1.

FIG. 1 is a perspective view of an electric vibration driver drill 1 as one example of an electric power tool. FIG. 2 is a right view of the electric vibration driver drill 1. FIG. 3 is a front view of the electric vibration driver drill 1. FIG. 4 is a top view of the electric vibration driver drill 1. FIG. 5 is a cross-sectional view taken along KAZAMADO-KAZAMADO of FIG. 2. FIG. 6 is a cross-sectional view taken along BB-BB of FIG. 2. FIG. 7 is a cross-sectional view taken along GRIP1-GRIP1 of FIG. 2. FIG. 8 is a cross-sectional view taken along GRIP2-GRIP2 of FIG. 2. FIG. 9 is a cross-sectional view taken along GRIP3-GRIP3 of FIG. 2.

The electric vibration driver drill 1 includes a housing 2 forming its outer wall.

The electric vibration driver drill 1 includes a tubular main body 4 having a center axis in a front-rear direction and a grip portion 6 formed so as to project downward from the lower portion of the main body 4. Note that the right is the front and the up is the up in FIG. 2, and the up is the left and the right is the front in FIG. 4.

The grip portion 6 is a part gripped by a user and includes a trigger type switch lever 8 on which a pulling operation by a fingertip of the user is possible on its upper end portion. The switch lever 8 projects from a switch main body 9 (see FIG. 7 and FIG. 8).

As illustrated in FIG. 5 and FIG. 6, a motor 10 is housed in the rear portion of the main body 4 of the electric vibration driver drill 1. A gear assembly 12 is located on the front side of the motor 10. On the front side of the gear assembly 12, a chuck 14 configured to grip a bit (tool bit) is disposed.

The motor 10 is a driving source for the electric vibration driver drill 1. A rotation of the motor 10 is decelerated and transmitted in the gear assembly 12 and then is transmitted to the chuck 14 and the bit. Note that FIG. 6 omits a part of the motor 10.

The housing 2 includes a main body housing 20 made of resin in which the motor 10, the switch main body 9, and the like are held and a rear cover 22 made of resin covering the rear of the motor 10.

The main body housing 20 includes an outer wall of the grip portion 6.

The main body housing 20 includes half left main body housing 20*a* and right main body housing 20*b*. The left main body housing 20*a* includes a plurality of screw boss portions, and the right main body housing 20*b* has screw-holes corresponding to the screw boss portions. The left main body housing 20*a* and the right main body housing 20*b* are combined with screws 24 in a right-left direction inserted into the respective sets of the screw-holes and the screw boss portions.

The respective rear portions of the left main body housing 20*a* and the right main body housing 20*b* in the main body 4 are combined with one another to form an opening. The rear cover 22 is fastened to the opening with a plurality of screws 25 extending in the front-rear direction. The respective screws 25 are located up and down (only the upper screw 25 is illustrated) to surely fix the rear cover 22. A plurality of air inlets 20*c* extending in an up-down direction are open so as to be arranged in the front-rear direction on the upper and the lower side portions of the rear end portions of the left main body housing 20*a* and the right main body housing 20*b*. That is, the plurality of air inlets 20*c* are formed into continuous slit shapes located along parts adjacent to the front of the rear cover 22. Further, a plurality of exhaust outlets 22*a* each extending in the front-rear direction are open so as to be arranged up and down on the side portions of the rear cover 22 and at the rear of the respective air inlets 20*c*.

As illustrated in FIG. 2 and FIG. 3, at the rear of the switch lever 8, a forward-reverse switching lever 26, a switch switching a rotation direction of the motor 10, is disposed so as to penetrate from side to side in a boundary region between the main body 4 and the grip portion 6.

Additionally, a plurality (two pieces) of lights 28 that can irradiate the front side are disposed so as to be located side by side on the upper side of the switch lever 8 and on the front of the forward-reverse switching lever 26. Here, the respective lights 28 are LEDs.

The grip portion 6 has a lower end portion where a battery mounting portion 30, which expands outward from its upper portion, is disposed. A battery 32 is held to the lower side of the battery mounting portion 30 to be attachable/detachable with a battery button 32*a*. The battery 32 is a lithium-ion battery and includes a plurality of cells (not illustrated). The cells have columnar shapes long in an axial direction and face the right-left direction.

On the front upper portion of the battery mounting portion 30 (on the top surface portion on the front side of the expanded lower portion of the grip portion 6), a display unit 33 that displays a state of an electronic gear by a lighting aspect of a plurality of lamps is disposed.

With a battery terminal portion upward and a bulge portion 32*b* upward and forward, the battery 32 is slid rearward from the front of the battery mounting portion 30 to be mounted. During the installation, the rear portion of the bulge portion 32*b* abuts on the front portion of the battery mounting portion 30, and the battery terminal portion contacts a battery mounting terminal portion of the battery mounting portion 30. Moreover, during the installation, a battery claw biased upward by an elastic member and projecting from a top surface of another part of the battery 32 enters a concave battery mounting portion hollowed upward and disposed on the lower front portion of the battery mounting portion 30. Meanwhile, when the battery 32 is removed, while the battery button 32*a* coupled to the elastic member for the battery claw is operated to disengage the battery claw with the concave battery mounting portion, the battery 32 is slid forward.

Respective hook 34 and bit holder 35 are located on the battery mounting portion 30. The hook 34 and the bit holder 35 are mountable to the left portion or the right portion of the battery mounting portion 30 with a screw 36. The hook 34 includes a U hook 34*a* having a "U" shape in front view, a first loop hook 34*b* having an "Ω" shape in side view, and a second loop hook 34*c* having a part along the first loop hook 34*b* and a loop-shaped part in top view. The parallel front end portion of the first loop hook 34*b* and both end portions of the second loop hook 34*c* are held in a tubular portion 34*d*, which is formed on the upper end portion of the U hook 34*a* having an axial direction in the front-rear direction. The bit holder 35 holds a plurality (two pieces) of respective bits 35*a* to be removable by forward sliding. The bits 35*a* are slid rearward with respect to the bit holder 35 to be mountable.

As illustrated in FIG. 2 and FIG. 9, a control circuit board 38 of a controller that controls the motor 10 is held in the battery mounting portion 30. The control circuit board 38 includes a columnar capacitor 38*a*, which projects upward with respect to the other part, and a microcomputer. The control circuit board 38 is electrically coupled to the motor 10 with a power supply lead wire and a signal lead wire (not illustrated). The control circuit board 38 is also electrically coupled to the battery mounting terminal portion of the battery mounting portion 30.

As illustrated in FIG. 5 and FIG. 6, the motor 10 is a brushless motor and includes a cylindrical stator 40 and a rotor 41 located inside the stator 40.

The rotor 41 includes a columnar motor shaft extending in the front-rear direction, a pinion 43 (FIG. 6) integrated with the front end portion of the motor shaft, a cylindrical rotor core located on the peripheral area of the center of the motor shaft, and a permanent magnet located inside the rotor core.

A cooling fan 44 is mounted to the rear of the motor shaft via a metallic insert bush (not illustrated). The fan 44 is a centrifugal fan. The insert bush is press-fitted and has a high fixing force to a motor shalt of the fan 44.

Respective exhaust outlets 22*a* are positioned radially outward of the fan 44.

A motor rear bearing that rotatably supports the rear end portion of the motor shaft is held to the rear side of the fan 44 and the inner surface of the rear portion of the rear cover 22.

The stator 40 includes a stator core 45, ring-shaped front insulating member 46A and rear insulating member 46B, a coil 47, a sensor substrate 48, and a sheet metal member 49 made of synthetic resin. The stator core 45 includes a cylindrical portion having the axial direction in the front-rear direction and a plurality of respective teeth 45*a* projecting radially inward from its inner surface. The front insulating member 46A and rear insulating member 46B are each mounted to the forth and the rear of the stator core 45. The coil 47 is wound around the respective teeth 45*a* via the front insulating member 46A and the rear insulating member 46B. The sensor substrate 48 is mounted to the front side of the front insulating member 46A. The sheet metal member 49 is mounted to the front side of the sensor substrate 48, has a circular shape, and includes a plurality of arc-shaped sheet metals.

The sensor substrate 48 senses a rotation position of the rotor 41 (permanent magnet) and transmits the rotation position to the control circuit board 38.

The sheet metals of the sheet metal member 49 are electrically coupled to the coil 47 to one another in a predetermined aspect and are coupled to the power supply lead wire of the control circuit board 38.

As illustrated from FIG. 10 to FIG. 42, the gear assembly 12 includes a cylindrical gear case 50 as its outer wall, a plate-shaped (dish-shaped) motor bracket 51 located on the rear side of the rear end of the gear case 50, a metallic gear housing 52 in a shape of inner and outer double cylinders located on the front side of the gear case 50, a clutch ring 53 as a clutch switching ring located on the front side of the gear housing 52, exposed in the upper front portion of the housing 2, and externally mounted to the housing 2, and a mode switching ring 54 externally mounted to the housing 2 on the front side similarly to the clutch ring 53.

A spindle 55 is located inside in the radial direction on the front portion of the outer wall in the gear assembly 12 so as to run along the center axis of the gear assembly 12. The spindle 55 has a distal end portion projecting forward from the outer wall of the gear assembly 12.

The spindle 55 is a columnar member having the axial direction in the front-rear direction and includes a spindle flange 55*a*, which expands radially outward at the center in the front-rear direction, a front stepped portion 55*b*, an intermediate stepped portion 55*c*, and a rear stepped portion 554, which are formed at the rear of the spindle flange 55*a* by configuring the respective diameters smaller than those of the front portions, a clip groove 55*e*, which are circumferentially formed on the front side of the intermediate stepped portion 55*c*, and a spindle hole 55*f*, which extends back and forth at the center of the front portion and is open at the front end. The spindle hole 55*f* is a bolt hole having a screw groove. A male threaded portion (not illustrated) is formed on an outer surface radially outward of the spindle hole 55*f* on the front end portion of the spindle 55.

The chuck 14 includes a female threaded portion (not illustrated) corresponding to the male threaded portion of the spindle 55. The chuck 14 receives the male threaded portion of the spindle 55 by the female threaded portion, and an insertion of a bolt (not illustrated) into the spindle hole 55*f* fixes the chuck 14 to the spindle 55. At least one of the spindle 55 and the chuck 14 can be regarded as an output shaft.

The gear case 50 includes a cylindrical gear case base portion 50*a* and has screw-hole portions 50*b* having screw-holes at centers of respective projecting pieces projecting radially outward on upper right, lower right, upper left, and lower left of the gear case base portion 50*a*. Screw-hole portions 51*b* and screw-hole portions 52*b* are similarly formed on a motor bracket base portion 51*a* having a cylindrical shape with bottom of the motor bracket 51 and on a rear portion of an outer tubular portion 52*a* of the gear housing 52. The screw-hole portion 51*b* projects radially outward and forward. The screw-hole portion 52*b* projects radially outward. A screw 56 shared among the screw-hole portions 50*b* and 51*b* and the screw-hole portion 52*b* on the upper right are passed through, and the same applies to the cases of the lower right, the upper left, and the lower left. Thus, the gear case 50 and the gear housing 52 (and the motor bracket 51) are fastened together with shared joining means, which allows close contact between these components. As a result, an internal mechanism is protected, and a leakage of grease (lubricant) or the like can be prevented when the grease or the like is applied on the internal mechanism. Additionally, compared with the case where a joining member of the motor bracket 51 and the gear case 50 and a joining member of the gear case 50 and the gear housing 52 are separately disposed, the above-described configuration achieves the compact gear assembly 12.

Side handle mounting portions 52*c*, which are concave portions in the front-rear direction to receive a "C"-shaped handle-side mounting portion of a side handle (not illustrated), are formed in the outer surface of the front portion of the outer tubular portion 52*a* of the gear housing 52 and parts adjacent to the screw-hole portions 52*b* in the circumferential direction (the lower side of the upper screw-hole portion 52*b* and the upper side of the lower screw-hole portion 52*b*). Inserting forked distal ends of the handle-side mounting portion into the pair of side handle mounting portions 52*c* on the right side and left side mounts the side handle extending in the right-left direction. Even when the side handle is attempted to rotate around the handle-side mounting portion, the screw-hole portions 52*b* projecting circumferentially outward retain the handle-side mounting portion, and therefore this rotation is prevented and the mounting state of the side handle is stably maintained.

With screw-hole portions 57 located radially outward of the respective screw-hole portions 52*b* of the gear housing 52 and screws 58 inserted into screw holes formed on an opening of the main body 4 of the main body housing 20, the gear assembly 12 is mounted to the front of this opening of the main body housing 20. The two upper screw-hole portions 57 have intervals in the right-left direction narrower than intervals of the two lower screw-hole portions 57 in the right-left direction. Accordingly, the respective screw-hole portions 57 are located so as to fit the shape of the columnar main body 4 from which the grip portion 6 extends downward, thereby contributing to the compactification of the upper portion in the right-left direction.

As illustrated in FIG. 6, in the inner surface of this opening of the main body housing 20, a rib 20*d* projecting radially inward is disposed. The rib 20*d* is adjacent to the side surface of the gear case base portion 50*a* at a rear side of a diameter-expanding portion with respect to the gear housing 52. By an operation of the internal mechanism (for example, an intermediate planetary gear mechanism 70 described later) of the gear assembly 12, the rib 20*d* receives a reactive force of stress deformation generated in the gear case 50. Accordingly, the gear assembly 12 is surely held.

On the right and left of the rear portion of the lower surface in the outer tubular portion 52*a* of the gear housing 52, projecting bodies 59 projecting downward and outward in the right-left direction are disposed. The respective projecting bodies 59 are locked to the inner surface of the main body housing 20 to prevent the separation of the gear assembly 12 from the main body housing 20.

The gear housing 52 has the exposed front portion, side portion, and upper portion serving as a part of the outer wall of the main body 4, and the gear housing 52 becomes a part of the housing 2.

In a center hole 51*c* of the motor bracket 51, a motor front bearing (not illustrated) that rotatably supports the pinion 43 (see FIG. 6) on the front end portion of the motor shaft is inserted. As especially illustrated in FIG. 35, the rotation of the motor bracket 51 is prevented by insertion of a plurality (seven pieces) of protrusions 51*d*, which project radially outward from the outer surface of the cylindrical portion of the motor bracket base portion 51*a*, into inner grooves 50*c*, which extend in the front-rear direction, are formed on the inner surface of the rear end portion of the gear case base portion 50*a*, and are hollowed radially outward.

Note that at least any of the motor bracket 51, the clutch ring 53, the mode switching ring 54, and the spindle 55 may be regarded as not a component of the gear assembly 12 but the motor bracket 51 may be regarded as a component of the motor 10. At least any of the chuck 14, the motor front bearing, and the pinion 43 may be regarded as the component of the gear assembly 12.

The gear assembly 12 internally includes three-stage planetary gear mechanisms, decelerates the rotation of the motor shaft, and transmits the rotation to the spindle 55. That is, the gear assembly 12 includes a rear planetary gear mechanism 60 (a deceleration mechanism at the first stage), the intermediate planetary gear mechanism 70 (a deceleration mechanism at the second stage, and a front planetary gear mechanism 80 (a deceleration mechanism at the third stage).

Figure 33:
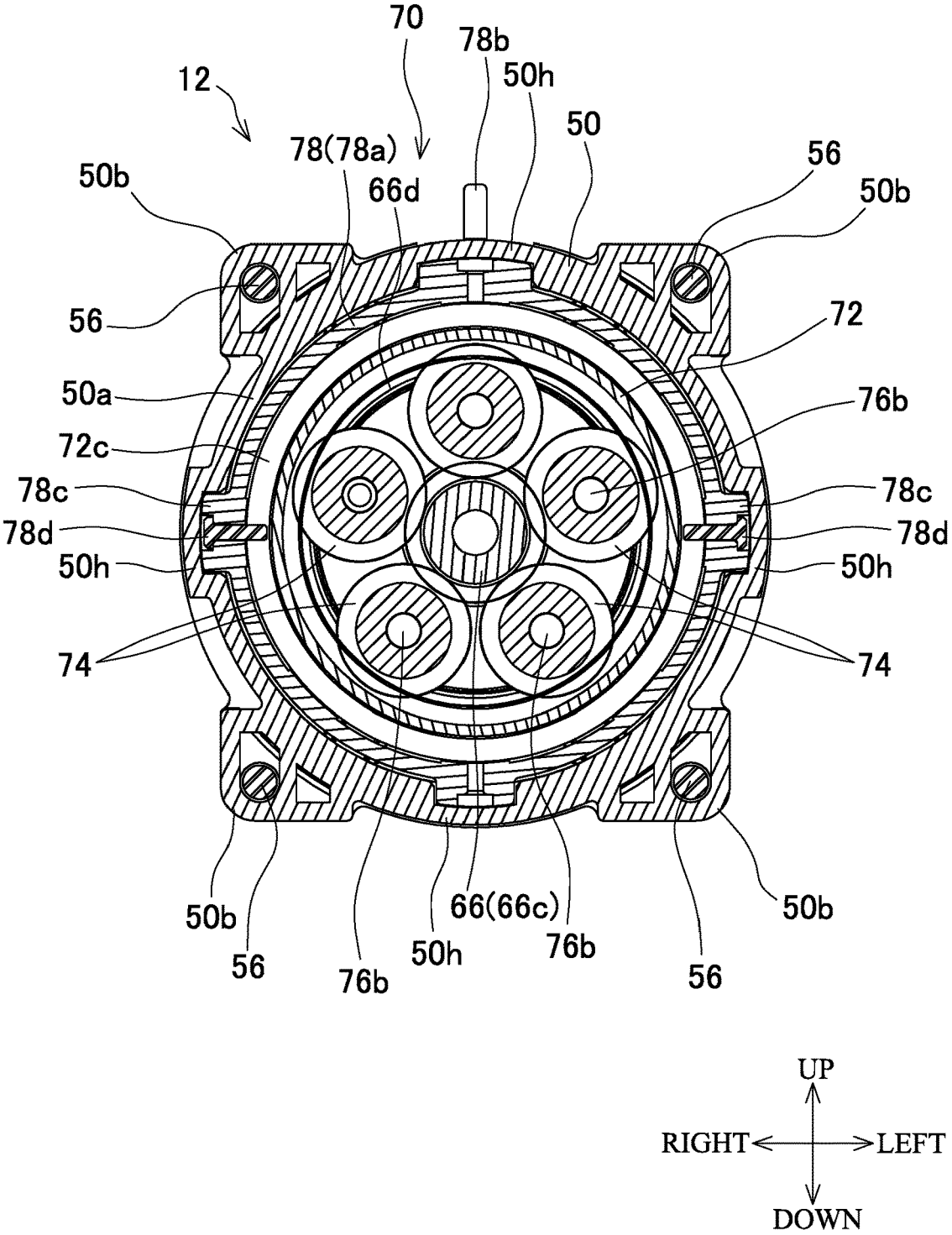
FIG. 33 is a cross-sectional view taken along J-J of FIG. 16.
Figure 34:
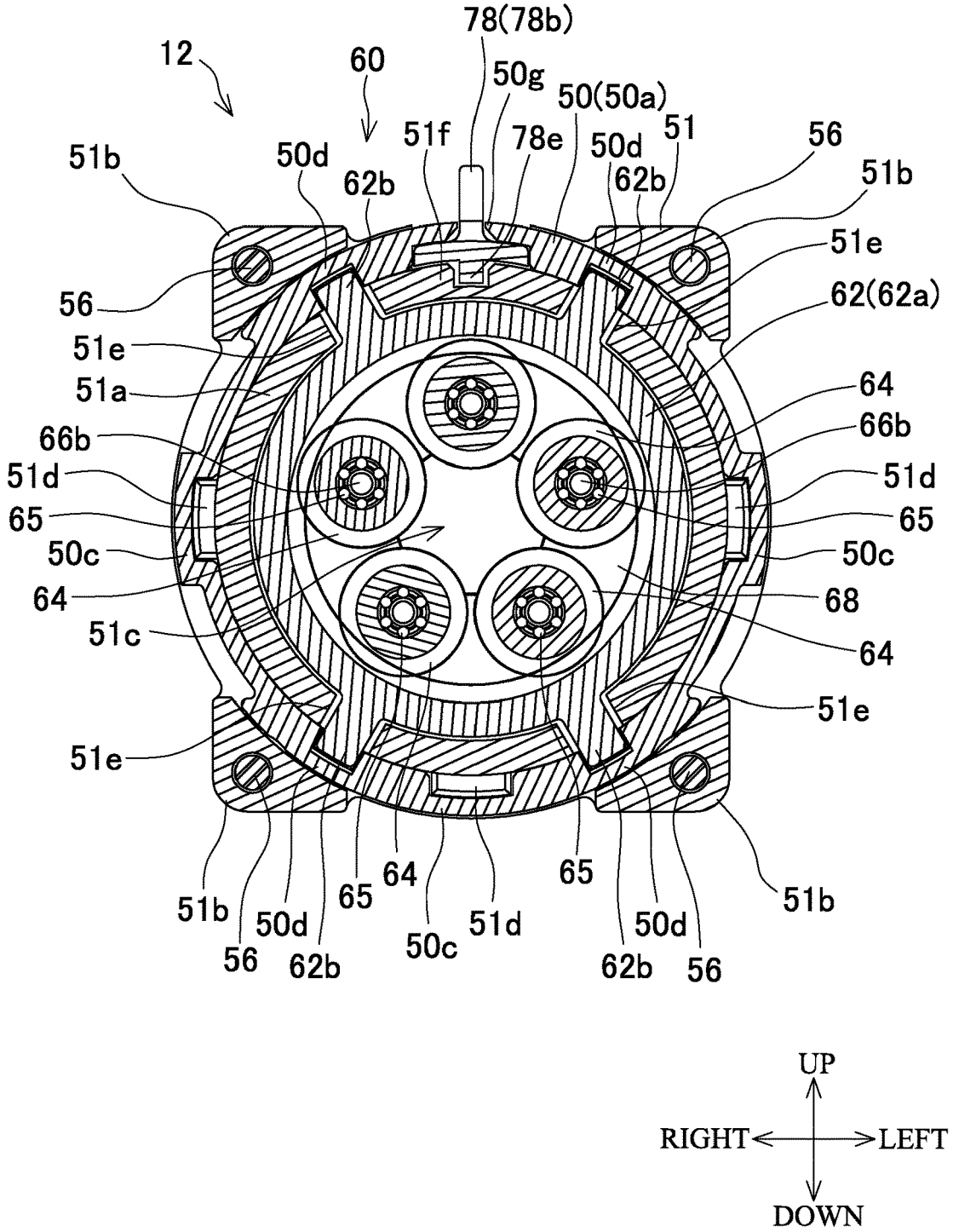
FIG. 34 is a cross-sectional view taken along H-H of FIG. 16.
Figure 35:
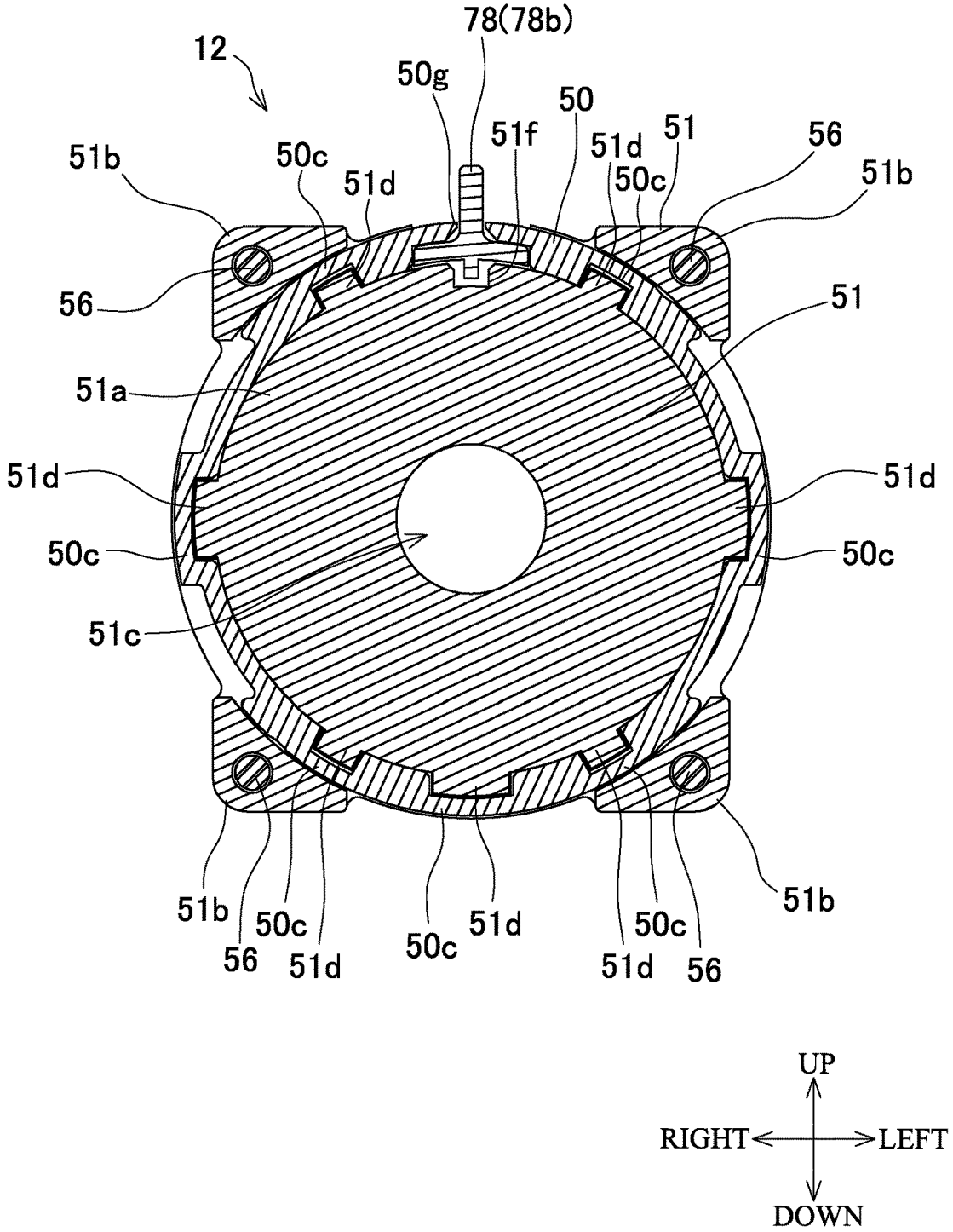
FIG. 35 is a cross-sectional view taken along L-L of FIG. 16.

As illustrated in FIG. 33 and FIG. 34, the rear planetary gear mechanism 60 includes an internal gear 62 fixed to the inside of the gear case 50, a plurality (five pieces) of planetary gears 64 having external teeth meshing with internal teeth of the internal gear 62, and a carrier 66 that rotatably supports the respective planetary gears 64 via needle bearings 65.

A plurality (four pieces) of protrusions 62*b*, which project radially outward from a ring-shaped inner tooth portion 62*a*, are inserted into a plurality of slits 51*e* and inner grooves 5M, thus preventing the internal gear 62 from rotating. The plurality of slits 51*e* are formed on the cylindrical surface of the motor bracket base portion 51*a* and extend in the front-rear direction. The inner grooves 50*d* are formed the inner surface of the rear end portion of the gear case base portion 50*a*, extend in the front-rear direction, and are hollowed radially outward.

The respective planetary gears 64 mesh with the pinion 43 (see FIG. 6) of the motor shaft.

The carrier 66 includes five pieces of pins 66*b* projecting rearward from a rear surface of a disk-shaped portion 66*a* with a hole at the center disposed at regular intervals in the circumferential direction. One planetary gear 64 and one needle bearing 65 are supported to each pin 66*b*. The carrier 66 has an external tooth gear 66*c* projecting forward from the center of the front surface of the disk-shaped portion 66*a* in a cylindrical shape. Further, a meshing tooth 66*d* is disposed on the outer surface of the front portion of the disk-shaped portion 66*a*.

Since the planetary gear 64 is supported by the needle bearing 65, supporting strength increases compared with the use of a ball bearing. Accordingly, even when the planetary gears 64 are thinned in the axial direction (front-rear direction), the strength to the same extent of that of the ball bearing can be secured, making the planetary gears 64 and the rear planetary gear mechanism 60, and eventually the electric vibration driver drill 1 further compact in the front-rear direction.

A washer 68 is located between the respective planetary gears 64 and the motor bracket 51.

Figure 32:
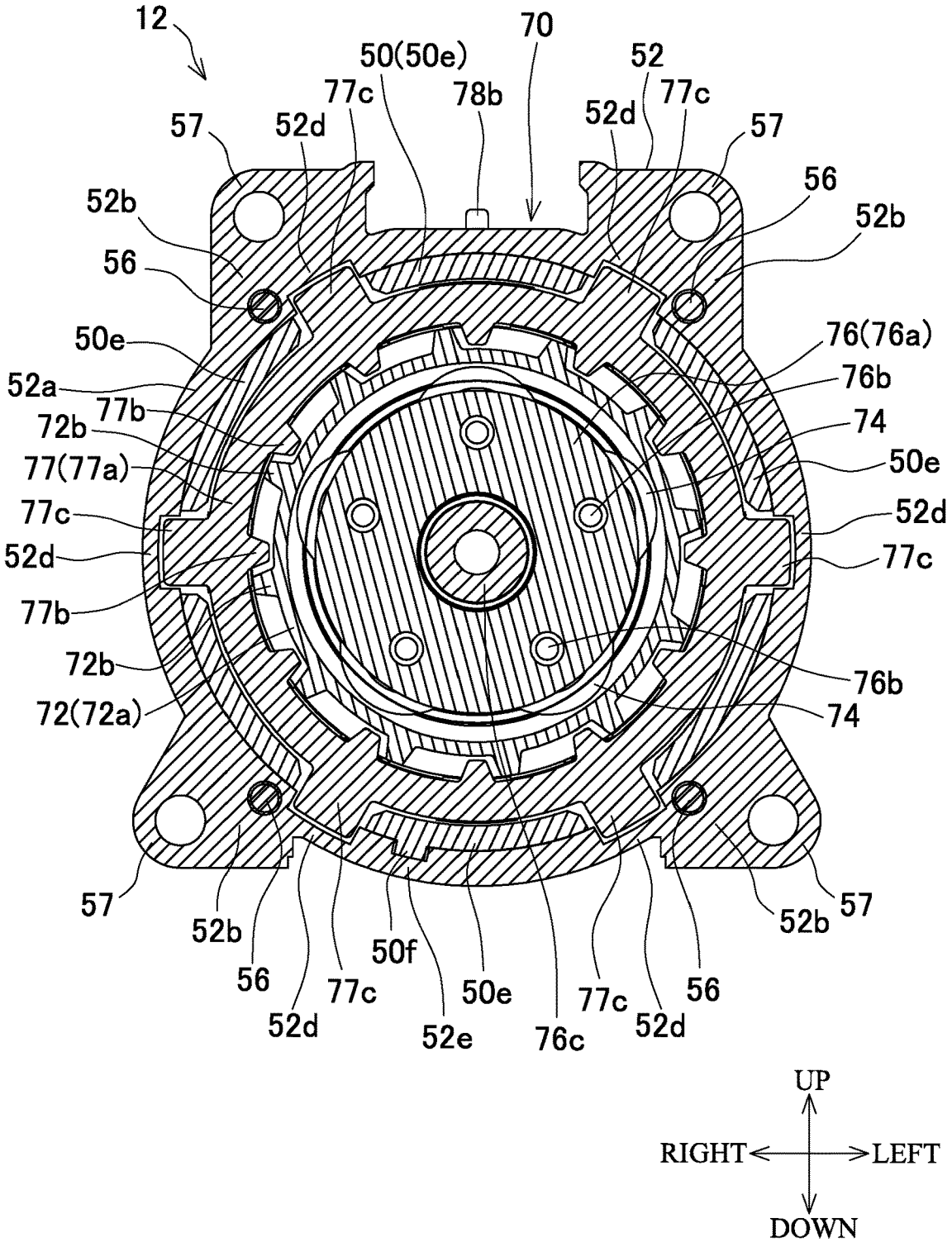
FIG. 32 is a cross-sectional view taken along F-F of FIG. 16.

As illustrated in FIG. 32 and FIG. 33, the intermediate planetary gear mechanism 70 includes an internal gear 72, a plurality (five pieces) of planetary gears 74 having external teeth meshing with the internal teeth of the internal gear 72, and a carrier 76 that rotatably supports the respective planetary gears 74.

On an outer surface of a front portion of a ring-shaped inner tooth portion 72*a* of the internal gear 72, a plurality of external teeth 72*b* projecting in the radial direction and extending in the front-rear direction are disposed at predetermined intervals in the circumferential direction. A coupling groove 72*c* extending in the circumferential direction is disposed on the outer surface of the rear portion of the inner tooth portion 72*a*. Additionally, a meshing tooth 72*d* is disposed on a side portion of an opening of the rear surface of the internal gear 72, and configured to mesh with the meshing tooth 66*d* of the carrier 66 at the first stage.

The respective planetary gears 74 mesh with the external tooth gear 66*c* of the carrier 66 at the first stage.

The carrier 76 includes five pieces of pins 76*b* projecting rearward from a rear surface of a disk-shaped portion 76*a* with the hole at the center, and one planetary gear 74 is supported to each pin 76*b*. The carrier 76 includes an external tooth gear 76*c* projecting forward in a cylindrical shape from the center of the front surface of the disk-shaped portion 76*a*.

As illustrated in FIG. 32, on the front side outside the internal gear 72, a coupling ring 77 held to the rear portion inside the gear housing 52 is located. On an inner peripheral surface of a circular coupling ring base portion 77*a* in the coupling ring 77, internal teeth 77*b* projecting radially inward and extending in the front-rear direction are disposed by the identical number to external teeth 72*b* of the internal gear 72. On the outer peripheral surface of the coupling ring base portion 77*a*, a plurality (six pieces) of projections 77*c* projecting outward and extending in the front-rear direction are disposed at predetermined intervals in the circumferential direction. The respective external teeth 72*b* of the internal gear 72 can enter between any of the internal teeth 77*b* in the coupling ring 77.

The respective projections 77*c* enter between a plurality of corresponding arc-shaped ribs 50*e*, which are formed on the front end portion of the gear case base portion 50*a* at regular intervals in the circumferential direction, and inner grooves 52*d*, which are formed on the inner surface of the rear end portion of the outer tubular portion 52*a* of the gear housing 52, extend in the front-rear direction, and are hollowed radially outward, thus preventing the coupling ring 77 from rotating. A projecting portion 50*f* projecting radially outward is formed on a surface radially outward of the lower arc-shaped rib 50*e*. The projecting portion 50*f* enters inner grooves 52*e*, which are formed on the inner surface of the rear end portion of the outer tubular portion 52*a* of the gear housing 52, extend in the front-rear direction, and are hollowed radially outward.

Meanwhile, as illustrated in FIG. 33, a speed switching ring 78 is located outside the rear portion of the internal gear 72. On an upper portion of a circular speed switching ring base portion 78*a* in the speed switching ring 78, a coupling piece 78*b* projects rearward and upward in an "L" shape in side view. Respective projecting pieces 78*c* project radially outward and rearward on the left portion, the right portion, and the lower portion of the speed switching ring base portion 78*a*.

As illustrated in FIG. 34, the gear case 50 includes a slit 50*g* entering forward from the upper rear portion, a lower end portion of an upper projecting part of the coupling piece 78*b* enters the slit 50*g*. The upper portion of the upper projecting part of the coupling piece 78*b* is joined to the lower portion of a speed switching lever 79 (see FIG. 1, FIG. 2, and FIG. 4), which is disposed to be slidable back and forth on the upper portion of the housing 2, via coil springs (elastic bodes, not illustrated) arranged in the front-rear direction. The speed switching lever 79 has a front portion entering a hole portion 52*f* having a hole formed so as to extend forward from the rear end on the upper portion of the outer tubular portion 52*a* of the gear housing 52. The upper screw-hole portions 57 are located on both right and left sides of the hole portion 52*f*.

As illustrated in FIG. 33, guide grooves 50*h* in the front-rear direction corresponding to the respective projecting pieces 78*c* of the speed switching ring 78 are disposed on the inner surface of the gear case base portion 50*a*. The corresponding projecting pieces 78*c* enter the respective guide grooves 50*h* to support the speed switching ring 78 such that the speed switching ring 78 moves only in the front-rear direction.

Pins 78*d* two in total heading from radially outward to inward of the right and left projecting pieces 78*c* are disposed. Outer heads of the respective pins 78*d* abut on the outer surfaces of the respective right and left projecting pieces 78*c*. Inner distal ends thinner than the heads of the respective pins 78*d* project radially inward from the inner surfaces of the respective projecting pieces 78*c* and enter into the coupling groove 72*c* of the internal gear 72.

Switching the speed switching lever 79 forward moves the speed switching ring 78 forward through the coupling piece 78*b*, the internal gear 72 moves forward while the internal gear 72 keeps the meshing with the respective planetary gears 74 via the respective pins 78*d* and the coupling groove 72*c*. Then, the respective external teeth 72*b* enter between the internal teeth 77*b* of the coupling ring 77 to restrict the circumferential rotation of the internal gear 72. The respective planetary gears 74 rotate around the fixed internal gear 72, and the rotation decelerated more than the rotation of the external tooth gear 66*c* at the first stage is transmitted to the external tooth gear 76*c* of the carrier 76. That is, switching the speed switching lever 79 forward sets a low speed mode that functions the deceleration by the intermediate planetary gear mechanism 70 at the second stage.

Figure 37:
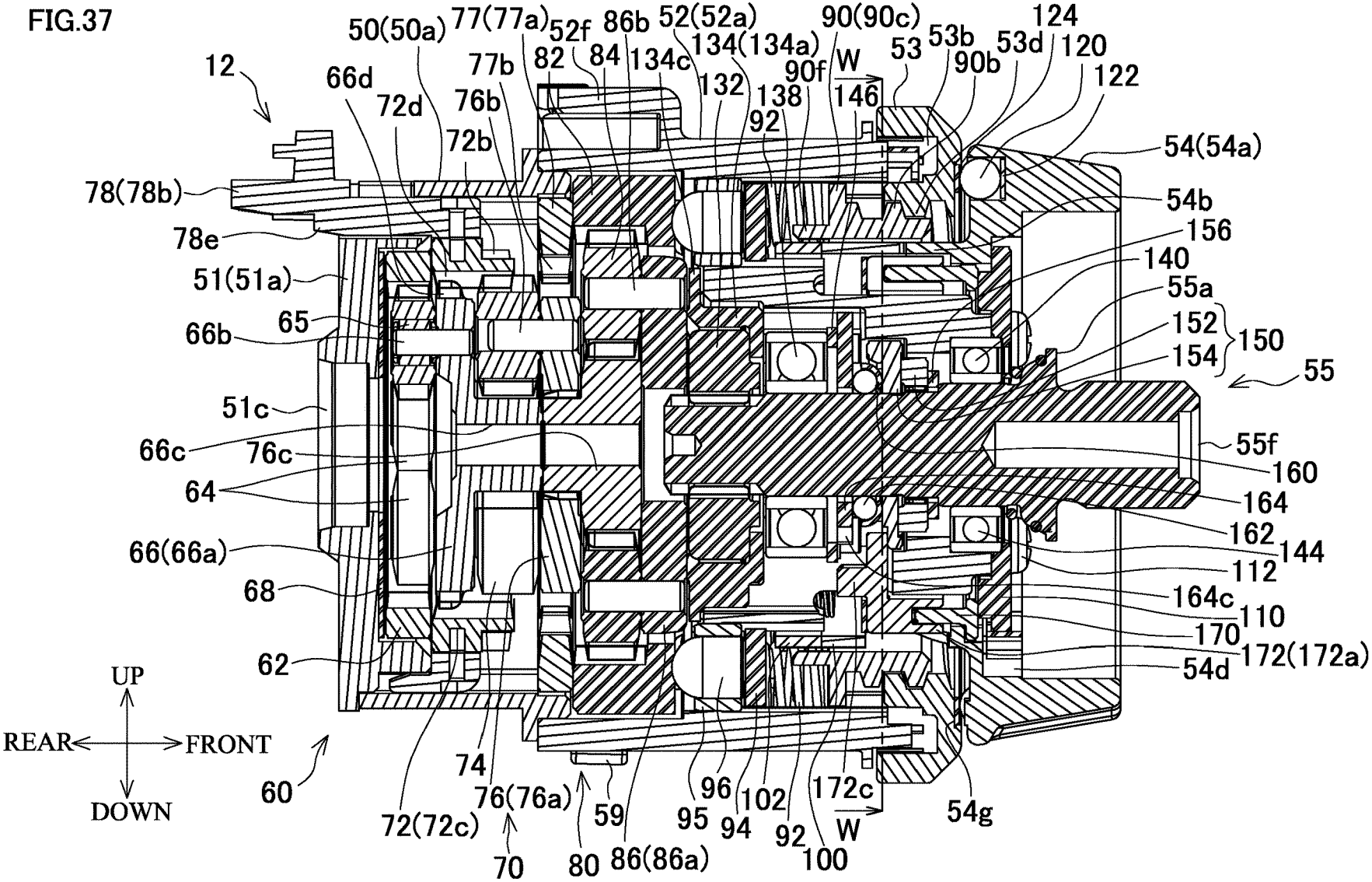
FIG. 37 is a drawing similar to FIG. 16 in a vibration mode and a high speed mode.
Figure 41:
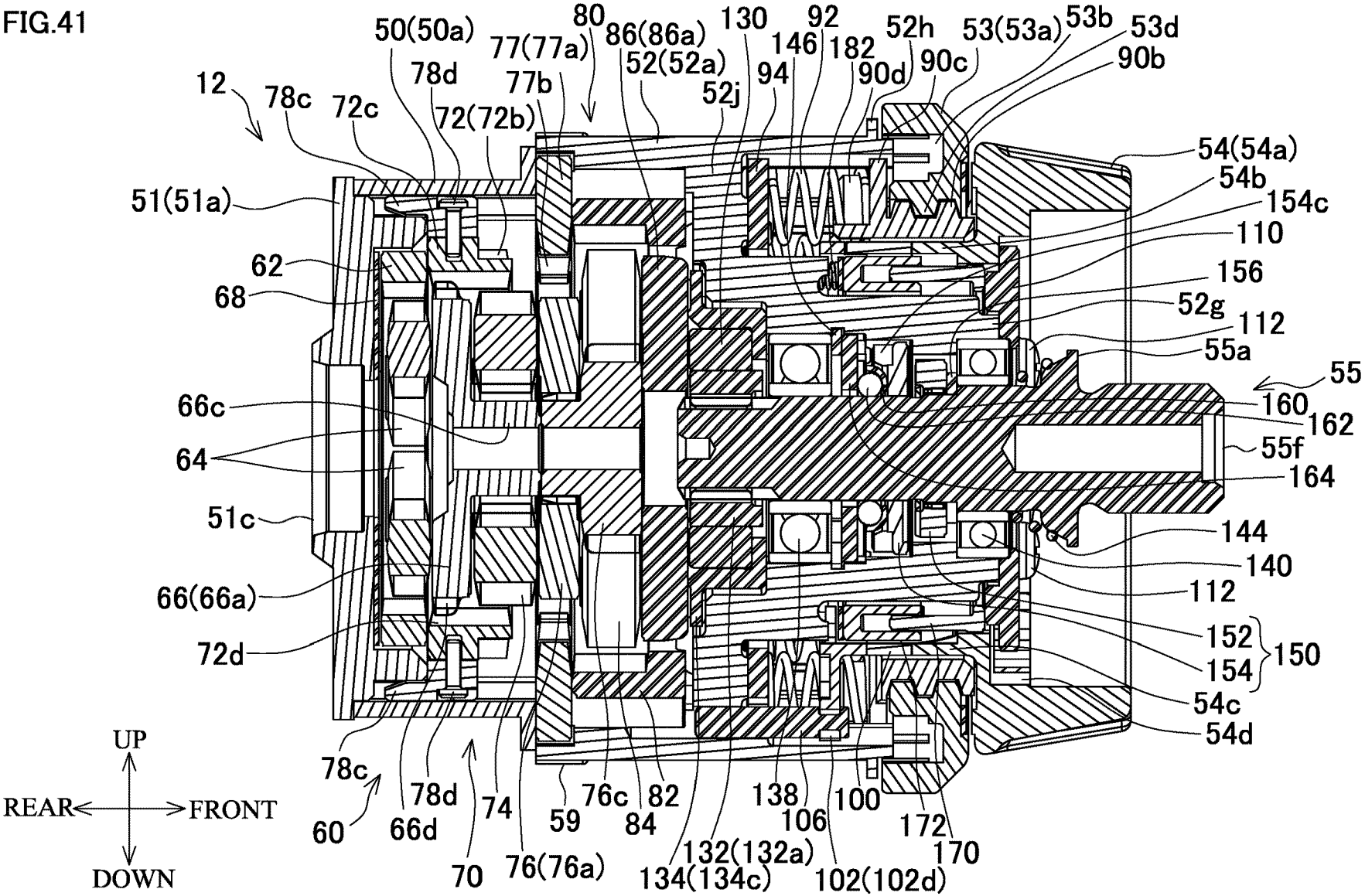
FIG. 41 is a drawing similar to FIG. 17 in the clutch mode and the high speed mode.

Meanwhile, as illustrated in FIG. 37 and FIG. 41, switching the speed switching lever 79 (see FIG. 1, FIG. 2, and FIG. 4) rearward similarly moves the speed switching ring 78 rearward and the internal gear 72 moves rearward while keeping the meshing with the respective planetary gears 74. Then, the respective external teeth 72*b* exit between the internal teeth 77*b* of the coupling ring 77 to release the rotation restriction in the circumferential direction on the internal gear 72, the meshing tooth 72*d* of the internal gear 72 meshes with the meshing tooth 66*d* of the carrier 66 at the first stage, the internal gear 72 not fixed in the circumferential direction rotates together with the carrier 66 at the first stage, and the rotation equivalent to the rotation of the external tooth gear 66*c* is transmitted to the external tooth gear 76*c*.

That is, switching the speed switching lever 79 rearward sets a high speed mode that cancels the deceleration by the intermediate planetary gear mechanism 70 at the second stage.

A rib 78*e* extending back and forth and projecting downward is disposed at the center in the right-left direction of the lower surface of the coupling piece 78*b*. Accordingly, the rib 78*e* secures a rigidity of the coupling piece 78*b* and prevents warping, thus stabilizing the position of the internal gear 72 after the movement by the speed switching ring 78. The rib 78*e* enters a groove 51*f*, which is disposed on the top surface of the motor bracket base portion 51*a* so as to extend in the front-rear direction and be hollowed downward. The slit 50*g* of the gear case 50 is positioned on the upper side of the groove 51*f*.

Figure 30:
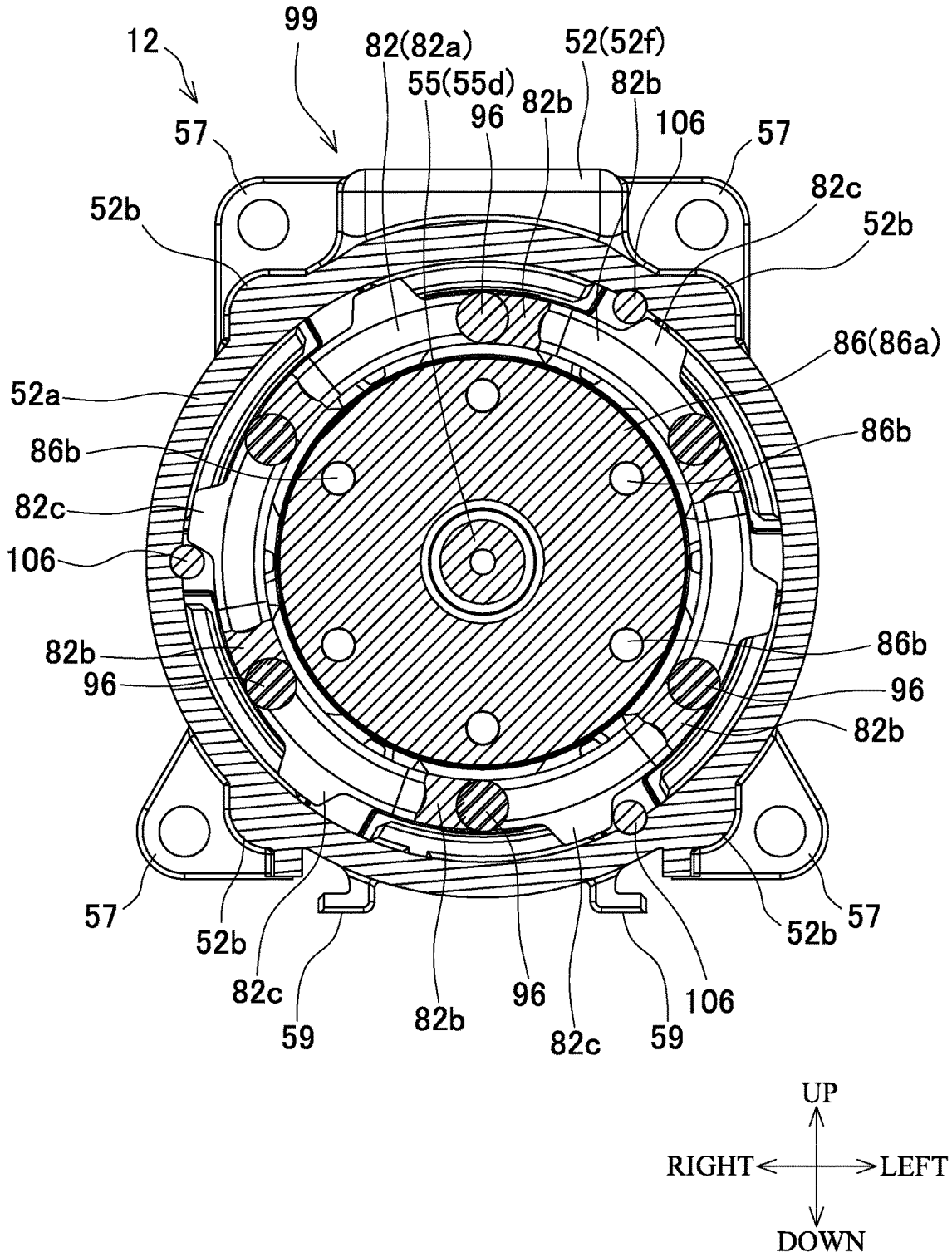
FIG. 30 is a cross-sectional view (during stop) taken along S-S of FIG. 16.
Figure 31:
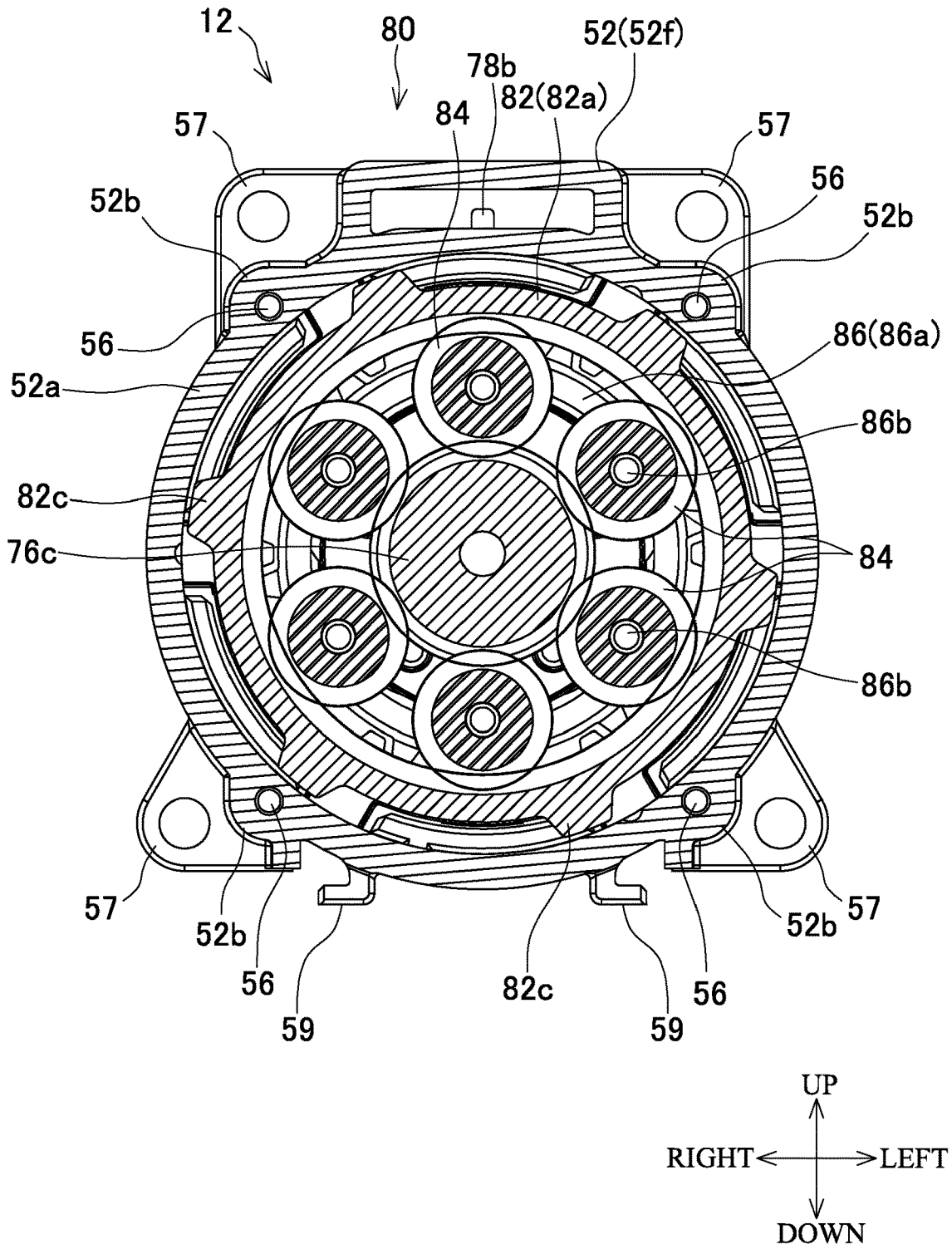
FIG. 31 is a cross-sectional view taken along E-E of FIG. 16.

As illustrated FIG. 30 and FIG. 31, the front planetary gear mechanism 80 includes an internal gear 82 disposed rotatable in the circumferential direction in the gear housing 52, a plurality (six pieces) of planetary gears 84 having external teeth meshing with the internal teeth of the internal gear 82, and a carrier 86 that rotatably supports the respective planetary gears 84. On a front surface of a cylindrical inner tooth portion 82*a* in the internal gear 82, a plurality (six pieces) of cam protrusions 82*b* projecting forward are disposed at predetermined intervals in the circumferential direction. On the outer surface of the inner tooth portion 82*a*, a plurality (six pieces) of projecting portions 82*c* projecting radially outward are disposed. The projecting portions 82*c* are each located at the center between the cam protrusions 82*b* in the inner tooth portion 82*a*.

The respective planetary gears 84 mesh with the external tooth gear 76*c* of the carrier 76 at the second stage.

Figure 28A:
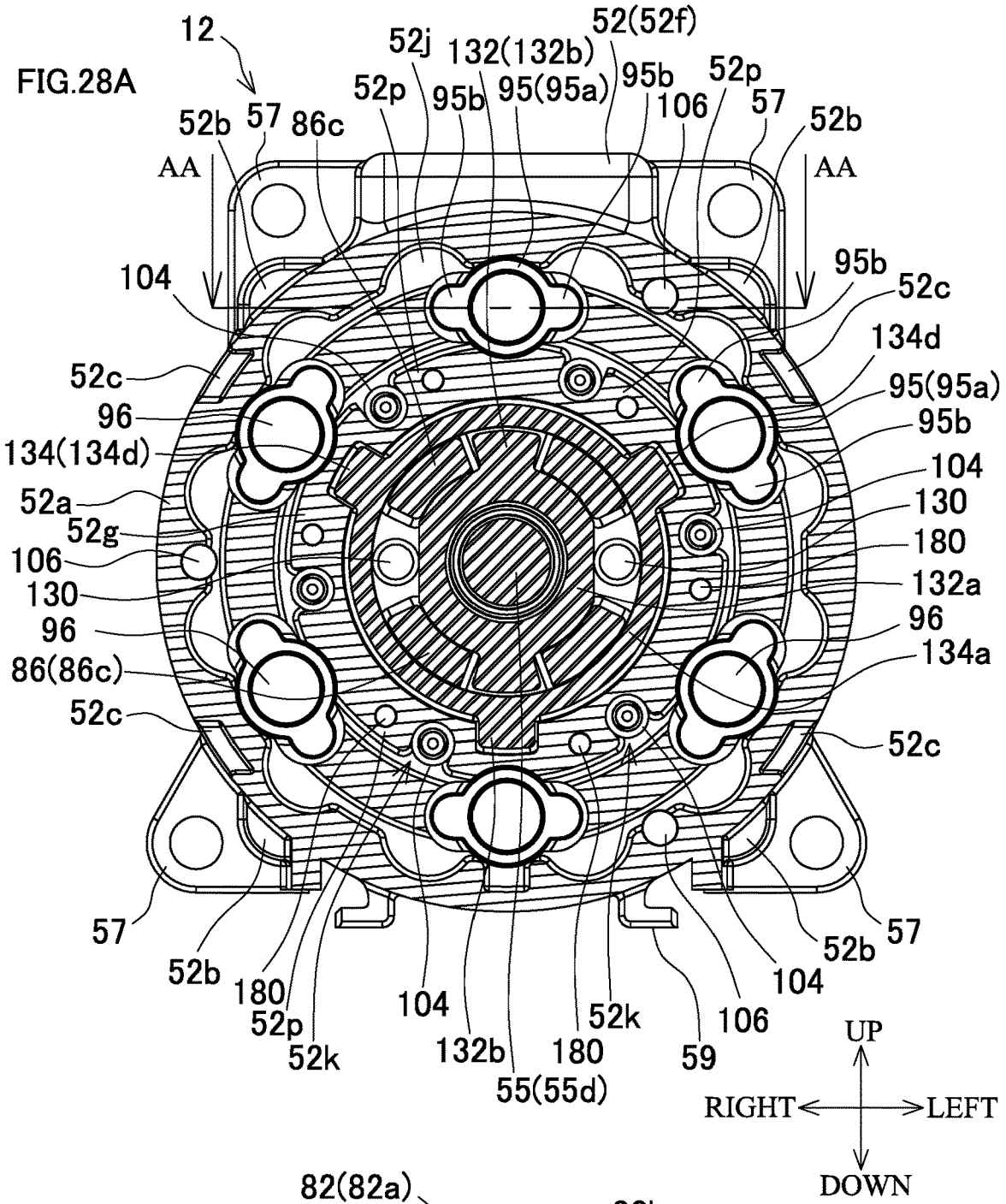
FIG. 28A is a cross-sectional view taken along Z-Z of FIG. 16.

The carrier 86 includes a plurality (six pieces) of pins 86*b* projecting rearward from a rear surface of a disk-shaped portion 86*a* with a hole at the center, and one planetary gear 84 is supported to each pin 86*b*. Additionally, the carrier 86 includes a plurality (four pieces) of projecting bodies 86*c* (see FIG. 14. FIG. 28A, and the like) projecting forward from the center of the front surface of the disk-shaped portion 86*a* in a quarter cylindrical shape arranged in the circumferential direction.

Figure 19:
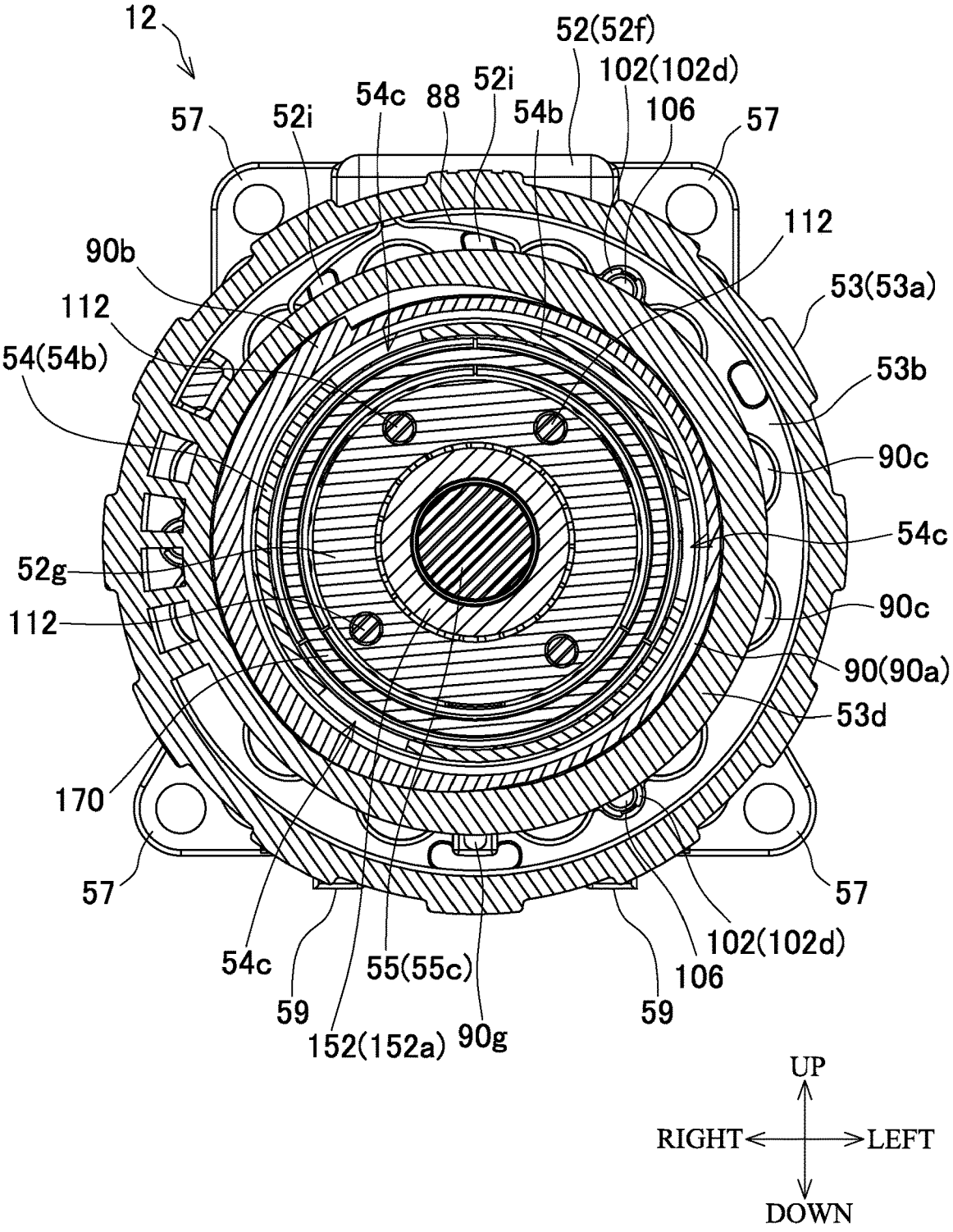
FIG. 19 is a cross-sectional view taken along Q-Q of FIG. 16.
Figure 20:
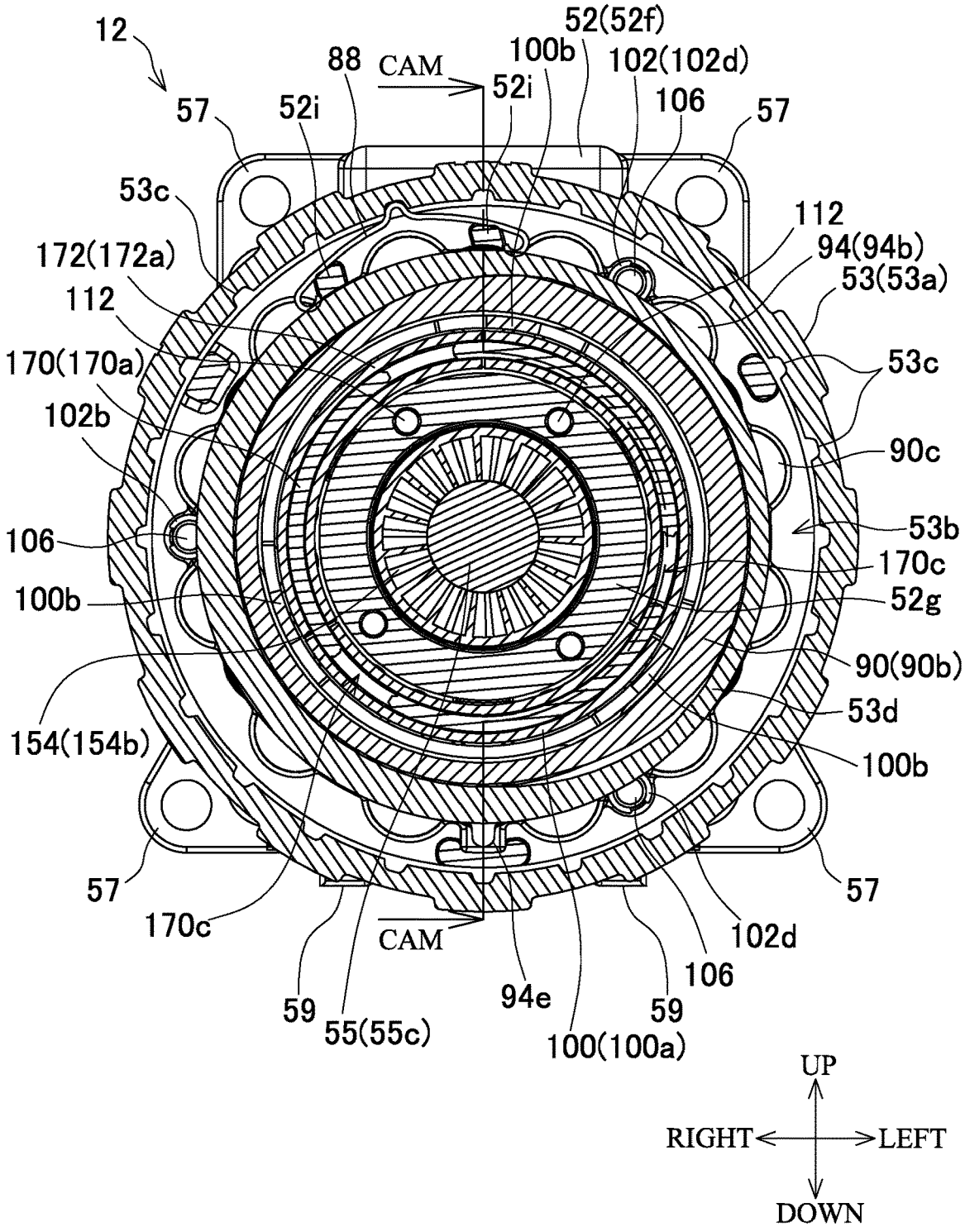
FIG. 20 is a cross-sectional view taken along A-A of FIG. 16.

As illustrated in FIG. 19 and FIG. 20, the clutch ring 53 is located radially outward of an inner tubular portion 52*g* in the gear housing 52. The inner tubular portion 52*g* has a cylindrical shape having a diameter smaller than that of the outer tubular portion 52*a*. The inner tubular portion 52*g* has a front end positioned forward with respect to the front end of the outer tubular portion 52*a*. The clutch ring 53 has a circular groove 53*b* hollowed forward from a rear end portion of a cylindrical clutch ring base portion 53*a* with an uneven outside. The clutch ring 53 is rotatably disposed around the axis while the groove 53*b* is inserted into a part on the front side with respect to a circular rib 52*h* (see FIG. 10, FIG. 13, and the like), which is formed so as to project radially outward in a front opening of the outer tubular portion 52*a* of the gear housing 52.

On the inner surface radially outward of the groove 53*b* of the clutch ring 53, a plurality of respective positioning depressed portions 53*c* are formed at regular intervals in the circumferential direction so as to be each depressed radially outward. Meanwhile, on the upper right of the front opening of the outer tubular portion 52*a* of the gear housing 52, a pair of protrusions 52*i* projecting forward are disposed. A leaf spring 88 bulging radially outward at its center and biased radially outward is locked to these protrusions 52*i*. The bulge portion of the leaf spring 88 can enter any of the positioning depressed portions 53*c*, provides a clicking feeling to the rotation of the clutch ring 53, and positions the clutch ring 53 in the rotation direction.

Moreover, a screw portion 53*d* having a spiral thread is disposed on the inner surface of the clutch ring base portion 53*a*.

As illustrated in FIG. 19 and FIG. 20, a ring-shaped spring holder 90 is located radially inward of the clutch ring 53.

On an outer surface of a cylindrical spring holder base portion 90*a* of the spring holder 90, a screw portion 90*b* having a thread meshing with the screw portion 53*d* of the clutch ring 53 is formed. The rotation of the clutch ring 53 moves the spring holder 90 in the front-rear direction.

Figure 15:
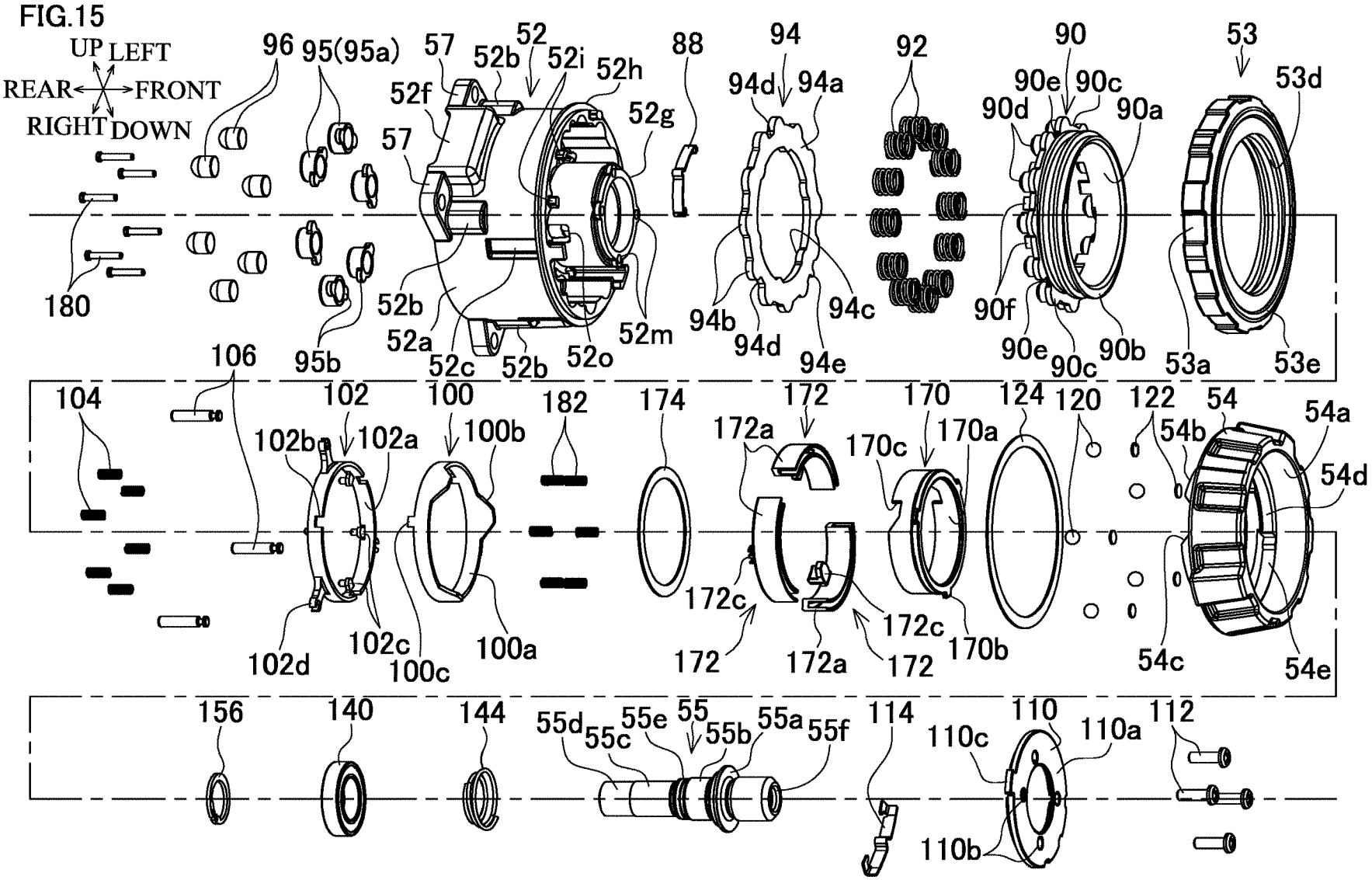
FIG. 15 is an exploded perspective view of another part of FIG. 10.
Figure 16:
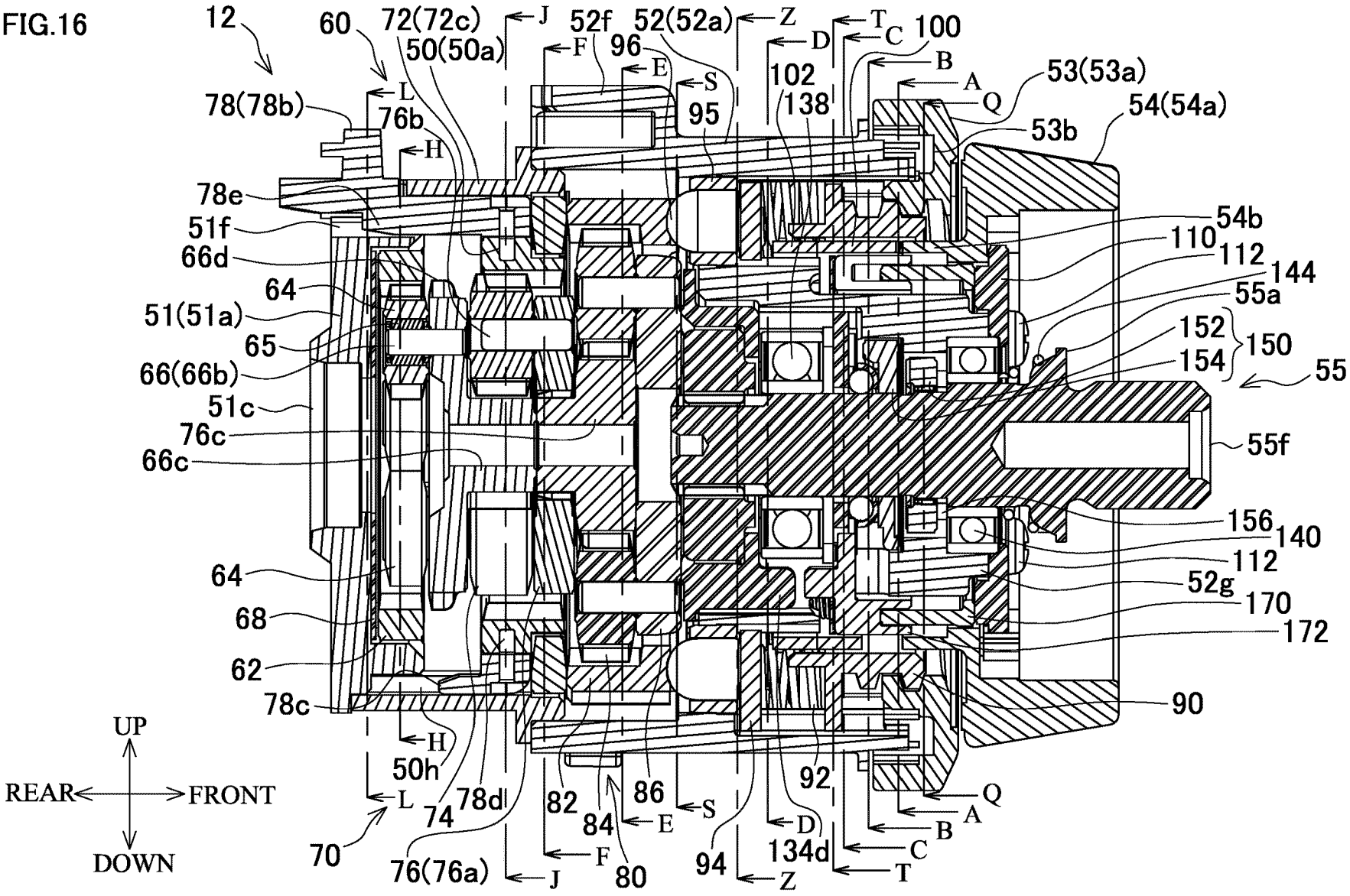
FIG. 16 is a cross-sectional view taken along FRONT-FRONT of FIG. 11.
Figure 17:
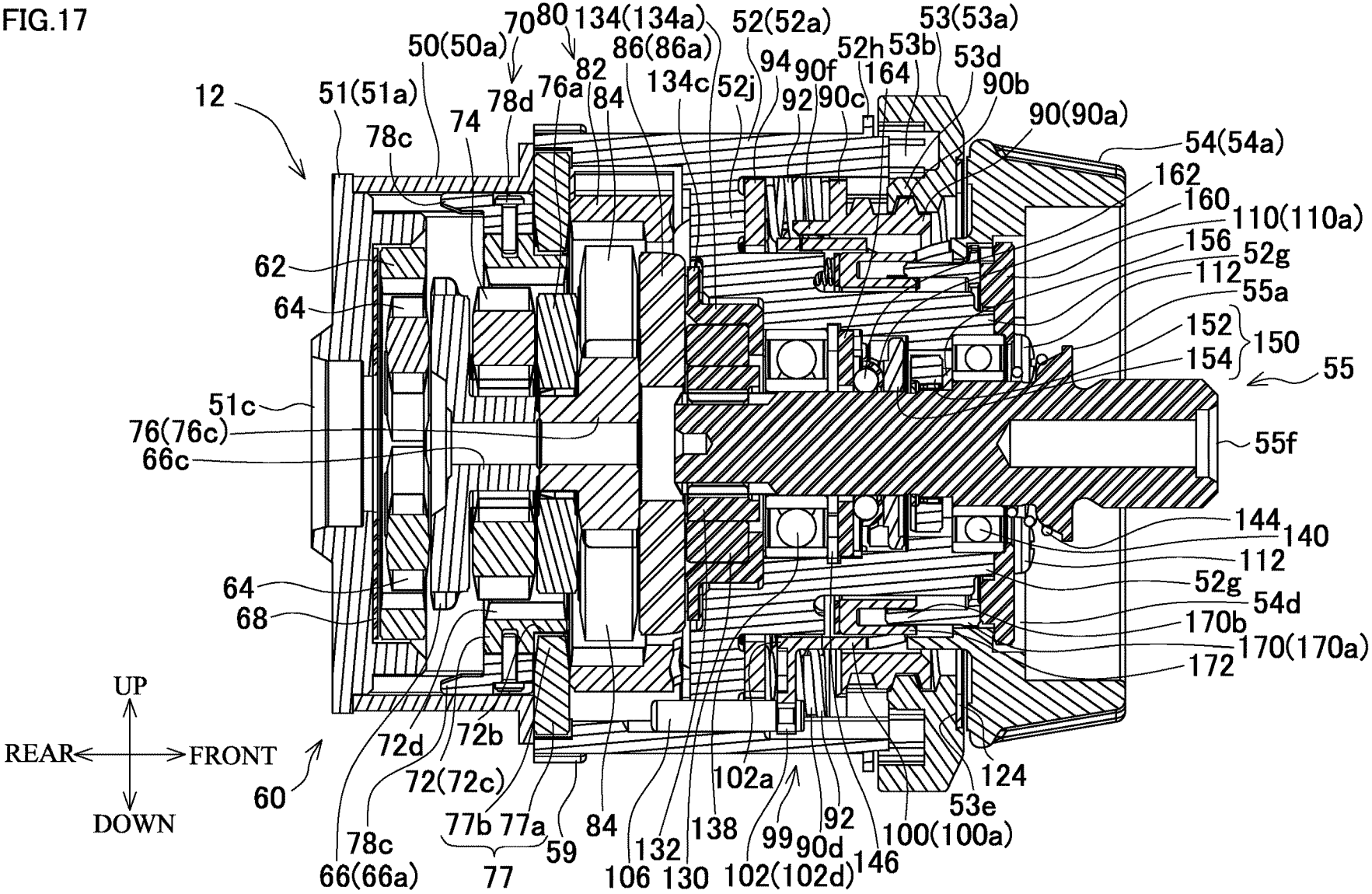
FIG. 17 is a cross-sectional view taken along TOP-TOP of FIG. 11.
Figure 18:
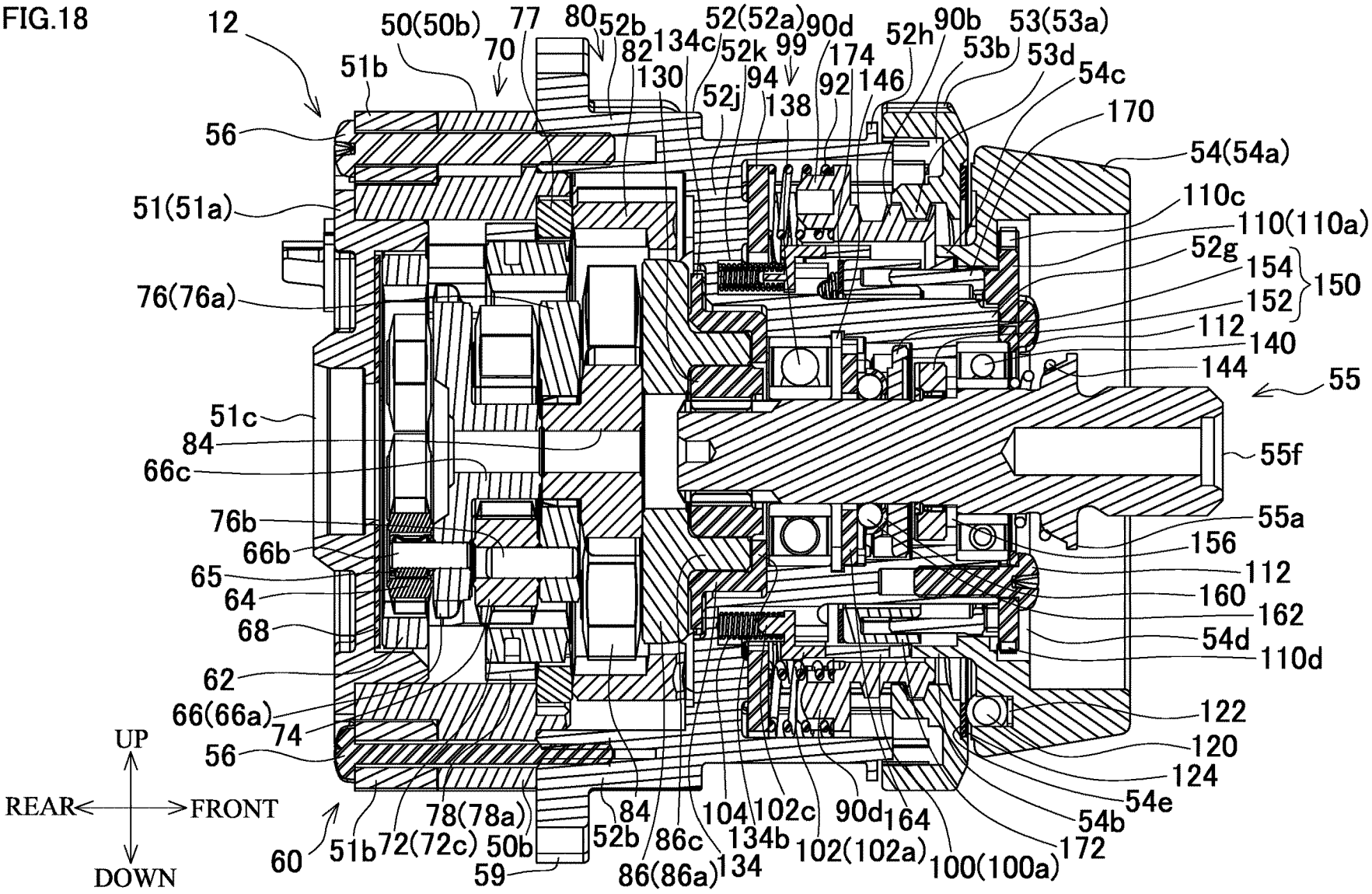
FIG. 18 is a cross-sectional view taken along NEJI1-NEJI1 of FIG. 11.

The spring holder base portion 90*a* has the rear portion including flange portions 90*c* (see FIG. 15, FIG. 24, and the like) three positions in total and spring holders 90*d* (see FIG. 15, FIG. 17, FIG. 18, and the like). The flange portions 90*c* project radially outward in a semicircular shape at a plurality of (12) positions from the front portion, and parts radially inward of the semicircular projecting portions are coupled in the predetermined number (four pieces) of sets. The respective spring holders 90*d* project in columnar shapes rearward from the respective semicircular projecting portions of the flange portions 90*c*. Bottoms 90*e* hollowed circumstantially inward with respect to the outer shapes of the respective flange portions 90*c* are formed between the respective flange portions 90*c* in the circumferential direction (see FIG. 15, FIG. 24, and the like).

Between the predetermined spring holders 90*d*, ribs 90*f* projecting rearward from the rear end portion of the spring holder base portion 90*a* are disposed (see FIG. 15, FIG. 17, and the like). The respective ribs 90*f* have projection heights to the rear similar to projection heights of the spring holders 90*d*. The respective ribs 90*f* restrict movements outward in the radial direction of various members located inward in the radial direction and hold these members to prevent these members from dropping.

Further, the lower flange portion 90*c* includes a projecting piece 90*g* projecting radially outward between the semicircular projecting portions in the lower portion.

Figure 26:
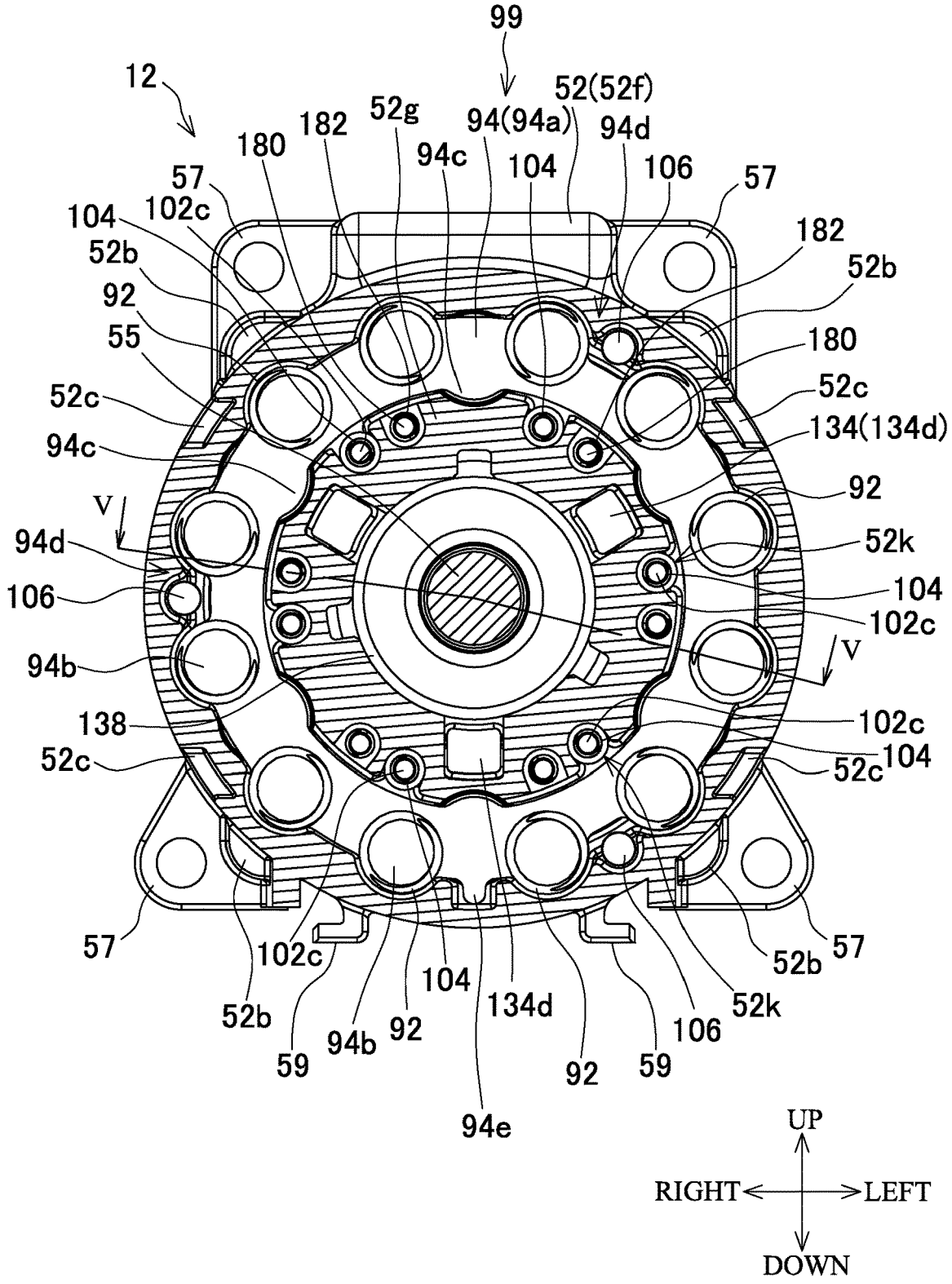
FIG. 26 is a cross-sectional view taken along D-D of FIG. 16.

As illustrated in FIG. 26, the respective spring holders 90*d* hold clutch pin coil springs 92 as elastic bodies. On the rear sides of the respective clutch pin coil springs 92, one washer 94 (clutch washer) having a shape similar to that of the flange portion 90*c* is disposed. The respective clutch pin coil springs 92 have front ends abutting on the rear surfaces of the flange portions 90*c* of the spring holder 90, and the rear ends of the respective clutch pin coil springs 92 abut on the front surface of the washer 94.

The washer 94 includes a plurality of (12 positions) projecting portions 94*b* projecting radially outward in a semicircular shape from a ring-shaped washer base portion 94*a*. Additionally, extended portions 94*c*, which extend in an arc shape radially inward from radially inner part of the washer base portion 94*a*, are disposed at six positions in total between mutually adjacent semicircular projecting portions projecting radially outward in the washer 94. Further, bottoms 94*d* are disposed at three positions in total formed similarly to the bottoms 90*e* of the spring holder 90. A projecting piece 94*e* projecting radially outward is disposed between the projecting portions 94*b* in the lower portion of the washer 94.

As illustrated in FIG. 19 to FIG. 26, the spring holder 90, the clutch pin coil springs 92, and the washer 94 are inserted between the inner tubular portion 52*g* and the outer tubular portion 52*a* in the gear housing 52. The inner surface of the front portion of the outer tubular portion 52*a* has an outer shape similar to that of the flange portion 90*c* or the washer 94. The flange portions 90*c* and the projecting piece 90*g* prevent the spring holder 90 from rotating. The projecting portions 94*b* and the projecting piece 94*e* prevent the washer 94 from rotating. Note that at least one of the projecting pieces 90*g* and 94*e* may be omitted.

As illustrated in FIG. 28A, a front surface of a ring-shaped wall body part 52*j*, which expands up and down and right and left to couple an inner tubular portion 52*g* and the outer tubular portion 52*a* together, of the gear housing 52 has a shape similar to those of the flange portion 90*c* and the washer 94. Circular holes are bored on parts positioned on the rear sides of the respective extended portions 94*c* of the washer 94 in the wall body part 52*j*. Into these holes, respective columnar clutch pins 96 are inserted from the front side via cylindrical clutch pin sleeves 95.

Figure 28B:
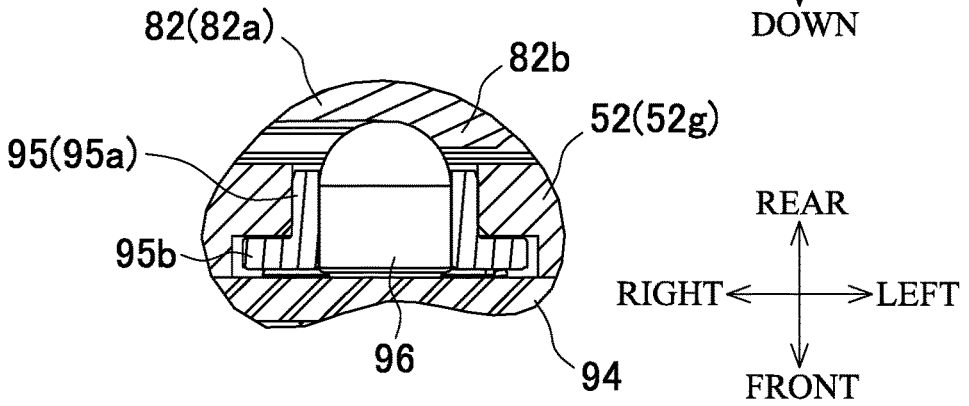
FIG. 28B is a cross-sectional view taken along AA-AA of FIG. 28A.

As illustrated in FIG. 28A and FIG. 28B, the clutch pin sleeves 95 each include a cylindrical clutch pin sleeve base portion 95*a* and a pair of flanges 95*b* projecting radially outward from the outer surface of the front end portion of the clutch pin sleeve base portion 95*a*. The respective flanges 95*b* are opposed to one another. Thus, arrangements of the respective flanges 95*b* increases the parts supported by the gear housing 52. Further, lengths of the clutch pin sleeve 95 and the clutch pin 96 in the front-rear direction become short while the support strength is maintained.

The respective clutch pins 96 have columnar shapes whose rear end portions are rounded off into spherical surfaces, and inserting the front portions into the clutch pin sleeve base portions 95*a* holds the clutch pins 96 integrally with the clutch pin sleeves 95.

The front end portions of the respective clutch pin sleeves 95 and the front end portions of the respective clutch pins 96 contact the rear surface of the washer 94.

The respective clutch pins 96 have the rear end portions that can contact the front surface of the cylindrical inner tooth portion 82*a* in the internal gear 82 of the front planetary gear mechanism 80.

When the rotation position of the clutch ring 53 is changed by twisting, the front-rear position of the spring holder 90 changes. Accordingly, a distance between the flange portions 90*c* and the washer 94 is changed, and the elastic forces of the respective clutch pin coil springs 92 are adjusted. Due to the elastic forces from the clutch pin coil springs 92, the washer 94 pushes the respective clutch pins 96 via the clutch pin sleeves 95. The clutch pins 96 each abut on any of the cam protrusions 82*b* in the internal gear 82 at the third stage to rotate and restrict the rotation of the internal gear 82 according to the elastic forces from the clutch pin coil springs 92.

Figure 29:
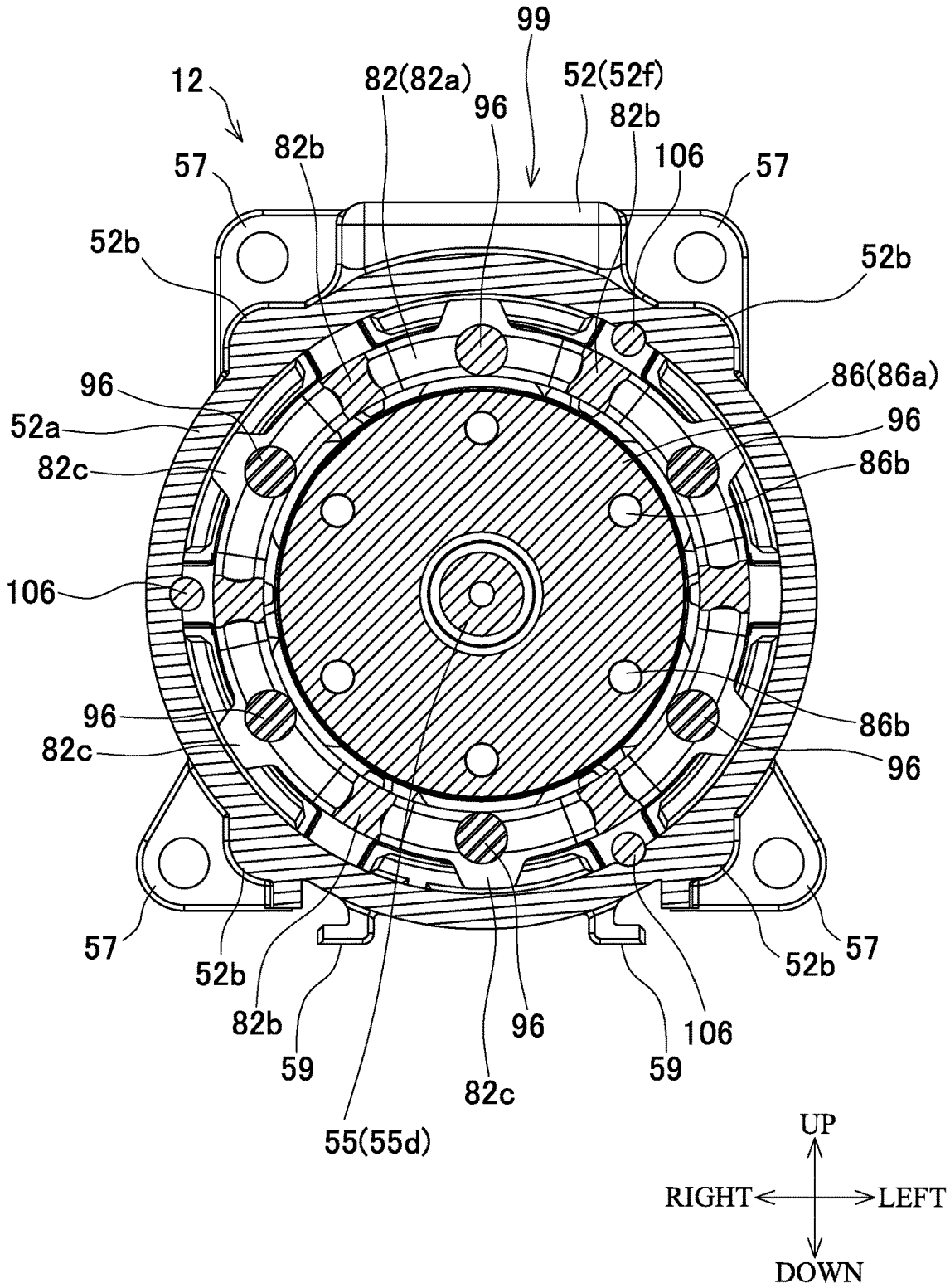
FIG. 29 is a cross-sectional view (during rotation) taken along S-S of FIG. 16.

That is, as illustrated in FIG. 30, the respective clutch pins 96 press the front surface of the internal gear 82 according to the elastic forces from the respective clutch pin coil springs 92, retain the cam protrusions 82*b* at less than a predetermined torque according to the elastic forces, and fix the internal gear 82. The cam protrusion 82*b* has a side surface including a narrow portion narrowed down into a spherical surface matching the shape of the rear end portion of the clutch pin 96. The clutch pins 96 in contact with the narrow portions can sufficiently resist the rotational force of the internal gear 82 at the third stage. As illustrated in FIG. 29, when the torque is the predetermined torque or more, the cam protrusions 82*b* move the respective clutch pins 96 forward against the elastic forces, thus performing relative crossing. The narrow portions facilitate the crossing smoothly. By the relative crossing, the respective clutch pins 96 permit this rotation to allow the internal gear 82 to rotate, and as long as another member does not block the rotation of the internal gear 82, the rotation of the internal gear 82 idles the carrier 86 (respective projecting bodies 86*c*) and causes the clutch to operate.

The spring holder 90, the respective clutch pin coil springs 92, the washer 94, the respective clutch pin sleeves 95, and the respective clutch pins 96 are components of a clutch mechanism 99. Note that the clutch mechanism 99 may include the cam protrusions 82*b*. Further, at least one of the respective clutch pin sleeves 95 and the washer 94 may be omitted.

Since in the electric vibration driver drill 1, the respective clutch pin coil springs 92 are not one large coil spring but are disposed divided into plural (12 pieces), a spring constant can be further increased, a close contact length can be further decreased, and a length in the front-rear direction can be further shortened compared with the use of the one large coil spring. Additionally, the various members can be located between the clutch pin coil springs 92 without interference to the operation of the clutch pin coil springs 92, making the electric vibration driver drill 1 compact by the amount.

Figure 24:
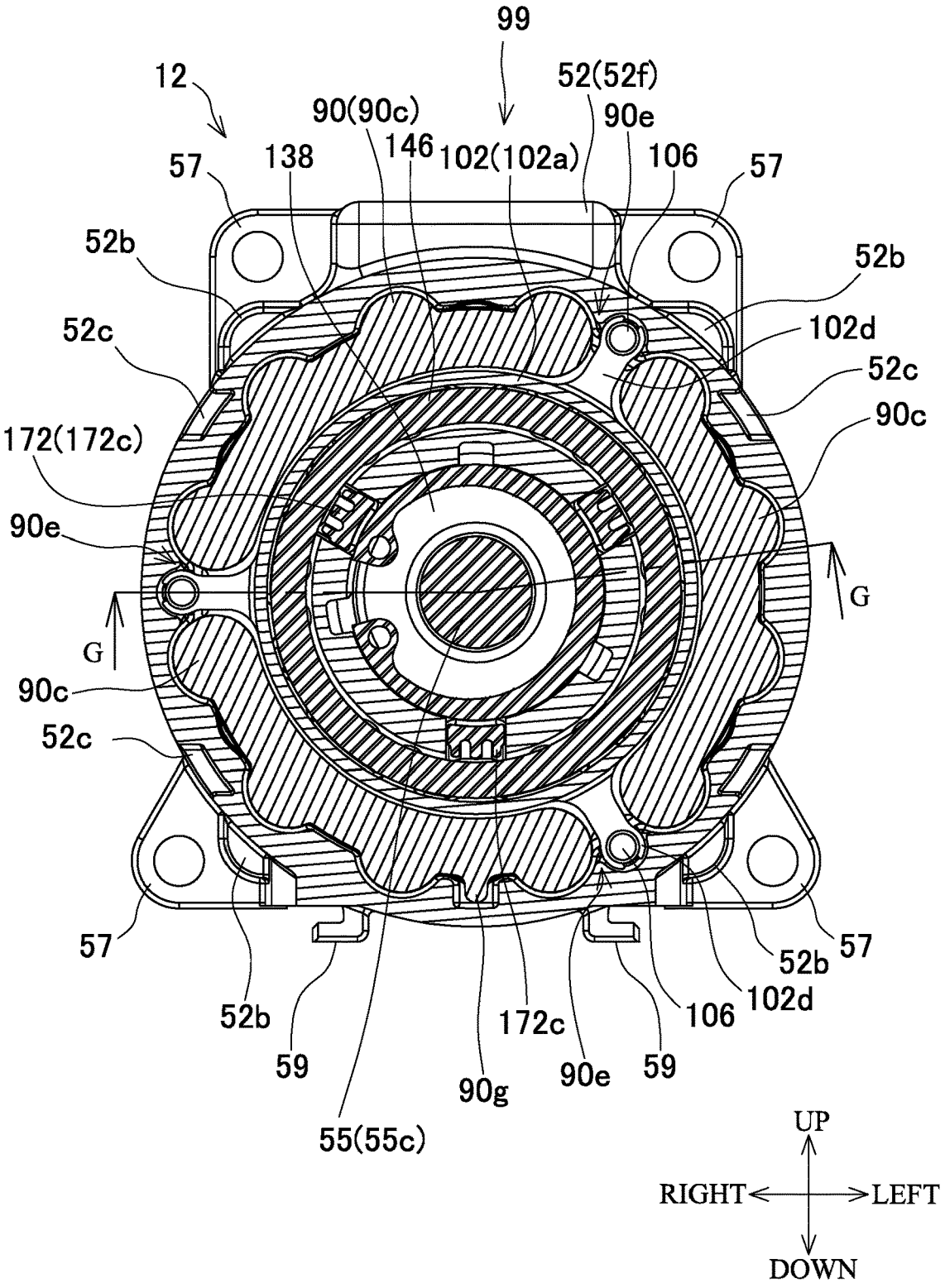
FIG. 24 is a cross-sectional view taken along T-T of FIG. 16.
Figure 25:
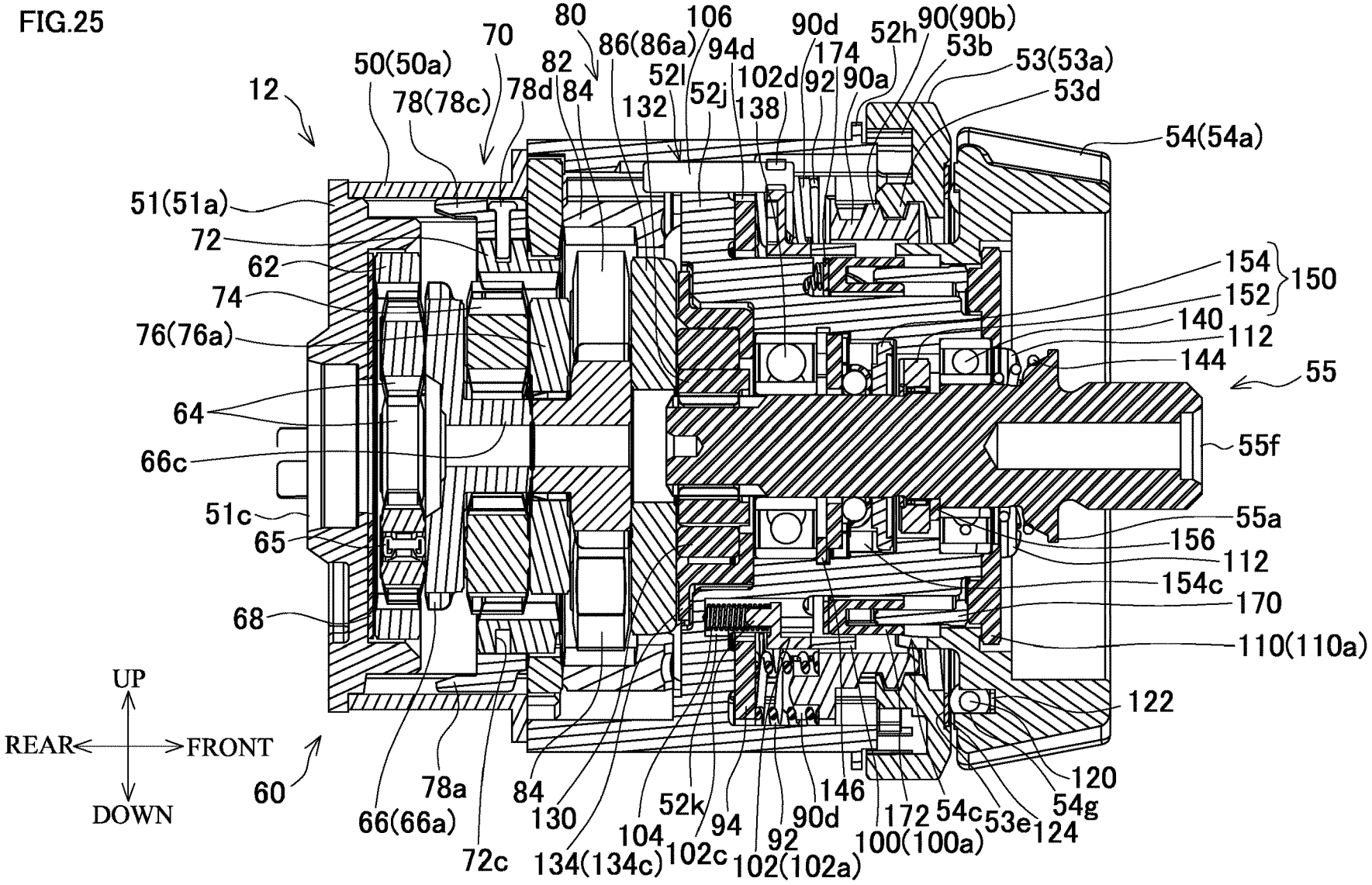
FIG. 25 is a cross-sectional view taken along G-G of FIG. 24.

As illustrated in FIG. 24 and FIG. 25, a support ring 100 and a pin holder 102 on the rear side of the support ring 100 are located radially inward of the spring holder 90.

The support ring 100 includes a plurality of (three positions) trapezoidal cam protrusions 100*b* on a front end portion of a cylindrical support ring base portion 100*a* having the axial direction in the front-rear direction. The cam protrusions 100*b* projecting forward with respect to the other part are formed at regular intervals from one another in the circumferential direction (see FIG. 15, FIG. 20, and the like). A plurality of (three positions) projecting pieces 100*c* projecting rearward from the rear end portion of the support ring base portion 100*a* are located between the cam protrusions 100*b* in the circumferential direction (see FIG. 15 and the like).

The pin holder 102 includes concave portions 102*b* (see FIG. 15 and the like), a plurality of (six positions) spring holders 102*c* (elastic holders, see FIG. 15 and the like), and a plurality of (three positions) pin holders 102*d*. The concave portions 102*b* are disposed on the front end portion of a cylindrical pin holder base portion 102*a* having the axial direction in the front-rear direction so as to correspond to the projecting pieces 100*c* of the support ring 100. The respective spring holders 102*c* projecting radially inward and rearward from the inner surface of the pin holder base portion 102*a* are located at regular intervals in the circumferential direction. The respective pin holders 102*d* projecting radially outward from the outer surface of the pin holder base portion 102*a* are located at regular intervals in the circumferential direction. The concave portions 102*b* and the pin holders 102*d* are displaced from one another in the circumferential direction.

Front end portions of pin holder coil springs 104 as elastic bodies are inserted into parts projecting rearward in the respective spring holders 102*c*. The respective pin holder coil springs 104 have center axes matching with center axes of projecting parts at the rear of the corresponding spring holders 102*c*. The pin holder coil springs 104 have rear portions inserted into hollow portions 52*k* (see FIG. 25, FIG. 28A, and the like) each formed to be hollowed in columnar shapes rearward from the front surface of the wall body part 52*j* of the gear housing 52. The respective hollow portions 52*k* are formed six in total located similarly to the spring holders 102*c*. The pin holder coil springs 104 bias the pin holder 102 forward.

As illustrated in FIG. 24 and FIG. 25, the front end portions of columnar internal gear lock pins 106 extending in the front-rear direction are held to the respective pin holders 102*d*. The front end portions of the internal gear lock pins 106 form circular grooves, and the distal end portions of the forked pin holders 102*d* are inserted into the grooves. The respective pin holders 102*d* and the respective internal gear lock pins 106 pass through between the predetermined clutch pin coil springs 92 and outside the bottoms 90*e* and 94*d* of the spring holder 90 and the washer 94 (see FIG. 24, FIG. 26, and the like). Further, the respective internal gear lock pins 106 pass through pin holes 521 bored so as to correspond to the internal gear lock pins 106 in the wall body part 52*j* of the gear housing 52 (see FIG. 25). The rear end portions of the respective internal gear lock pins 106 can advance and retreat with respect to radially outward of the internal gear 82 at the third stage. As illustrated in FIG. 26 and the like, the respective pin holder coil springs 104 are located radially inward of the respective internal gear lock pins 106 having center axes different from the center axes of the respective pin holder coil springs 104. Additionally, the respective pin holder coil springs 104 are located radially inward of the washer 94 in contact with the respective clutch pins 96.

The pin holder coil springs 104 bias the respective internal gear lock pins 106 forward via the pin holder 102. The respective spring holders 102*c* of the pin holder 102 have rear portions located radially inward of the washer 94.

Figure 21:
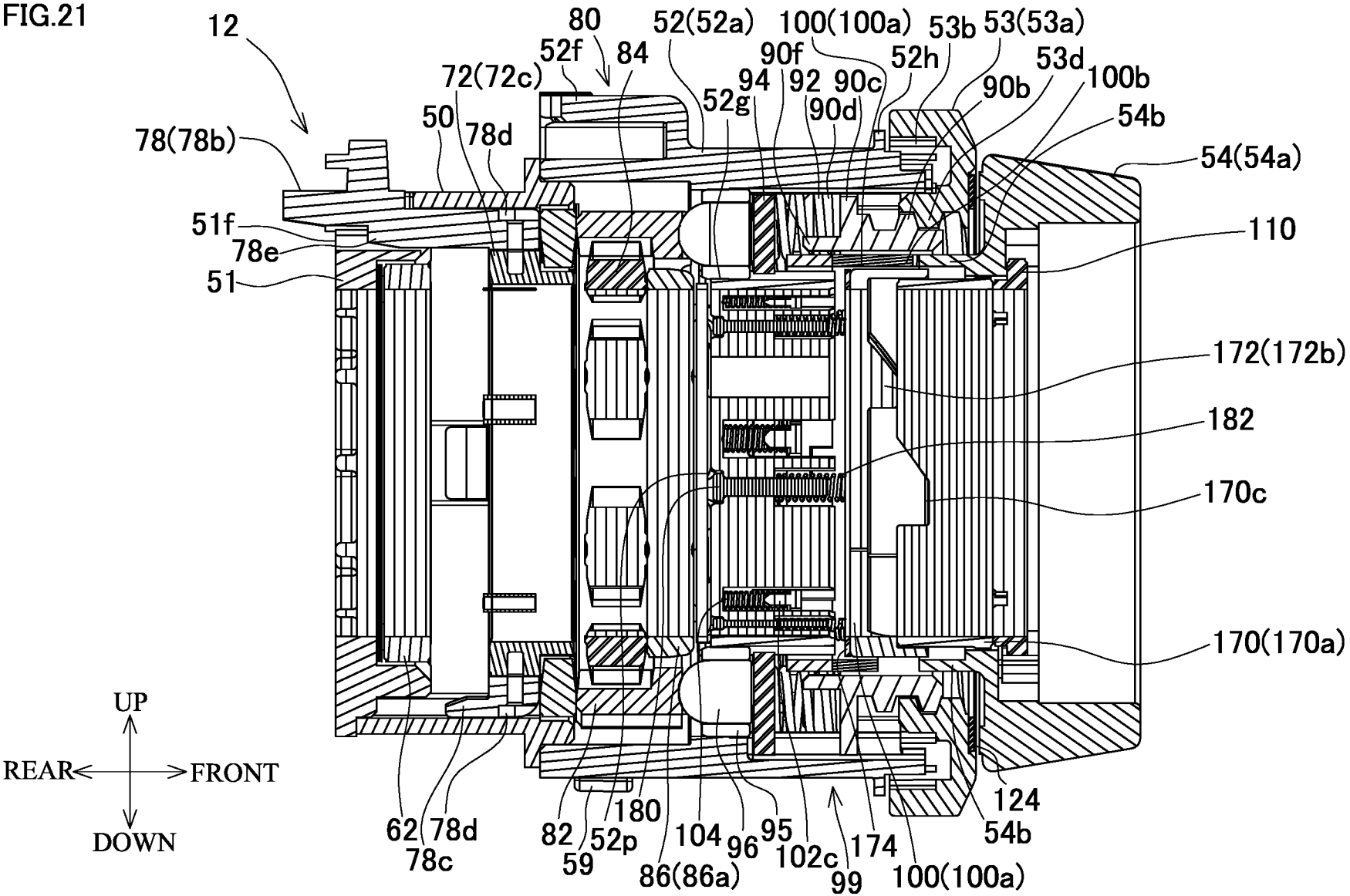
FIG. 21 is a cross-sectional view taken along CAM-CAM of FIG. 20.

As illustrated in FIG. 21, the mode switching ring 54 includes a mode switching ring base portion 54*a* having a tapered cylindrical shape tapered toward the front and with the uneven outside, and a cam portion 54*b* projecting in a cylindrical shape rearward from the rear end portion of its inner surface.

Figure 36:
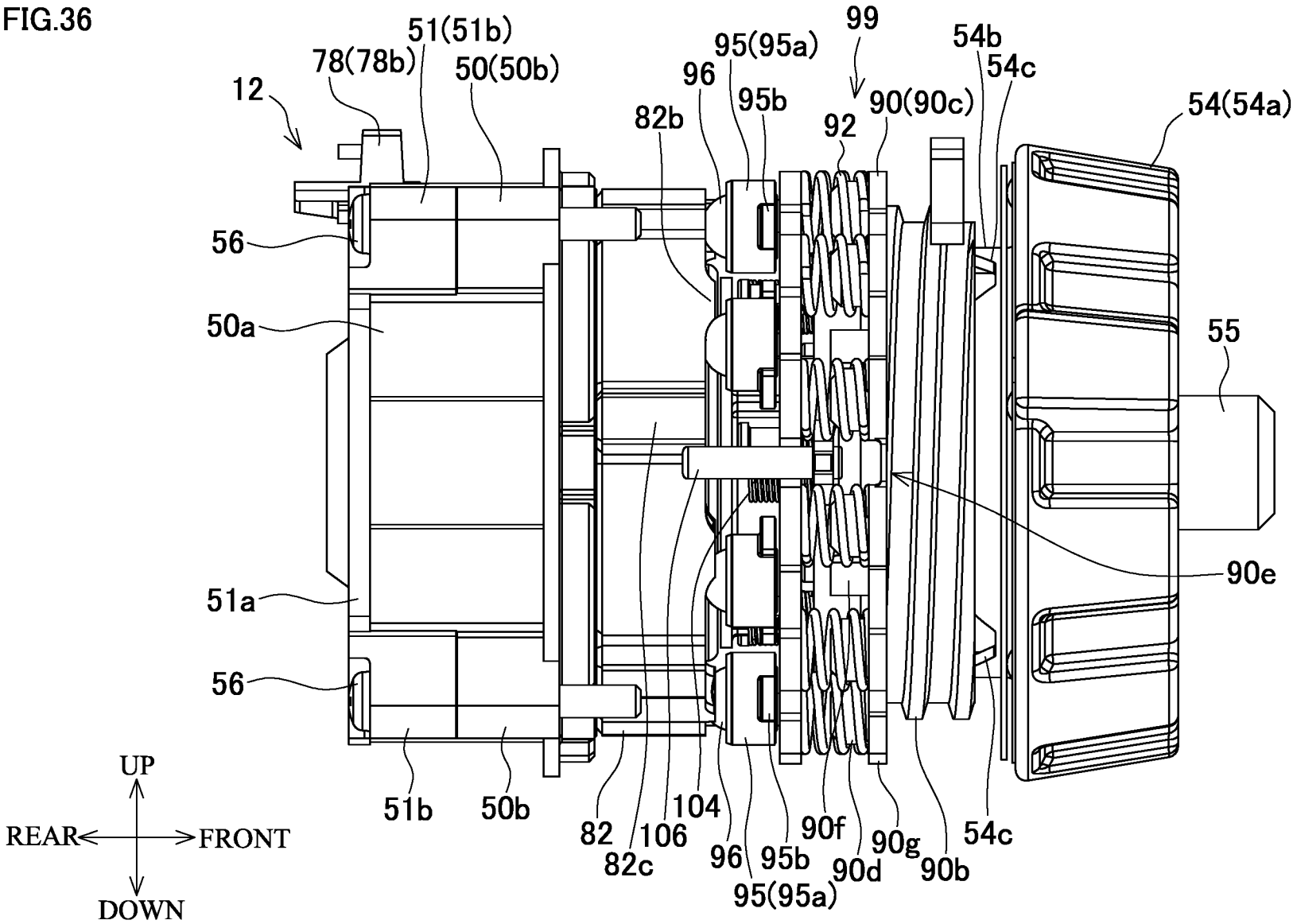
FIG. 36 is a drawing when a part of an outer wall is removed in FIG. 10.
Figure 39:
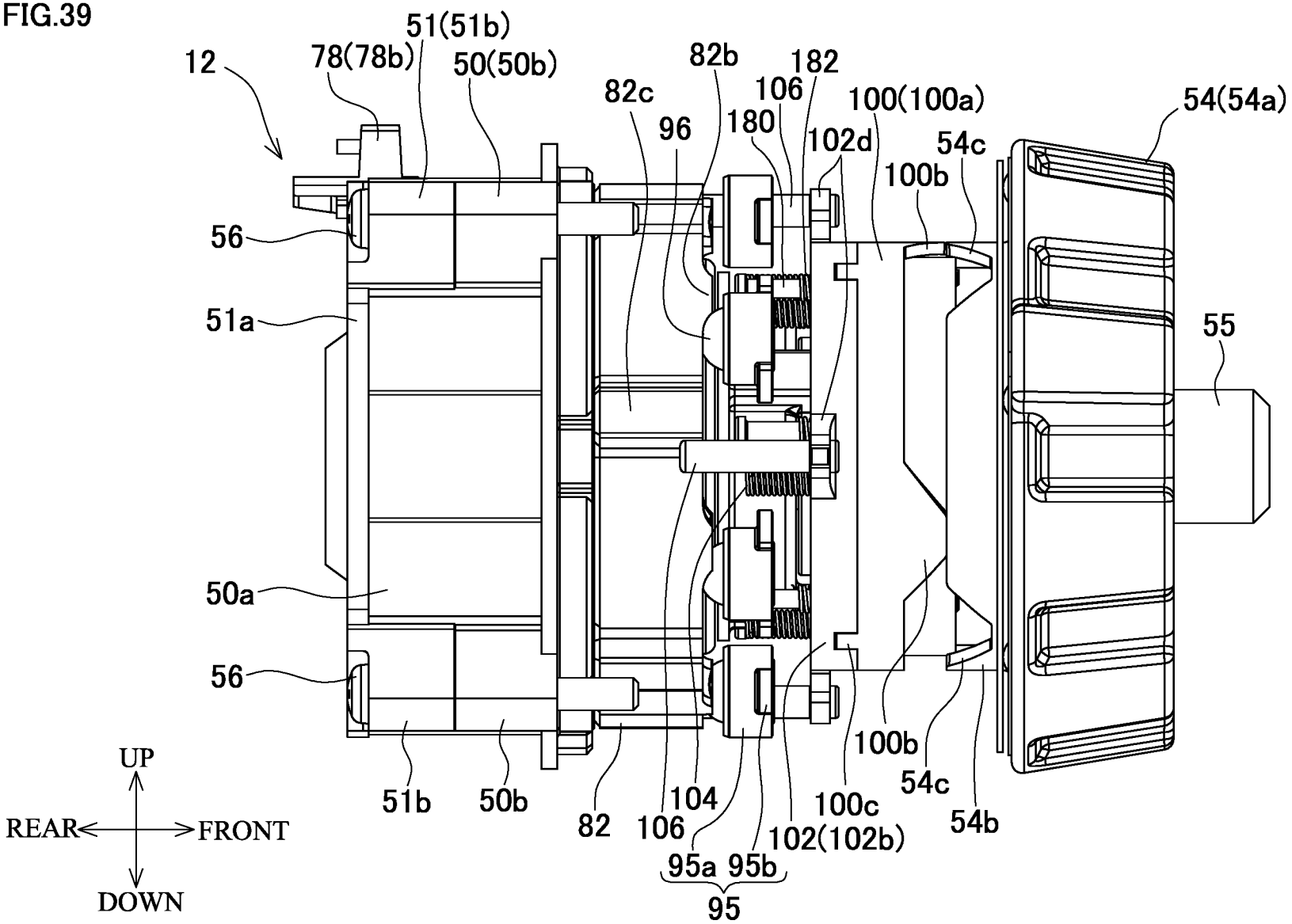
FIG. 39 is a drawing when a part of an internal mechanism is removed in FIG. 36 and a mode is other than a clutch mode.

The cam portion 54*b* includes cam depressed portions 4*c* depressed forward in trapezoidal shapes, which are located similarly to the cam protrusions 100*b* of the support ring 100, three positions in total (see FIG. 15, FIG. 19, FIG. 36. FIG. 39, and the like). The support ring 100 is located on the rear side of the cam portion 54*b*.

As illustrated in FIG. 11, FIG. 13, FIG. 15, and FIG. 40, a rotation restricting rib 54*d* projecting radially inward in a ring shape is disposed on the inner surface of the mode switching ring 54 and the front side of the cam portion 54*b*. A rotation permitting concave portion 54*e* depressed radially outward is formed on the upper portion of the rotation restricting rib 54*d*. A pair of leaf spring lock portions 54*f* are formed on the lower portion of the rotation restricting rib 54*d* to lock a leaf spring 114 as an elastic body.

The mode switching ring 54 is mounted to be rotatable around the axis with the cam portion 54*b* located radially outward of the inner tubular portion 52*g* of the gear housing 52. To the front end portion of the inner tubular portion 52*g*, a ring-shaped retainer 110 is fixed with a plurality (four pieces) of screws 112. The mode switching ring 54 is sandwiched between the retainer 110 and the clutch ring 53.

Figure 11:
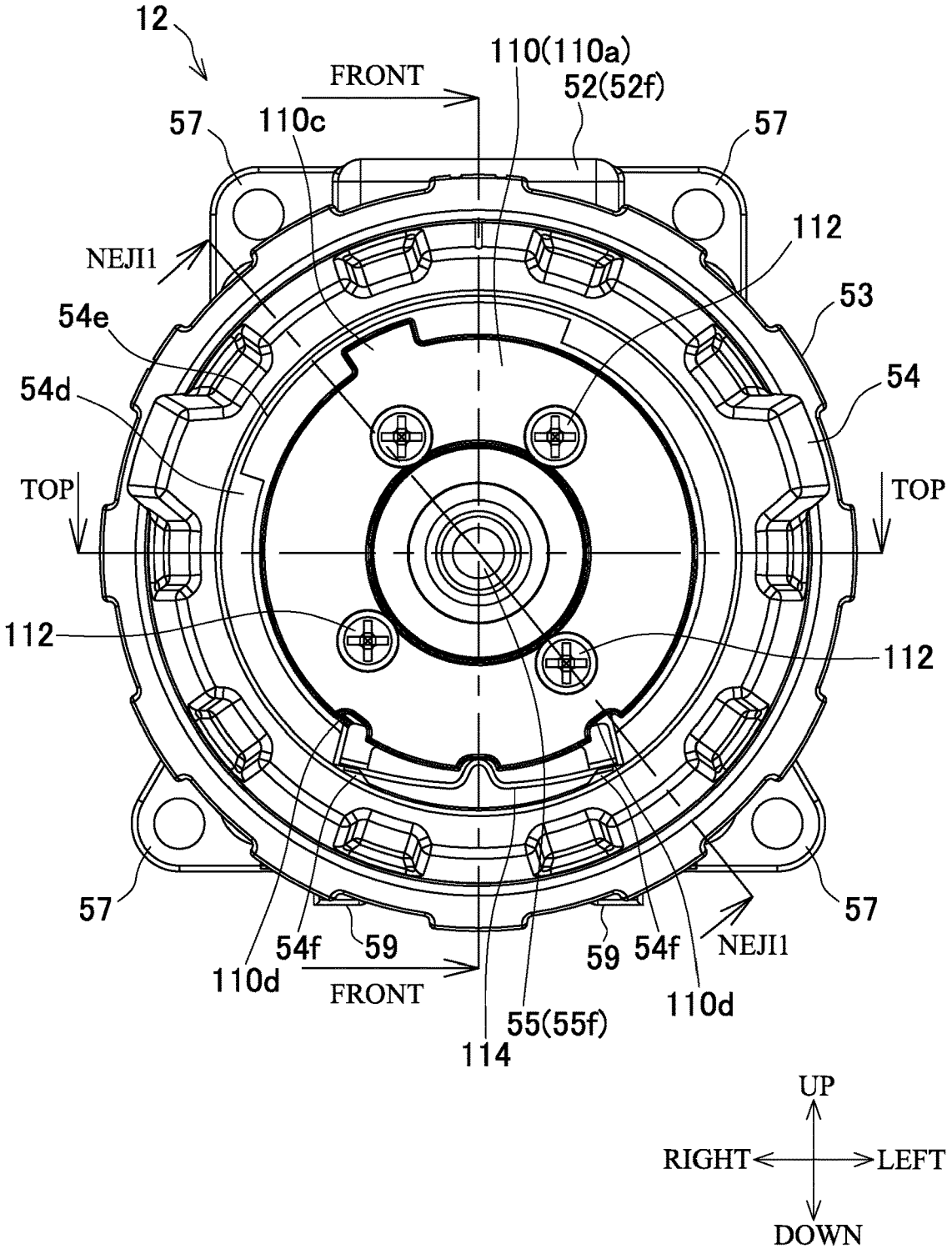
FIG. 11 is a front view of FIG. 10.
Figure 12:
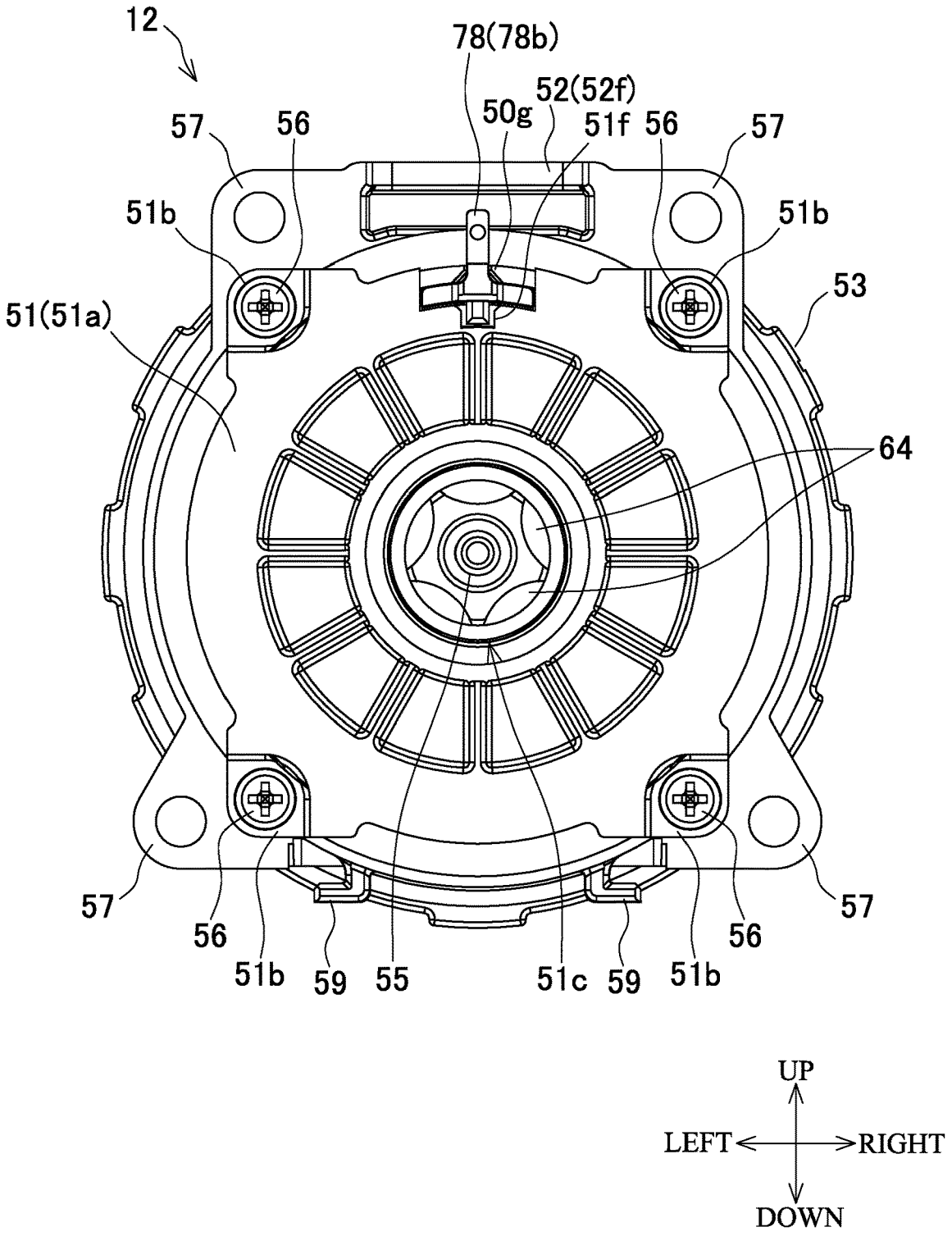
FIG. 12 is a rear view of FIG. 10.
Figure 13:
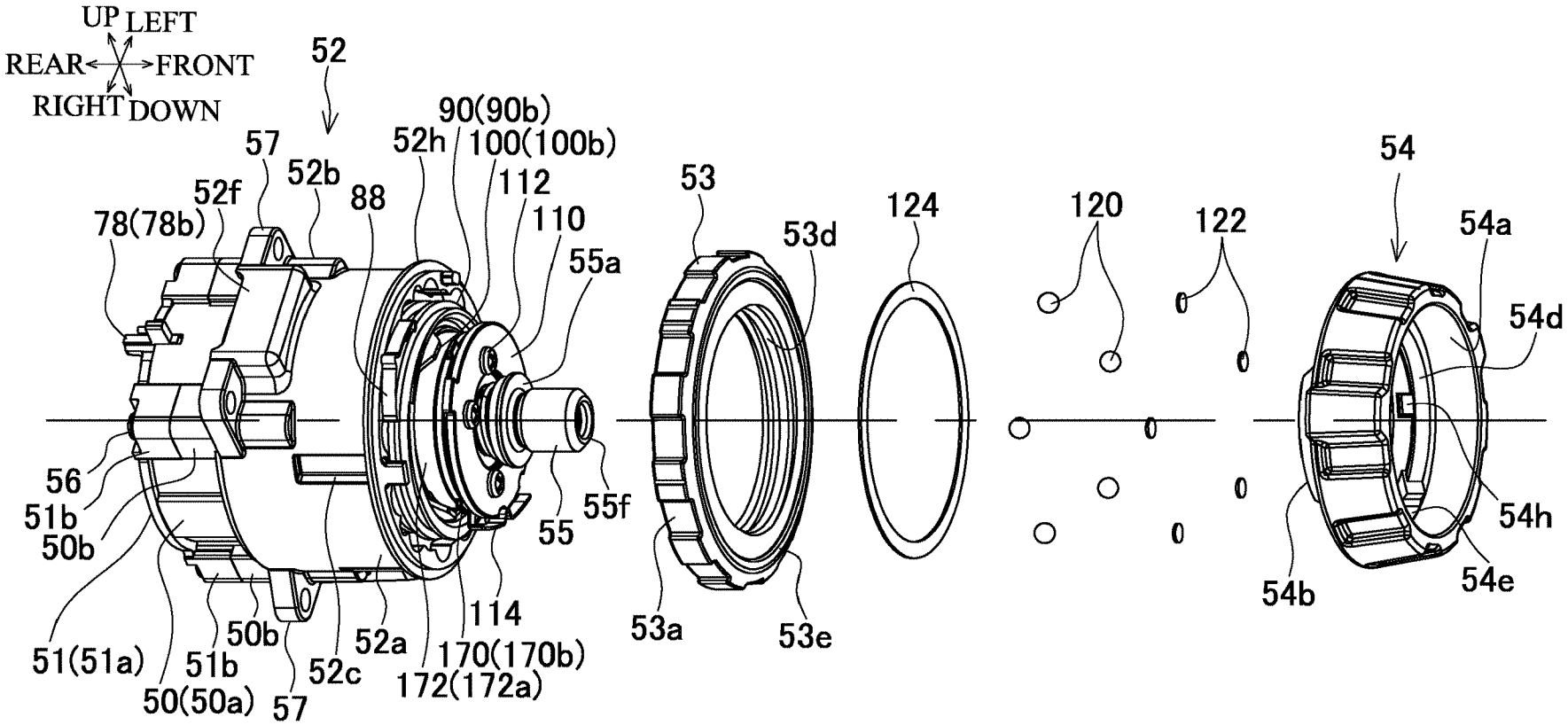
FIG. 13 is a perspective view of FIG. 10 where only a front portion is exploded.
Figure 14:
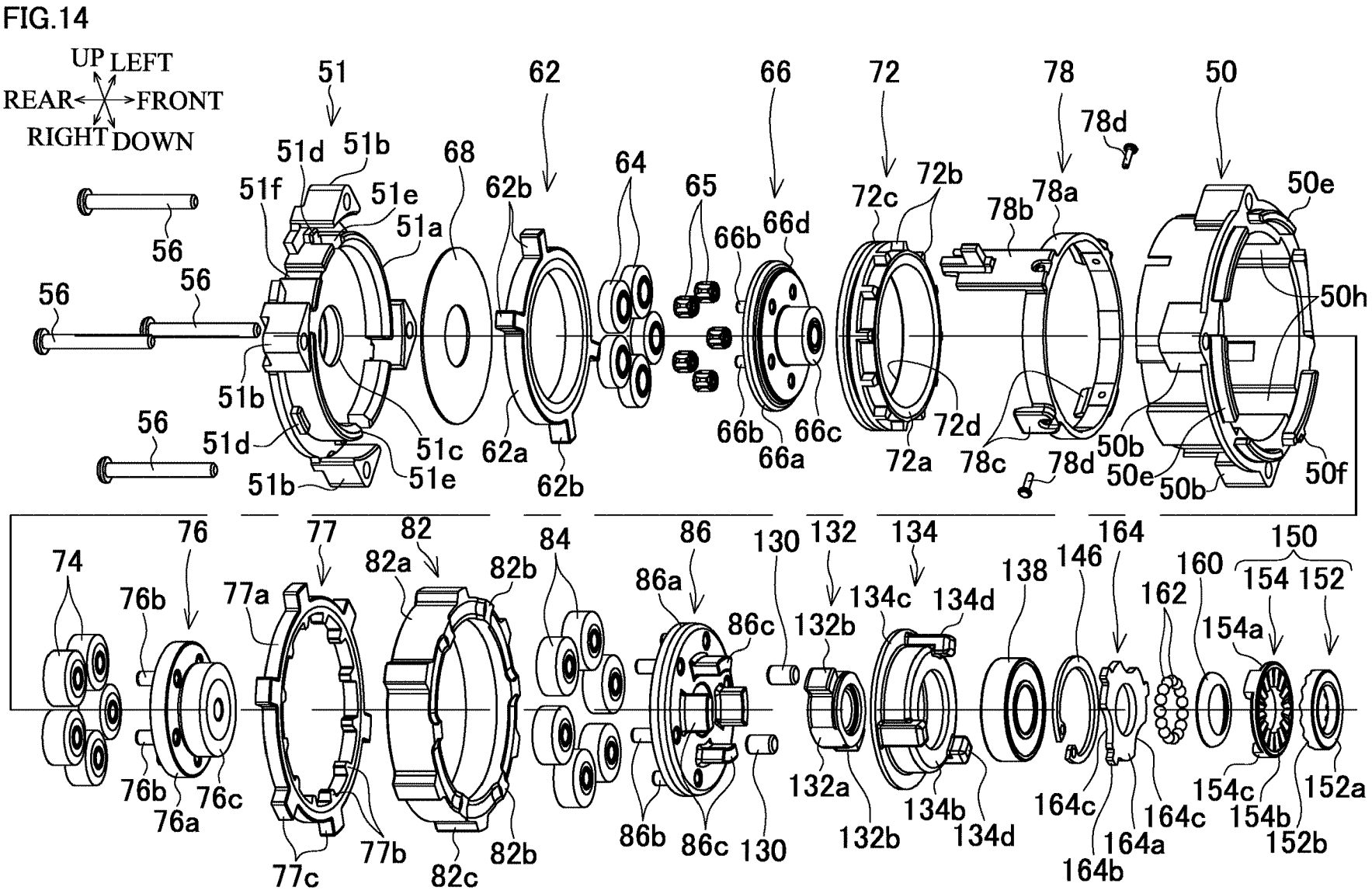
FIG. 14 is an exploded perspective view of a part of FIG. 10.
Figure 40:
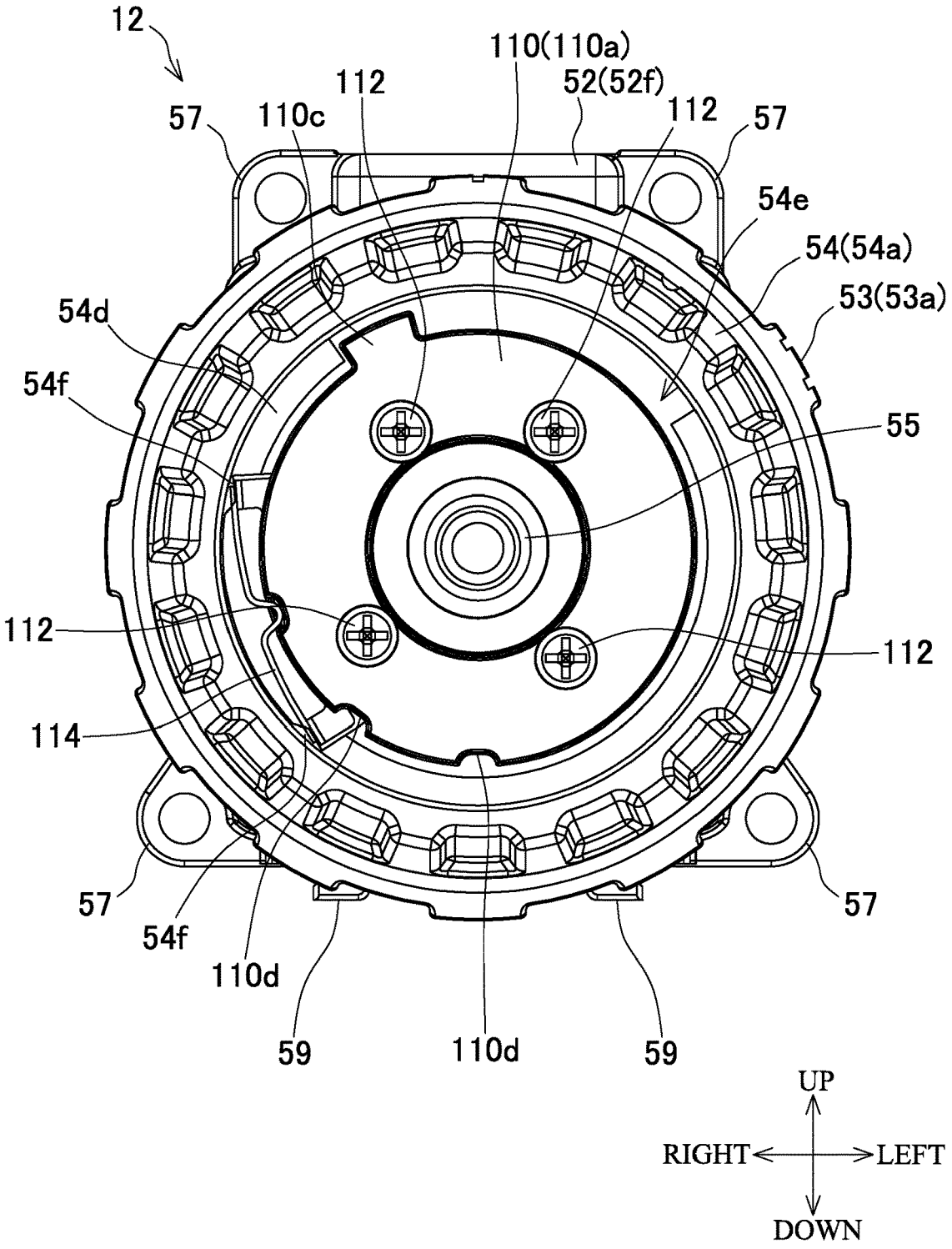
FIG. 40 is a drawing similar to FIG. 10 in the clutch mode.

As illustrated in FIG. 11 and FIG. 40, the retainer 110 includes a circular retainer base portion 110*a*, respective screw-holes 110*b* disposed on the retainer base portion 110*a* through which the screws 112 pass, a projecting piece 110*c* projecting radially outward from the outer side of the retainer base portion 110*a*, and a plurality of (three positions) notches 110*d* hollowed radially inward from the outer side of the retainer base portion 110*a* on a side opposed to the projecting piece 110*c*.

The respective screw-holes 110*b* are located so as not to form a rotation symmetry with respect to the center of the retainer base portion 110*a*. A plurality of screw-hole portions 52*m* are formed on the front end portion of the inner tubular portion 52*g* located similarly to the respective screw-holes 110*b* to receive the screws 112. The non-rotation symmetry locations of the respective screw-holes 110*b* and the respective screw-hole portions 52*m* prevents the retainer 110 from being mounted in an incorrect orientation of the retainer 110.

The projecting piece 110*c* is positioned inside the rotation permitting concave portion 54*e* of the mode switching ring 54 viewed in the circumferential direction.

The notches 110*d* are located at regular intervals in the circumferential direction in a predetermined arc. A bulge portion radially inward in the leaf spring 114 can enter any one of the notches 110*d*.

Rotating the mode switching ring 54 to the left viewed from the rear against the biasing force from the leaf spring 114 from a state where the leaf spring 114 enters the center notch 110*d* (referred to as a center state, see FIG. 11), the leaf spring 114 enters the right notch 110*d* (referred to as a left state, see FIG. 40). At this time, the projecting piece 110*c* is positioned at the end portion of the rotation permitting concave portion 54*e*, and the additional left rotation is restricted by the rotation restricting rib 54*d*. Similarly, the right rotation from the center state enters the leaf spring 114 into the left notch 110*d* (referred to as a right state), and the additional right rotation is restricted.

Figure 27:
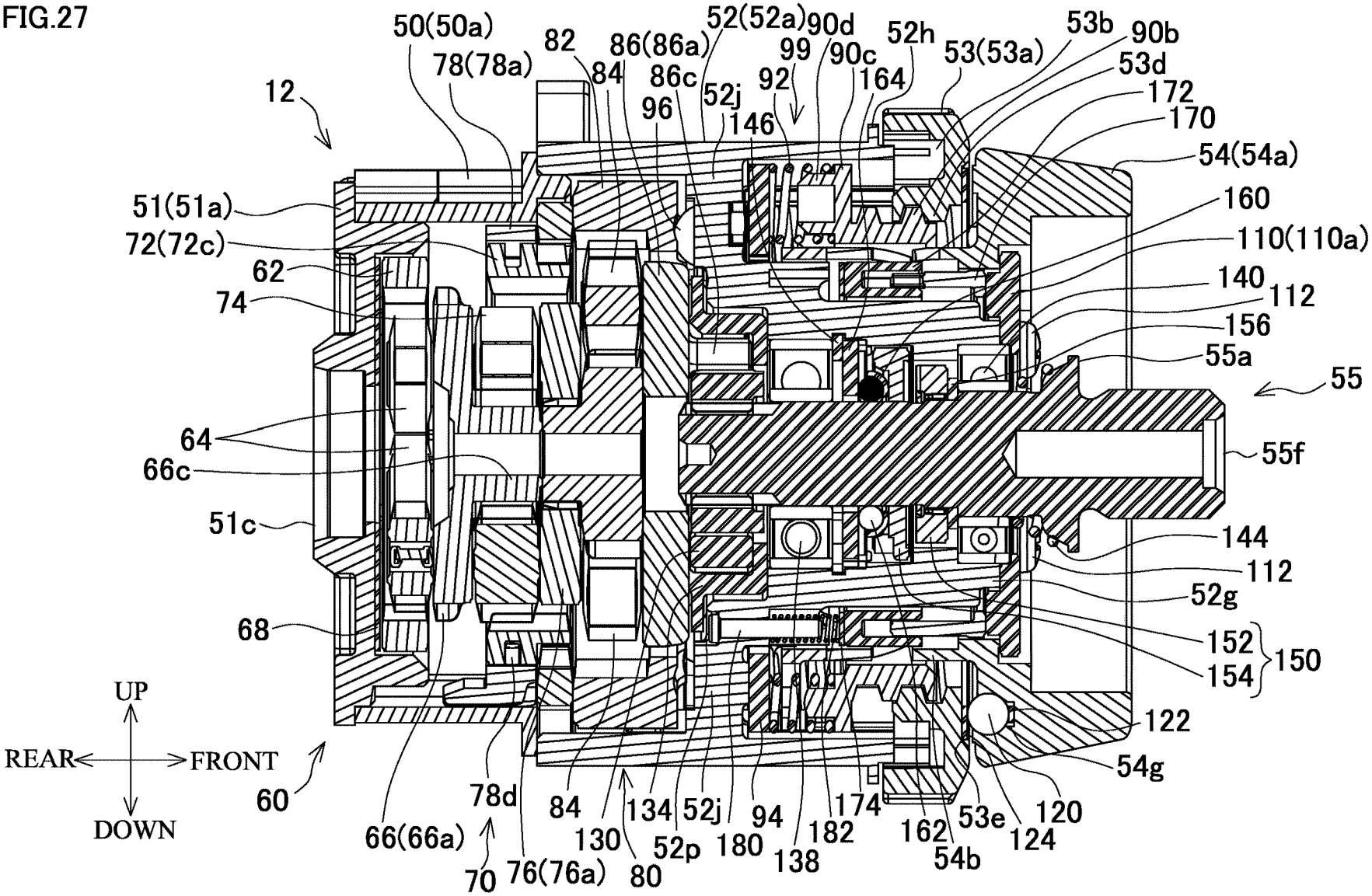
FIG. 27 is a cross-sectional view taken along V-V of FIG. 26.

As illustrated in FIG. 25 and FIG. 27, between the mode switching ring 54 and the clutch ring 53, a plurality (five pieces) of balls 120 made of steel are disposed as sliding members.

Five pieces of hollow portions 54*g*, which are hollowed forward from the rear surface of the mode switching ring base portion 54*a*, are located at regular intervals in the circumferential direction. The balls 120 are entered the respective hollow portions 54*g* via circular plates 122 made of steel. Meanwhile, a ring-shaped groove 53*e* is formed on the front surface of the clutch ring base portion 53*a*, and a washer 124 made of steel is inserted into the groove 53*e*. The rear portions of the respective balls 120 contact the washer 124.

Relatively rotating the mode switching ring 54 and the clutch ring 53 causes the respective balls 120 to roll between the circular plates 122 and the washer 124 and reduces a friction between the mode switching ring 54 and the clutch ring 53.

As illustrated in FIG. 11, FIG. 30, and FIG. 36 to FIG. 39, with the mode switching ring 54 in the center state or the right state, parts of the cam portion 54*b* other than the cam depressed portions 54*c* contact the front end portions of the respective cam protrusions 100*b* of the support ring 100 and the support ring 100 is positioned rearward. Then, the pin holder 102 is positioned rearward and the respective internal gear lock pins 106 enter between the projecting portions 82*c* in the circumferential direction, radially outward of the internal gear 82 at the third stage. The respective internal gear lock pins 106 abut on the side surfaces of the projecting portions 82*c* to block the rotation of the internal gear 82 at the third stage.

Figure 42:
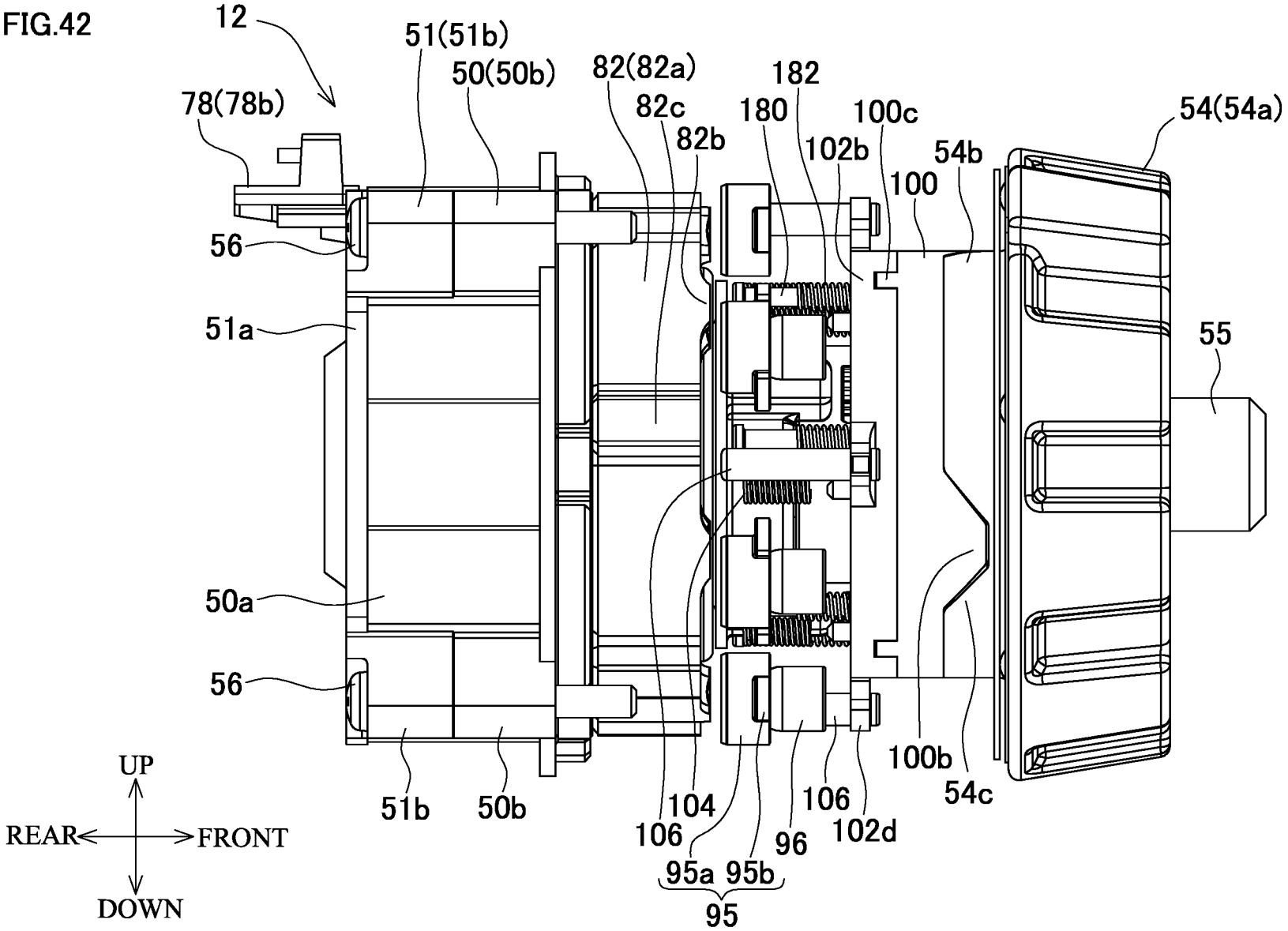
FIG. 42 is a drawing similar to FIG. 39 in the clutch mode.

Meanwhile, as illustrated in FIG. 40 to FIG. 42, with the mode switching ring 54 in the left state, the respective cam protrusions 100*b* enter the cam depressed portions 54*c*, and the support ring 100 is positioned forward. Then, the pin holder 102 is positioned forward, and the respective internal gear lock pins 106 escape from radially outward of the internal gear 82 at the third stage. Accordingly, the respective internal gear lock pins 106 do not interfere with the rotation of the internal gear 82 at the third stage. Therefore, the internal gear 82 at the third stage starts rotating at the torque according to the rotation position of the clutch ring 53, and the clutch operates (the clutch mode).

The respective pin holder coil springs 104 bias the support ring 100 via the pin holder 102, thus promoting the entrance of the respective cam protrusions 1 (Kb to the cam depressed portions 54*c*. In the case where the mode switching ring 54 is rotated to turn into another state from the left state, the respective cam protrusions 100*b* are detached from the cam depressed portions 54*c* against the biasing forces from the respective pin holder coil springs 104, and the pin holder 102 is positioned rearward.

As illustrated in FIG. 28A, a pair (right and left in the drawing) of respective rollers 130 are located in opposed respective projecting bodies 86*c* of the carrier 86 at the third stage.

A lock cam 132 is located in another pair (the upper and lower sides in the drawing). The lock cam 132 includes a cylindrical portion 132*a* and a pair of projecting pieces 132*b* projecting radially outward from the top and the bottom of the cylindrical portion 132*a*, and the respective projecting pieces 132*b* are positioned between the projecting bodies 86*c*. The cylindrical portion 132*a* of the lock cam 132 has a center hole spline-coupled to the rear stepped portion 55*d* of the spindle 55, and the lock cam 132 is integrated with the spindle 55. The lock cam 132 rotates together with the carrier 86 at the third stage via the respective projecting bodies 86*c*. The lock cam 132 has a front side covered with a cylindrical lock ring 134. The lock ring 134 is fixed to the inside of the inner tubular portion 52*g* of the gear housing 52. The lock ring 134 includes a cylindrical lock ring base portion 134*a*, an inner flange 134*b* projecting inward from the inner surface of the front end portion of the lock ring base portion 134*a*, an outer flange 134*c* projecting outward from the outer surface of the rear end portion of the lock ring base portion 134*a*, and a plurality of (three positions) projecting portions 134*d* projecting radially outward from the side surface of the lock ring base portion 134*a* and further projecting forward located at regular intervals in the circumferential direction. On the rear side of the inner flange 134*b*, the respective rollers 130, the lock cam 132, and the respective projecting bodies 86*c* of the carrier 86 at the third stage are positioned. The projecting portions 134*d* enter the inner surface of the inner tubular portion 52*g* of the gear housing 52 formed so as have the corresponding shape to fix the lock ring 134 unrotatable.

As illustrated in FIG. 15 to FIG. 18 and FIG. 26, the spindle 55 is held to be movable back and forth and rotatable around the axis with a spindle rear bearing 138, which is located on the front side of the lock ring 134, and a spindle front bearing 140, which is located radially outward of the front stepped portion 55*b*.

The spindle front bearing 140 is located outside the front stepped portion 55*b* of the spindle 55.

Between the spindle front bearing 140 and the spindle flange 55*a*, a spindle coil spring 144 as an elastic body is disposed. The rear surface of the spindle flange 55*a* and the spindle coil spring 144 have inverted tapered shapes expanding forward whose diameters gradually expand toward the front.

Meanwhile, a clip 146 that presses (a front surface of an outer race of) the spindle rear bearing 138 enters a groove disposed on the inner surface of the inner tubular portion 52*g* of the gear housing 52.

As illustrated in FIG. 14, FIG. 16 to FIG. 18, FIG. 19, FIG. 20, and FIG. 22, between the spindle front bearing 140 and the clip 146, a vibration mechanism 150 is located. The vibration mechanism 150 includes a first vibration cam 152 and a second vibration cam 154 each having a ring shape and held to the intermediate stepped portion 55*c* of the spindle 55.

A first cam surface 152*b* having a plurality of cam teeth is formed on the rear surface of a cylindrical first vibration cam base portion 152*a* in the first vibration cam 152. The first vibration cam 152 is fixed integrally with the spindle 55 with a circlip 156, which is fixed outside the front end portion in the intermediate stepped portion 55*c* of the spindle 55.

In an ordinary state, the spindle 55 is biased to an advance position where the circlip 156 contacts (an inner race of) the spindle front bearing 140 by the spindle coil spring 144.

A second cam surface 154*b* having a plurality of cam teeth is formed on a front surface of a ring-shaped second vibration cam base portion 154*a* in the second vibration cam 154. On the rear surface of the second vibration cam base portion 154*a*, a plurality (three pieces) of claws 154*c* projecting rearward are disposed at regular intervals in the circumferential direction. The second vibration cam 154 is placed on the outer circumferential surface of the spindle 55 so as not to be fixed in the circumferential direction.

Between the second vibration cam 154 and the clip 146, a ball holding washer 160, a plurality of balls 162 made of steel, and a ball receiving washer 164 are disposed.

Figure 22:
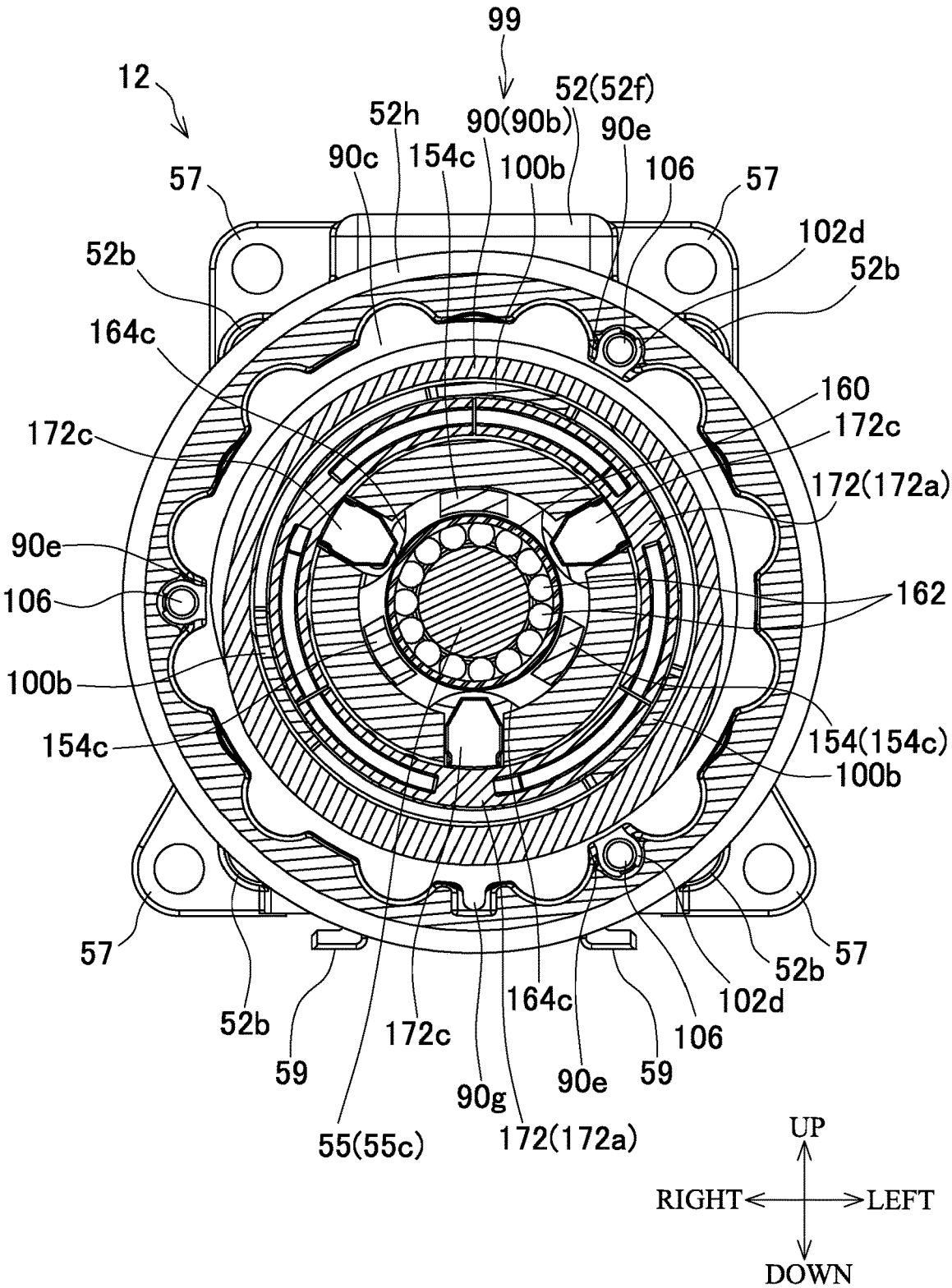
FIG. 22 is a cross-sectional view taken along B-B of FIG. 16.

As illustrated in FIG. 22, the ball holding washer 160 is adjacent to the rear surface of the second vibration cam base portion 154*a*. The ball holding washer 160 having a bowl shape with its inner peripheral portion as the front end and its outer peripheral portion as the rear end, holds the respective balls 162 on the side of the curved rear surface, and arranges the respective balls 162 in the circumferential direction.

Figure 23:
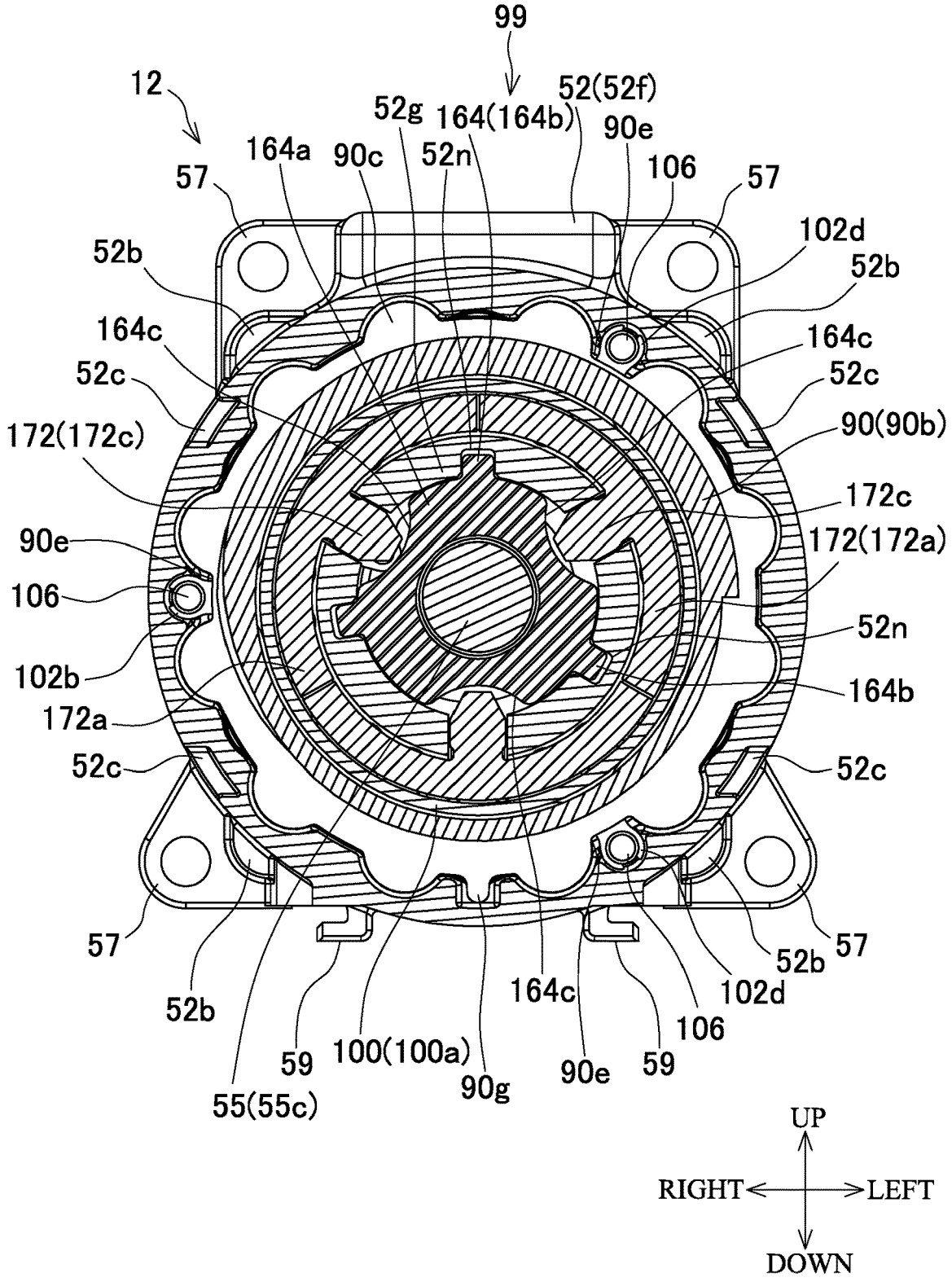
FIG. 23 is a cross-sectional view taken along C-C of FIG. 16.

As illustrated in FIG. 23, the ball receiving washer 164 includes a plurality of (three positions) convex portions 164*b* and respective narrow portions 164*c*. The convex portions 164*b* projecting radially outward from a circular ball receiving washer base portion 164*a* are located at regular intervals in the circumferential direction. The narrow portions 164*c* are located between the respective convex portions 164*b* in the circumferential direction. The rotation of the ball receiving washer 164 is prevented by entering the respective convex portions 164*b* into concave portions 52*n*, which are disposed on the inner surface of the inner tubular portion 52*g* of the gear housing 52.

Note that at least any of the circlip 156, the ball holding washer 160, the balls 162, and the ball receiving washer 164 may be included in the vibration mechanism 150.

As illustrated in FIG. 15 to FIG. 24, a vibration switching ring 170 is disposed radially inward of the cam portion 54*b* of the mode switching ring 54. On the rear side of the vibration switching ring 170, one set (three pieces) of vibration switching levers 172 (vibration switching members, a part of vibration switching means) having an arc shape one-third of the circumference are disposed. That is, the plurality of respective vibration switching levers 172 are arranged in the circumferential direction to form a ring shape by the combination of the three pieces. A washer 174 is disposed on the rear side of the vibration switching levers 172.

The vibration switching ring 170 includes a plurality of (three positions) protrusions 170*b* and a plurality of (three positions) trapezoidal cam depressed portions 170*c*. The protrusions 170*b* project radially outward from a front end portion of a cylindrical vibration switching ring base portion 170*a* located at regular intervals in the circumferential direction. The cam depressed portions 170*c* are depressed forward from the rear end portion of the vibration switching ring base portion 170*a* located at positions identical to the protrusions 170*b* in the circumferential direction. The respective protrusions 170*b* enter hollow portions 54*h* (see FIG. 13), which are correspondingly disposed on the rear portion of the cam portion 54*b* of the mode switching ring 54, and the vibration switching ring 170 rotates integrally with the mode switching ring 54.

The vibration switching lever 172 each includes a vibration switching lever base portion 172*a* having a "U" shape in cross section opening forward, a bulge portion 172*b* as a vibration switching cam portion (see FIG. 17, FIG. 21, and the like) bulging forward with shapes corresponding to the cam depressed portions 170*c* in the vibration switching lever base portions 172*a*, and a vibration switching claw 172*c* (see FIG. 22, FIG. 23, and the like) projecting radially inward and rearward from the center of the outer surface radially inward of the vibration switching lever base portion 172*a*. The respective vibration switching levers 172 are located radially outward of the inner tubular portion 52*g* in a state where the vibration switching claws 172*c* enter a plurality of (three positions) holes 52*o* (through-holes, see FIG. 15) in the radial direction bored at regular intervals in the circumferential direction at centers in the front-rear direction of the inner tubular portion 52*g* of the gear housing 52. The vibration switching lever 172 is located inside the support ring 100. Note that the uneven surfaces of the bulge portion 172*b* and the cam depressed portion 170*c* may be interchanged.

As illustrated in FIG. 22 and FIG. 23, the respective vibration switching claws 172*c* are positioned radially outward of narrow portions 164*c* of the ball receiving washer 164. That is, the ball receiving washer 164 includes the narrow portions 164*c* so as to avoid the respective vibration switching claws 172*c*.

Further, the respective vibration switching claws 172*c* are configured to advance and retreat with respect to between the claws 154*c*, which project rearward on the rear side of the second vibration cam base portion 154*a*.

Respective pin holes 52*p* extending back and forth are bored between the holes 52*o* at three positions in the inner tubular portion 52*g* of the gear housing 52 and parts adjacent to the hollow portions 52*k* at the six positions in the circumferential direction (see FIG. 21, FIG. 27, and the like). Pins 180 are inserted from rearward into the respective pin holes 52*p*. The pin holes 52*p* each have a front portion enlarged with respect to the rear portion. Between the enlarged portions and the front portions of the respective pins 180, vibration switching lever coil springs 182 as elastic bodies are inserted. The respective vibration switching lever coil springs 182 have front end portions contacting the washer 174 on the rear side of the respective vibration switching levers 172. The respective vibration switching lever coil springs 182 bias the washer 174 and the respective vibration switching levers 172 forward.

That is, the respective vibration switching lever coil springs 182 as biasing members are circumferentially arranged by three pieces or more (six pieces). The plurality (two pieces) of the vibration switching lever coil springs 182 contact one vibration switching lever 172, thus biasing (pushing) the vibration switching lever 172 by the plurality of vibration switching lever coil springs 182.

As illustrated in FIG. 22 and FIG. 23, with the mode switching ring 54 in the center state or the left state, parts other than the cam depressed portions 170*c* in the rear end portion of the vibration switching ring base portion 170*a* contact the front end portions of the bulge portions 172*b* of the respective vibration switching levers 172, and the respective vibration switching levers 172 are positioned rearward. Then, the respective vibration switching claws 172*c* are positioned rearward, separate from between the claws 154*c* of the second vibration cam 154. Thus, the respective vibration switching claws 172*c* permit this rotation to allow the rotation of the second vibration cam 154. Although the rotation of the spindle 55 integrally rotates the first vibration cam 152 and the second vibration cam 154 also rotates appropriately via the first cam surface 152*b* and the second cam surface 154*b*, since the rotation of the second vibration cam 154 is permitted with the second vibration cam 154 placed on the outer circumferential surface of the spindle 55, the vibration does not occur.

Figure 38:
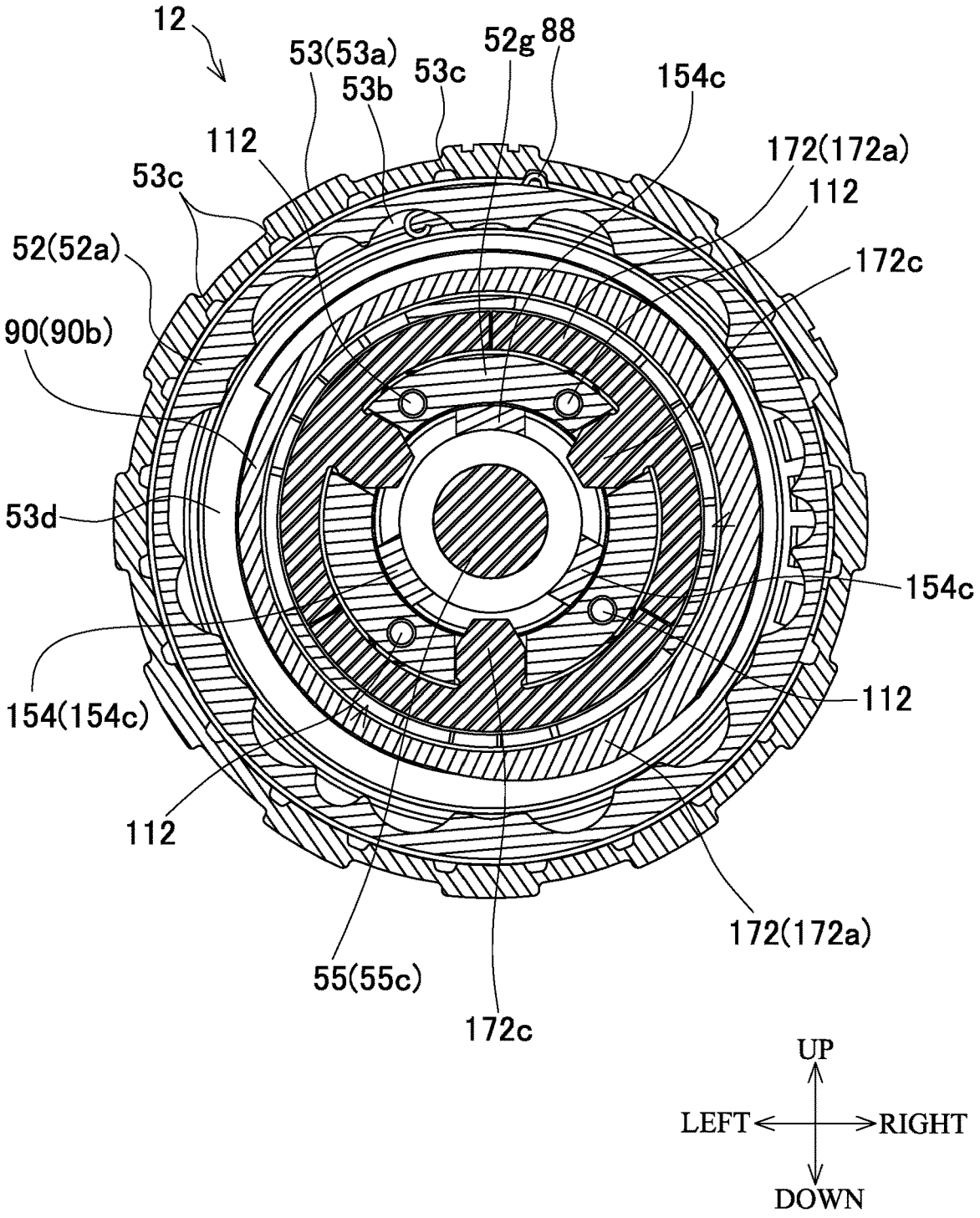
FIG. 38 is a cross-sectional view taken along W-W of FIG. 37.

In contrast to this, as illustrated in FIG. 38, with the mode switching ring 54 in the right state, the corresponding bulge portions 172*b* enter the respective cam depressed portions 170*c*, the respective vibration switching levers 172 positioned rearward while the mode switching ring 54 is in the center state or the left state move forward simultaneously, and the respective vibration switching levers 172 are positioned forward. Then, the respective vibration switching claws 172*c* are positioned forward and enter between the claws 154*c* of the second vibration cam 154. Even when the second vibration cam 154 attempts to rotate, the respective vibration switching claws 172*c* are hooked to the claws 154*c*, and thus the respective vibration switching levers 172 block the rotation of the second vibration cam 154 by the respective vibration switching claws 172*c*. While the rotation of the spindle 55 integrally rotates the first vibration cam 152, the second vibration cam 154 does not rotate; therefore, the retreat of the spindle 55 rotates the first cam surface 152*b* while in contact with the fixed second cam surface 154*b*, thus generating the axial vibration in the spindle 55 (vibration mode). In the electric vibration driver drill 1, the vibration switching ring 170, the respective vibration switching levers 172, the pins 180, and the respective vibration switching lever coil springs 182 constitute the vibration switching means. Additionally, switching the mode switching ring 54 from the right state to the center state or the left state moves the respective vibration switching levers 172, which are positioned forward, rearward at the same time.

By positioning the respective vibration switching levers 172 forward, the rear end portion of the vibration switching ring base portion 170*a* relatively enters the respective vibration switching lever base portions 172*a* to increase contact of the respective vibration switching levers 172 and contact of the vibration switching ring 170 and the respective vibration switching levers 172. Therefore, when the vibration occurs, obstructiveness of parts forward with respect to the respective vibration switching levers 172 (inside the inner tubular portion 52*g* of the gear housing 52) is secured, a dust-proof performance is secured, and a leakage of grease and the like applied to the inside of this part is prevented.

Further, the respective vibration switching lever coil springs 182 bias the respective vibration switching levers 172 forward to facilitate entry of the respective bulge portions 172*b* into the cam depressed portions 170*c*. In the case where the mode switching ring 54 is rotated from the right state to another state, against the biasing forces from the respective vibration switching lever coil springs 182, the respective bulge portions 172*b* separate from the cam depressed portions 170*c*, and the respective vibration switching levers 172 are positioned rearward.

The following describes an operation example of such electric vibration driver drill 1.

When a worker grips the grip portion 6 to pull the switch lever 8, switching in the switch main body 9 feeds the power from the battery 32 to the motor 10 to rotate the rotor 41 (motor shaft).

The rotation of the motor shaft rotates the fan 44. Exhausting air to the respective exhaust outlets 22*a* of the fan 44 generates an airflow (wind) from the air inlets 20*c*. Such a wind cools the mechanism inside the housing 2 including the motor 10.

The rotational force of the motor shaft is decelerated by the gear assembly 12 having the three-stage deceleration mechanism, is transmitted to the spindle 55, and then is transmitted to a drill or a bit such as a driver attached to the chuck 14.

The intermediate planetary gear mechanism 70 in the gear assembly 12 operates in the high speed mode or the low speed mode according to the position of the speed switching lever 79.

Further, according to the rotation position of the mode switching ring 54, the three operation modes are selectable.

That is, with the mode switching ring 54 in the left state, the clutch mode is selected. When a torque corresponding to the rotation position of the clutch ring 53 is applied to the spindle 55, the front planetary gear mechanism 80 generates idling to throw out the clutch (stop the torque transmission). The screw tightening proceeds with a driver bit, and when the screw is fully inserted and the large torque is applied, the spindle 55 idles and thus the screw tightening is terminated.

Meanwhile, with the mode switching ring 54 in the right state, the vibration mode is selected. The respective vibration switching levers 172 lock the rotation of the second vibration cam 154, the retreat of the spindle 55 during rotation frictions the first cam surface 152*b* and the second cam surface 154*b* together, thus causing the axial vibration in the spindle 55.

On the other hand, with the mode switching ring 54 in the center state, the internal gear 82 of the front planetary gear mechanism 80 is fixed and the second vibration cam 154 is allowed to rotate, thus entering the drill mode in which the clutch does not operate and the vibration does not occur. In the drill mode, the spindle 55 is rotated without throwing out the clutch, and when the worker installs the drill bit to advance drilling, the rotation of the spindle 55 continues regardless of a load on the spindle 55.

The above-described electric vibration driver drill 1 includes the housing 2 (gear housing 52), the mode switching ring 54 (first ring) and the clutch ring 53 (second ring) each externally mounted to the housing 2 to be rotatable, and the respective balls 120 (sliding members) located between the mode switching ring 54 and the clutch ring 53. Accordingly, the friction between the mode switching ring 54 and the clutch ring 53 is reduced, and therefore the mode switching ring 54 and the clutch ring 53 easily rotate.

Since the sliding members are the respective balls 120, the sliding members are further easily located compared with the use of cylindrical bearings.

Further, the respective circular plates 122 are interposed between the mode switching ring 54 and the respective balls 120, and the washer 124 is interposed between the clutch ring 53 and the respective balls 120. Accordingly, compared with the case of the respective balls 120 directly contacting the mode switching ring 54 or the clutch ring 53, the rotations of the balls 120 are further smoothened, and service lives of the respective balls 120, the mode switching ring 54, and the clutch ring 53 are further lengthened.

Moreover, the electric vibration driver drill 1 includes the housing 2 (gear housing 52), the vibration mechanism 150 and the clutch mechanism 99 each located inside the housing 2, the mode switching ring 54 (vibration switching ring) configured to operate the vibration mechanism 150 and rotatably held to the housing 2, the clutch ring 53 (clutch switching ring) configured to operate the clutch mechanism 99 and rotatably held to the housing 2, and the respective balls 120 located between the mode switching ring 54 the clutch ring 53. Accordingly, the friction between the mode switching ring 54 and the clutch ring 53 is reduced, and therefore the mode switching ring 54 and the clutch ring 53 easily rotate.

Further, the mode switching ring 54 operates the presence/absence of the vibration of the spindle 55 (output shaft) by the vibration mechanism 150 by whether to set the vibration mode (right state) or not. The clutch ring 53 operates the torque for causing the clutch to operate in the clutch mechanism 99 by the change in the rotation position. Therefore, the mode switching ring 54 and the clutch ring 53 easy to rotate facilitate commanding the presence/absence of the vibration and the clutch operation torque.

Additionally, the electric vibration driver drill 1 includes the motor 10, the spindle 55, the first vibration cam 152, the housing 2 (gear housing 52), the second vibration cam 154, the respective vibration switching levers 172, and the plurality (two pieces for each vibration switching lever 172, six in total) of respective vibration switching lever coil springs 182. The spindle 55 is rotatable by the motor 10. The first vibration cam 152 is fixed to the spindle 55. The first vibration cam 152 is located inward of the housing 2. The second vibration cam 154 is located inward of the housing 2. The second vibration cam 154 is configured to be in friction with the first vibration cam 152. The vibration switching levers 172 switch between a rotatable condition and an unrotatable condition of the second vibration cam 154 with respect to the housing 2. The plurality of vibration switching lever coil springs 182 bias the respective vibration switching levers 172. Accordingly, while the respective vibration switching lever coil springs 182 push the respective vibration switching levers 172 forward and secure the biasing force (elastic force) to switch the mode to the vibration mode, the biasing force can be dispersed into the plurality of vibration switching lever coil springs 182, thereby ensuring decreasing the magnitude of the biasing force of one vibration switching lever coil spring 182. Therefore, the electric vibration driver drill 1 that includes the compact vibration switching means and further is entirely compact is provided.

Three or more of the vibration switching lever coil springs 182 are disposed and circumferentially arranged. Accordingly, while the reliable switching to the vibration mode is secured, the electric vibration driver drill 1 that includes the compact vibration switching means and further is entirely compact especially in the front-rear direction is provided.

Further, the plurality (three pieces) of the vibration switching levers 172 are disposed and circumferentially arranged. Accordingly, the vibration switching levers 172 can be easily installed to the peripheral area of the vibration mechanism 150 and can block the rotation of the second vibration cam 154 with more certainty.

In addition, the second vibration cam 154 includes the claw 154*c*. The vibration switching lever 172 includes the vibration switching claw 172*c*. The vibration switching claw 172*c* is hooked to the claw 154*c* to block the rotation of the second vibration cam 154. Accordingly, the vibration switching lever 172 is configured to reliably switch between the rotatable condition and the unrotatable condition of the second vibration cam 154 with the simple configuration.

In addition, the electric vibration driver drill 1 includes the motor 10, the planetary gear 84, the internal gear 82, the internal gear lock pin 106, and the plurality of pin holder coil springs 104. The planetary gear 84 is driven by the motor 10. The internal gear 82 meshes with the planetary gear 84. The internal gear lock pin 106 blocks the rotation of the internal gear 82. The plurality of pin holder coil springs 104 bias the internal gear lock pin 106. The plurality of pin holder coil springs 104 have center axes different from a center axis of the internal gear lock pin 106. The plurality of pin holder coil springs 104 are circumferentially arranged. Accordingly, like the conventional case where coil springs having center axes matched with center axes of the internal gear lock pins 106 with one another are externally mounted, this configuration eliminates the need for increasing the diameters of the front ends of the internal gear lock pins 106 to allow the coil springs to push the internal gear lock pins 106, the internal gear lock pins 106 are entirely configured to have small diameters, and the respective internal gear lock pins 106 and the housing 2 housing these members become compact in the radial direction. Additionally, by disposing the plurality of pin holder coil springs 104, the individual pin holder coil springs 104 decrease while the accurate operations related to the front and rear movements of the internal gear lock pins 106 are secured, and therefore the housing 2 housing these members becomes compact in the radial direction.

Additionally, the plurality of internal gear lock pins 106 are disposed. Accordingly, the internal gear lock pins 106 decrease in the radial direction while the accurate operation related to the block of the rotation of the internal gear 82 by the internal gear lock pins 106 is secured, and therefore the housing 2 housing these members becomes compact in the radial direction.

Further, the plurality of pin holder coil springs 104 are located radially inward of the internal gear lock pins 106. Accordingly, the respective pin holder coil springs 104 are not positioned radially outward of the internal gear lock pins 106, thus making the electric vibration driver drill 1 compact in the radial direction.

Moreover, the internal gear lock pin 106 is held to the pin holder 102. The plurality of pin holder coil springs 104 bias the internal gear lock pin 106 via the pin holder 102. Accordingly, the electric vibration driver drill 1 compact in the radial direction is simply formed.

In addition, the electric vibration driver drill 1 includes the respective clutch pins 96 in contact with the internal gear 82 and the washer 94 in contact with the respective clutch pins 96. The respective spring holders 102*c* are located radially inward of the washer 94. The respective spring holders 102*c* hold the pin holder coil springs 104 in the pin holder 102. Accordingly, the washer 94 for the clutch mode and the rear portion of the pin holder 102 for the vibration mode and the drill mode overlap in the radial direction, making the electric vibration driver drill 1 compact in the front-rear direction. Note that the washer 94 moves back and forth via the respective clutch pins 96 in the clutch mode. Meanwhile, locating a part of the pin holder 102 radially inward of its moving range secures a compact property in the front-rear direction.

Further, the electric vibration driver drill 1 includes the respective clutch pins 96 in contact with the internal gear 82 and the washer 94 in contact with the respective clutch pins 96. The washer 94 includes the bottom 94*d* through which each internal gear lock pin 106 passes. Accordingly, the respective clutch pins 96, which contact the internal gear 82 for the clutch mode, are operable by the washer 94. Additionally, the respective internal gear lock pins 106, which block the rotation of the internal gear 82 for the vibration mode and the drill mode, pass through the bottoms 944, and thus the respective internal gear lock pins 106 are located compactly in the radial direction.

In addition, the electric vibration driver drill 1 includes the motor 10, the spindle 55, the first vibration cam 152, the housing 2 (gear housing 52), the second vibration cam 154, and the respective vibration switching levers 172. The spindle 55 is rotatable by the motor 10. The first vibration cam 152 is fixed to the spindle 55. The first vibration cam 152 is located inward of the housing 2. The second vibration cam 154 is located inward of the gear housing 52. The second vibration cam 154 is configured to be in friction with the first vibration cam 152. The vibration switching levers 172 switch between the rotatable condition and the unrotatable condition of the second vibration cam 154 to the gear housing 52. The three vibration switching levers 172 are circumferentially arranged and disposed to be movable back and forth. Accordingly, compared with the conventional case where the vibration switching lever having a long rod shape in the front-rear direction (the axial direction of, for example, the spindle 55) moves inside a slit in the front-rear direction disposed in the gear housing, the vibration switching levers 172 become short. Thus, the electric vibration driver drill 1 that includes the compact vibration switching means including the vibration switching levers 172 and further is entirely compact in the front-rear direction is provided. Additionally, compared with a case where the vibration switching lever 172 is not circumferentially arranged and is formed into an integrated ring, the slit formed from the end surface of the gear housing 52 is unnecessary. That is, while the integrated ring requires the slit from the end surface to install this ring to the gear housing, the respective vibration switching levers 172 circumferentially divided into one another can be mounted to the gear housing 52 even without the slit from the end surface. Therefore, the retention performance of the lubricant such as the grease is improved and rigidity of the gear housing 52 is improved, and thus the inner members can be held with more certainty.

Note also in a modification example where the vibration switching lever is formed into the integrated ring and the slit from the end surface is disposed, the vibration switching lever and the slit become compact in the front-rear direction compared with the conventional rod-shaped vibration switching lever and the conventional slit.

Further, the respective vibration switching levers 172 form the ring shape in combination. Thus, the electric vibration driver drill 1 becomes compact in the front-rear direction and includes the gear housing 52 with high strength is provided.

Further, the housing 2 includes the main body housing 20 and the gear housing 52 located inward of the main body housing 20. The respective vibration switching levers 172 are located inward of the main body housing 20 and outward of the gear housing 52. This configuration facilitates installing the respective vibration switching levers 172 such that they are smoothly movable in the axial direction.

Further, the vibration switching lever 172 each includes the bulge portion 172*b* for the vibration switching lever 172 to axially (front-rear direction) move. Accordingly, the respective vibration switching levers 172 integrally including the cam portions for axial movement makes the vibration switching levers 172 axially compact.

In addition, the electric vibration driver drill 1 includes the motor 10, the spindle 55, the first vibration cam 152, the housing 2 (gear housing 52), the second vibration cam 154, and the respective vibration switching levers 172. The spindle 55 is rotatable by the motor 10. The first vibration cam 152 is fixed to the spindle 55. The first vibration cam 152 is located inward of the housing 2. The second vibration cam 154 is located inward of the gear housing 52. The second vibration cam 154 is configured to be in friction with the first vibration cam 152. The vibration switching levers 172 switch between the rotatable condition and the unrotatable condition of the second vibration cam 154 to the gear housing 52. The gear housing 52 has the plurality of holes 52*o* in the radial direction. The respective vibration switching levers 172 enter into the corresponding holes 52*o*. Accordingly, compared with the conventional case where the vibration switching lever having the long rod shape in the front-rear direction moves inside a slit in the front-rear direction disposed in the gear housing, the electric vibration driver drill 1 becomes compact in the front-rear direction and the strength of the gear housing 52 is improved.

Configurations and modification examples of the disclosure are not limited to the above-described configurations and modification example, and, for example, additional modifications as follows can be appropriately applied.

At least one of the circular plates 122 and the washer 124 may be omitted. The circular plates 122 may be located on the clutch ring 53 side, and the washer 124 may be located on the mode switching ring 54 side. The circular plates 122 may be located on both sides, and the washers 124 may be located on both sides.

Instead of the balls 120 or together with the balls 120, a washer (sliding member) made of resin having smooth front surface and rear surface may be employed. Without the use of the balls 120, the mode switching ring 54 and the clutch ring 53 slide on the smooth surfaces of the washer to reduce the friction.

These locations may be changed to, for example, the mode switching ring 54 being located on the rear side of the clutch ring 53. Further, at least any of the mode switching ring 54 and the clutch ring 53 may be externally mounted to the housing 2 or may be changed to another ring operable by the worker.

The clutch mechanism 99 may be an electric clutch. The vibration mechanism 150 may electrically generate vibrations. The vibration mechanism 150 may be omitted, and an electric driver drill without the vibration mode may be used. The clutch mechanism 99 may be omitted, and a vibration drill without the clutch mode may be used. The drill mode may be omitted, and a vibration driver without the drill mode may be used.

The pin holders 102*d* may hold the internal gear lock pins 106 by another configuration such as a press-fitting of a projection to a hole. Other configurations of holding, press-fitting, and the like may be appropriately changed similarly.

The fan 44 may be located forward with respect to the stator 40.

As the battery 32, any lithium-ion battery with 14.4 V, 18 V (maximum: 20 V), and 18 to 36 V such as 18 V, 25.2 V, 28 V, and 36 V can be used, a lithium-ion battery with a voltage less than 10.8 V or more than 36 V can be used, and a battery of another type can be used.

The gear housing 52 may be held in the main body housing 20. At least any of the number of sections of the housing 2, the number of installations of the planetary gears, the number of stages of the deceleration mechanism, the number of various balls, the number of rollers 130, the numbers of various protrusions (the projecting portions, the projecting pieces, convex portions, and the like), the number of various pins, the number of various springs, and the number of various screws may be increased and decreased from the above-described numbers. Materials of various members may be changed, such as a ball made of steel being changed to a ball made of resin. Configurations of various operation units, such as the configuration of the switch of the switch lever 8, may be changed. Locations of various members or parts may be changed, such as the spring holder 90 of the clutch mechanism 99 being located radially inward of the pin holder 102 for locking the internal gear 82. The shapes of the various members may be changed, such as the circular plates 122 being formed into a regular polygonal plate.

Additionally, the disclosure may be applied to an angle power tool in which a direction of an output shaft (tool bit holder) is different from (becomes approximately 90 degrees) a direction of a power unit (at least one of a direction among a direction of a motor shaft of a motor and a transmission direction of a mechanism that transmits its rotational force).

Further, the disclosure may be applied to, for example, a vibration driver drill other than a rechargeable vibration driver drill (driven by a battery) including one driven by a commercial power supply, or other electric power tools other than a vibration driver drill, or a cleaner, a blower, or a gardening tool including a gardening trimmer.

It is explicitly stated that all features disclosed in the description and/or the claims are intended to be disclosed separately and independently from each other for the purpose of original disclosure as well as for the purpose of restricting the claimed invention independent of the composition of the features in the embodiments and/or the claims. It is explicitly stated that all value ranges or indications of groups of entities disclose every possible intermediate value or intermediate entity for the purpose of original disclosure as well as for the purpose of restricting the claimed invention, in particular as limits of value ranges.

What is claimed is:

1. An electric power tool comprising:

a motor;

a spindle rotatable by the motor;

a first vibration cam fixed to the spindle;

a housing, the first vibration cam being located inward of the housing;

a second vibration cam located inward of the housing, the second vibration cam being configured to be in frictional contact with the first vibration cam;

a set of three vibration switching levers that are (i) each arcuate-shaped and circumferentially arranged, and (ii) collectively form a ring shape, the vibration switching levers operating to switch between a rotatable condition and an unrotatable condition of the second vibration cam with respect to the housing; and a plurality of biasing members that bias the set of three vibration switching levers.

2. The electric power tool according to claim 1, wherein three or more of the biasing members are disposed and circumferentially arranged.

3. The electric power tool according to claim 1, wherein the second vibration cam has a plurality of claws, and each vibration switching lever includes a vibration switching claw, and each vibration switching claw is hooked to one of the claws to block the rotation of the second vibration cam.

4. An electric power tool comprising:

a motor;

a spindle rotatable by the motor, a first vibration cam fixed to the spindle;

a housing, the first vibration cam being located inward of the housing;

a second vibration cam located inward of the housing, the second vibration cam being configured to be in frictional contact with the first vibration cam; and a set of three vibration switching levers that are (i) each arcuate-shaped and circumferentially arranged, and (ii) collectively form a ring shape, the vibration switching levers operating to switch between a rotatable condition and an unrotatable condition of the second vibration cam with respect to the housing, wherein the set of three vibration switching levers are disposed to be movable back and forth.

5. The electric power tool according to claim 4, wherein the housing includes a main body housing and a gear housing located inward of the main body housing, and the vibration switching levers are located inward of the main body housing and radially outward of a tubular portion of the gear housing.

6. The electric power tool according to claim 4, wherein the vibration switching lever includes a vibration switching cam portion for the vibration switching lever to axially move.

7. The electric power tool according to claim 1, further comprising a vibration support ring disposed in front of the set of three vibration switching levers, the vibration support ring having a plurality of cam depressed portions each configured to receive a bulge portion that is disposed on each of the three vibration switching levers.

8. The electric power tool according to claim 4, further comprising a vibration support ring disposed in front of the set of three vibration switching levers, the vibration support ring having a plurality of cam depressed portions each configured to receive a bulge portion that is disposed on each of the three vibration switching levers.

9. The electric power tool according to claim 7, further comprising a mode switching ring that, when rotated, causes the bulge portion to contact one of the cam depressed portions.

10. The electric power tool according to claim 8, further comprising a mode switching ring that, when rotated, causes the bulge portion to contact one of the cam depressed portions.

11. The electric power tool according to claim 3, further comprising a mode switching ring that, when rotated, causes each vibration switching claw to be hooked to a corresponding claw of the second vibration cam.

12. The electric power tool according to claim 4, further comprising a mode switching ring, wherein the second vibration cam has a plurality of claws, each vibration switching lever includes a vibration switching claw, and each vibration switching claw is hooked to one of the claws to block the rotation of the second vibration cam, and the mode switching ring, when rotated, causes each vibration switching claw to be hooked to the claws of the second cam.

* * * * *